US011626659B2

(12) United States Patent
Driscoll et al.

(10) Patent No.: US 11,626,659 B2
(45) Date of Patent: Apr. 11, 2023

(54) ANTENNA UNIT WITH PHASE-SHIFTING MODULATOR, AND RELATED ANTENNA, SUBSYSTEM, SYSTEM, AND METHOD

(71) Applicant: Echodyne Corp., Kirkland, WA (US)

(72) Inventors: Tom Driscoll, Bellevue, WA (US); William F. Graves, Jr., Kirkland, WA (US); Jason E. Jerauld, Sammamish, WA (US); Nathan Ingle Landy, Seattle, WA (US); Charles A. Renneberg, Seattle, WA (US); Benjamin Sikes, Seattle, WA (US); Yianni Tzanidis, Springboro, OH (US); Felix D. Yuen, Newcastle, WA (US); Nicholas K. Brune, Kirkland, WA (US)

(73) Assignee: Echodyne Corp., Kirkland, WA (US)

( * ) Notice: Subject to any disclaimer, the term of this patent is extended or adjusted under 35 U.S.C. 154(b) by 595 days.

(21) Appl. No.: 16/402,872

(22) Filed: May 3, 2019

(65) Prior Publication Data

US 2020/0350665 A1 Nov. 5, 2020

(51) Int. Cl.
*H01Q 1/38* (2006.01)
*H01Q 3/34* (2006.01)
(Continued)

(52) U.S. Cl.
CPC ..... *H01Q 1/38* (2013.01); *H01Q 3/34* (2013.01); *H01Q 21/0025* (2013.01); *H01Q 21/0037* (2013.01); *H01Q 25/00* (2013.01)

(58) Field of Classification Search
CPC ..... H01Q 1/38; H01Q 3/34; H01Q 21/0025; H01Q 21/0037; H01Q 25/00; H01Q 21/065; H01Q 3/38
See application file for complete search history.

(56) References Cited

U.S. PATENT DOCUMENTS 4,499,471 A * 2/1985 Luh ..... H01Q 25/02 333/109
6,232,920 B1 5/2001 Brookner et al.
(Continued)

FOREIGN PATENT DOCUMENTS

JP H02224505 A 9/1990

OTHER PUBLICATIONS

International Searching Authority, "International Search Report and Written Opinion from PCT Application No. PCT/US2020/030810", from Foreign Counterpart to U.S. Appl. No. 16/402,872, dated Jul. 27, 2020, pp. 1 through 14, Published: WO.

*Primary Examiner* — Minh D A
(74) *Attorney, Agent, or Firm* — Volpe Koenig

(57) ABSTRACT

An embodiment an antenna unit of an antenna array includes a signal coupler, a phase-shifting modulator, and an antenna element. The signal coupler has a first input-output port, a second input-output port, and a coupled port. The phase-shifting modulator is coupled to the coupled port of the signal coupler, and the antenna element is coupled to the phase-shifting modulator via a connection remote from the signal coupler, or via an isolated port of the signal coupler. The phase-shifting modulator is configured for both relatively low signal loss and relatively low power consumption such that the antenna array can have significantly lower C-SWAP metrics than a conventional phased array while retaining the higher performance metrics of a conventional phased array.

29 Claims, 21 Drawing Sheets

(51) Int. Cl.
*H01Q 21/00* (2006.01)
*H01Q 25/00* (2006.01)

(56) References Cited

U.S. PATENT DOCUMENTS

| | | | | |
|---|---|---|---|---|
| 9,118,113 | B2 | 8/2015 | Mortazawi et al. | |
| 2010/0171674 | A1 | 7/2010 | Henderson | |
| 2015/0200467 | A1* | 7/2015 | Kurk | H01Q 5/50 343/853 |
| 2017/0026006 | A1* | 1/2017 | Roukos | H03F 3/19 |
| 2017/0194688 | A1* | 7/2017 | Sharma | H01P 5/16 |
| 2019/0103665 | A1* | 4/2019 | Yoo | H01Q 15/0086 |

* cited by examiner

ANTENNA UNIT WITH PHASE-SHIFTING MODULATOR, AND RELATED ANTENNA, SUBSYSTEM, SYSTEM, AND METHOD

CROSS-REFERENCE TO RELATED APPLICATION

This application is related to U.S. patent application Ser. No. 16/159,567, filed Oct. 12, 2018, and titled "BEAM-STEERING ANTENNA," which claims priority from U.S. Provisional Patent Application No. 62/572,043, filed Oct. 13, 2017, the content of the related applications is incorporated herein by reference.

SUMMARY

A phased-array antenna, or phased array, is configured to steer one or more narrow, electromagnetic-signal beams over a prescribed region of space by shifting the phase of a reference wave by a respective amount at each of a multitude of antenna elements. Typically, a phased array includes, for each antenna element, a respective phase-shift circuit, or phase shifter, to perform such phase shifting.

Unfortunately, although it typically offers unparalleled beam-steering performance and agility, a phased array typically suffers from significant cost, size, weight, and power (C-SWAP) limitations due, in large part, to the phase shifters. For example, although a low-loss phase shifter can maintain an antenna's power consumption at an acceptable level for a given application, such a phase shifter is typically bulky (i.e., large and heavy) and expensive. And although a reduced-size phase shifter can meet the cost, size, and weight specifications for a given application, such a phase shifter typically exhibits high signal loss, and, therefore, typically requires a corresponding power amplifier at the phase shifter's input node or output node; the inclusion of one power amplifier per phase shifter not only can cause the power consumption of the phased array to exceed a specified level, but also can offset, at least partially, the reductions in cost, size, and weight that the low-loss phase shifter provides.

An embodiment of an antenna array that solves one or more of the above problems with a phased array is configured to adjust the phase of a respective signal radiated or received by each antenna element without a conventional phase shifter. For example, each antenna unit of the antenna array can include a phase-shifting modulator that is configured for relatively low signal loss and relatively low power consumption, and can have a relatively small size. Therefore, an embodiment of such an antenna array can have significantly lower C-SWAP metrics while retaining the higher performance metrics of a phased array.

An embodiment an antenna unit of such an antenna array includes a signal coupler, a phase-shifting modulator, and an antenna element. The signal coupler has a first input-output port, a second input-output port (also referred to herein as "signal ports"), and a signal-coupled port (also referred to herein as a "coupled port"). The phase-shifting modulator is coupled to the first coupled port of the signal coupler, and the antenna element is coupled to the phase-shifting modulator.

The phase-shifting modulator can be configured as a through phase modulator or as a reflective reactance modulator, can be configured for low power consumption (e.g., approximately 0.1-1.0 Watts (W)), can be configured for low insertion loss (e.g., 3 db or less of insertion loss), and can be configured to receive one or more control signals that represent single-bit or multi-bit control of the phase that the phase shifter imparts to a signal. Alternatively, the phase-shifting modulator can be configured to receive an analog control signal for a continuous (i.e., analog) selection of the phase that the phase-shifting modulator imparts to a signal.

In an embodiment in which the phase-shifting modulator is a through phase modulator, one port of the through phase modulator is coupled to the coupled port of the signal coupler, and another port of the through phase modulator is coupled to the antenna element.

And in an embodiment in which the phase-shifting modulator is a reflective reactance modulator, a port of the reactance modulator is coupled to the coupled port of the signal coupler, and the antenna element is coupled to a signal-isolated port (also referred to herein as an "isolated port") of the signal coupler, and, therefore, is coupled to the reactance modulator via the isolated and coupled ports of the signal coupler.

By allowing selection of phase shift applied to a signal, an embodiment of an antenna unit can omit a conventional phase shifter yet still can be configured such that an antenna including the antenna unit can have, between adjacent antenna elements, a minimum lattice spacing $d_1$ that approaches the theoretical maximum practical lattice spacing of $\lambda/2$ (at least in one dimension of an antenna array, such as the azimuth dimension), where $\lambda$ is the wavelength of a reference wave in the medium in which an antenna including the antenna unit is configured to radiate. For example, if an antenna is configured to radiate in air, then the wavelength can be approximated as the free-space wavelength $\lambda_0$ because the magnetic permeability and the electric permittivity of air are approximately equal to the magnetic permeability and the electric permittivity of a vacuum, respectively.

Furthermore, an antenna that includes an embodiment of antenna unit such as described above may be better suited for some applications than a conventional phased array. For example, a phased array of a traditional radar system may be too dense and may scan a field of view (FOV) too slowly, and the radar system may be too expensive, for use in an autonomous (self-driving) automobile. Similarly, a phased array of a traditional radar system may be too dense, and the radar system may be too expensive, too heavy, and too power hungry, for use in an unmanned aerial vehicle (UAV) such as a drone.

DETAILED DESCRIPTION

The words "approximately," "substantially," other forms thereof, and other similar words, may be used below to indicate that two or more quantities can be exactly equal, or can be within ±10%, inclusive, of one another due to, for example, manufacturing tolerances, or other design considerations, of the physical structures described below. And for a value of a quantity a being in a range of values b to c, "approximately," "substantially," other forms thereof, and other similar words, may be used to indicate the value of a being between $b-10\%|c-b|$ to $c+10\%|c-b|$ inclusive.

Figure 1:
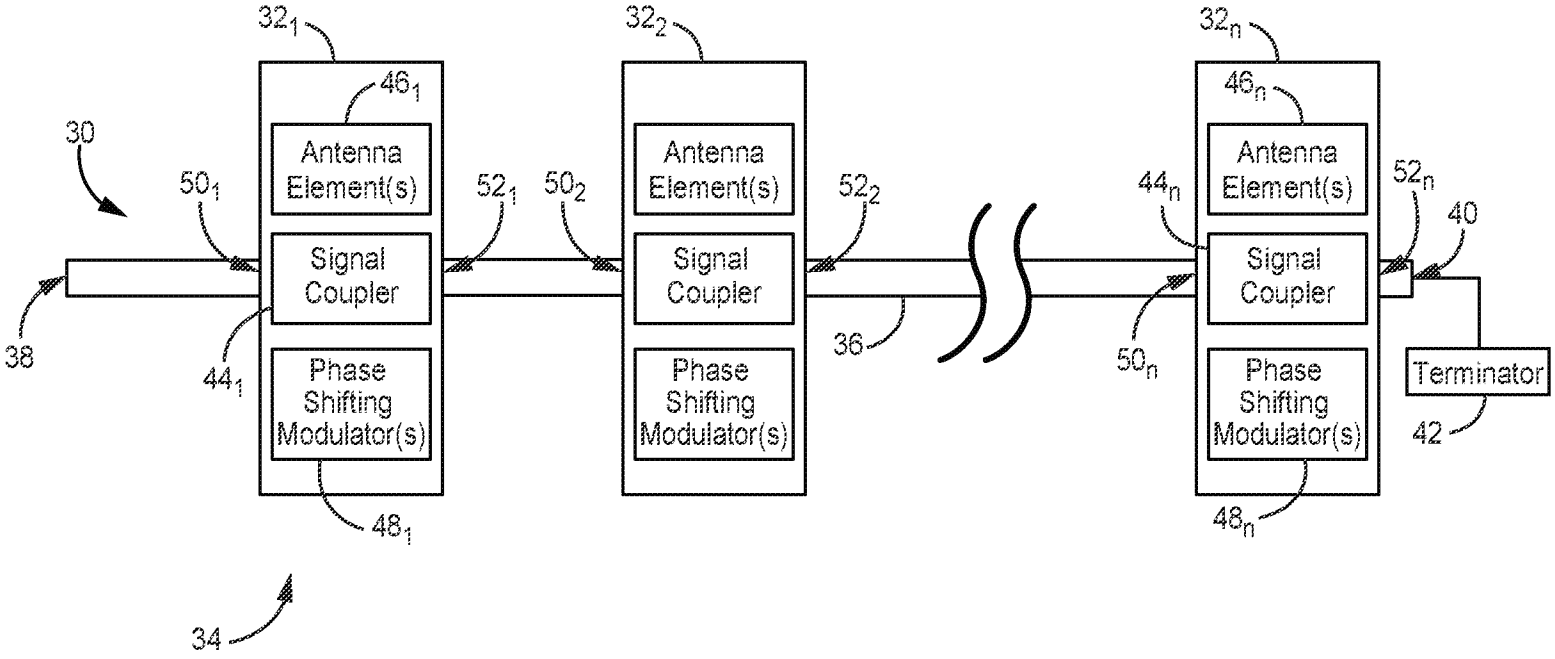
FIG. 1 is a diagram of a row of antenna units of a phased antenna array, according to an embodiment.

FIG. 1 is a plan view of a row 30 of antenna units $\mathbf{32}_1$-$\mathbf{32}_n$ of an antenna array 34, where each of the antenna units is configured to shift the phase of a transmitted or received signal, according to an embodiment. The antenna array 34 can include one or more additional rows 30 of antenna units 32, these possible additional rows not shown in FIG. 1.

The phase-shifting antenna units 32 can provide the antenna array 34 (hereinafter "antenna" or "antenna array") with:

a. performance metrics (e.g., beam-steering resolution), antenna-element spacing, and component density that are on par, respectively, with the performance metrics, antenna-element spacing, and component density of a conventional phased antenna array, and b. C-SWAP metrics that are significantly lower, i.e., significantly improved, as compared with the C-SWAP metrics of a phased array.

That is, the phase-shifting antenna units 32 can impart to the antenna 34 one or more of the best features of a conventional phased antenna array and mitigate one or more of the worst features of a phased array. For example, the antenna 34 may have a lattice spacing $d_1$, which approaches $\lambda_0/2$ (e.g., $d_1 \approx 0.4\lambda_0$), where $\lambda_0$ is the free-space wavelength of a signal that the antenna is configured to transmit, to receive, or to both transmit and to receive. The lattice spacing $d_1$ is the spacing between immediately adjacent antenna elements (e.g., antenna elements 46 described below) measured from a location (e.g., rightmost edge) of one of the antenna elements to the same relative location (e.g., rightmost edge) of the other of the antenna elements.

Still referring to FIG. 1, in addition to the antenna units 32, each row 30 includes a respective transmission medium 36 having a signal input-output port 38 and a signal-termination port 40, and a respective row signal terminator 42 coupled to the signal-termination port.

Each antenna unit 32 includes respective signal coupler 44, one or more antenna elements 46, one or more phase-shifting modulators 48, a first signal input-output port 50, and a second signal input-output port 52.

The signal coupler 44 is coupled to the transmission medium 36 via the signal ports 50 and 52, to the one or more antenna elements 46, and to the one or more phase shifters 48, and can have any suitable configuration. For example, each signal coupler 44 can be described as effectively being coupled in electrical series with respective sections of the transmission medium 36, as including a respective portion of the transmission medium, or as being electrically coupled to the transmission medium. Furthermore, each signal coupler 44 can be a backward wave coupler or a forward wave coupler, and can be configured to present, at its ports, suitable input and output impedances. Embodiments of the signal coupler 44 are described in more detail below in conjunction with FIGS. 2-3, and 7-16.

Each of the one or more antenna elements 46 can have any suitable configuration. For example, an antenna element 46 can be an approximately planar conductor having at least one dimension (e.g., in the dimension along which the row 30 of antenna units 32 is aligned, or in the orthogonal dimension) approximately equal to $\lambda_m/2$, can be configured as a voltage radiator, and can be configured to present suitable input and output impedances to the signal coupler 44 or to a respective phase shifter 48 ($\lambda_m$ is the wavelength (e.g., center wavelength, carrier wavelength) of the signal that each antenna element 46 transmits or receives in the transmission medium 36).

And each of the one or more phase-shifting modulators 48 is configured to impart, to a signal, a controllable phase (e.g., controllable in response to one or more control signals), can have any suitable topology, and can be configured to provide any suitable input and output impedances. For example, a phase-shifting modulator 48 can be a through phase modulator or a reflective reactance modulator, can be configured to have a suitably low level of signal attenuation (e.g., a suitably low insertion loss such as 3 dB or less) and a suitably low level of power consumption (e.g., 0.1-1.0 W or less), and can be configured to provide one or more bits of phase resolution. Embodiments of a phase-shifting modulator 48 are described in more detail below in conjunction with FIGS. 4-6 (through phase modulator) and FIGS. 17-19 (reflective reactance modulator).

The transmission medium 36 can be any suitable transmission medium, such as a strip line, a microstrip line, a coplanar waveguide (CPW), a ground-plane-backed coplanar waveguide (GBCPW), or an enclosed waveguide (e.g., a waveguide with a rectangular cross section). Furthermore, the transmission medium 36 can be configured to support to any suitable propagation mode (e.g., mode $TE_{10}$) of a reference wave, and to suppress any unsuitable propagation mode(s) of a reference wave. And the transmission medium can be configured (e.g., tapered in the dimension along which the row 30 of antenna units 32 is aligned) to provide an approximately uniform signal power to each of the antenna units.

And the terminator 42 is configured to present, at the termination port 40 of the transmission medium 36, a termination impedance having a value that renders negligible signal reflections or other signal redirections at the termination port. The terminator 42 can have any suitable topology and structure.

Still referring to FIG. 1, operation of the antenna 34 is described during transmit and receive modes, according to an embodiment.

During a transmit mode, a reference-wave generator (not shown in FIG. 1) generates a transmit reference wave, and couples the transmit reference wave to the signal port 38 of the transmission medium 36, and a controller circuit (not shown in FIG. 1) generates one or more sets of control signals, and couples each of the one or more sets of control signals to a respective one of the phase-shifting modulators 48.

The signal coupler $\mathbf{44}_1$ receives, at the signal port 501, the reference wave from the signal port 38 of the transmission medium 36, directs a first portion (or component) of the reference wave to the signal port $\mathbf{52}_1$, and respectively directs one or more second portions of the reference wave (also called "transmit intermediate signals") to the one or more phase-shifting modulators $\mathbf{48}_1$.

Each of the one or more phase-shifting modulators $\mathbf{48}_1$ shifts the phase of a respective transmit intermediate signal in response to the respective set of one or more control signals (not shown in FIG. 1) that the phase-shifting modulator receives, and, as described below, either the signal coupler $\mathbf{44}_1$ or each of the one or more phase-shifting modulators $\mathbf{48}_1$ couples a respective phase-shifted transmit intermediate signal to a respective one of the antenna elements $\mathbf{46}_1$.

And each antenna element $\mathbf{46}_1$ radiates a respective transmit signal in response to the respective phase-shifted transmit intermediate signal from a respective one of the phase-shifting modulators $\mathbf{48}_1$.

The other antenna units 32 in the row 30 operate in a similar manner, except that the last antenna unit $\mathbf{32}_n$ in the row directs, via the signal port $\mathbf{52}_n$, a first portion of the reference wave to the terminator 42 via the termination port 40 of the transmission medium 36. As stated above, the terminator 42 has an impedance that approximately matches the impedance that the transmission medium 36 presents to the terminator at the port 40; therefore, the terminator causes reflections of the transmit reference wave at the port 40 to have, ideally, zero energy, or otherwise to have a level of energy that is below a reflection-energy threshold that is suitable for the application in which the antenna 34 is being used.

The antenna units 32 in other antenna rows (if present) of the antenna 34 operate in a similar manner as the antenna units of the antenna row 30.

The transmit signals from each of the antenna units 32 of the antenna 34 combine to form a transmit beam pattern having one or more main transmit beams (not shown in FIG. 1).

By controlling the respective phase shift imparted by each of the phase-shifting modulators 48, and, therefore, by controlling the relative phases of the transmit signals radiated by the antenna elements 46, the controller circuit (not shown in FIG. 1) can steer one or more main transmit beams (not shown in FIG. 1) in multiple dimensions, such as in azimuth (AZ) and elevation (EL) dimensions.

Still referring to FIG. 1, during a receive mode, a controller circuit (not shown in FIG. 1) generates one or more sets of control signals, and couples each of the one or more sets of control signals to a respective one of the phase-shifting modulators 48.

Each of the one or more antenna elements $\mathbf{46}_n$ of the antenna unit $\mathbf{32}_n$ receives, from a source remote from the antenna 34, a respective receive signal, generates, in response to the respective receive signal, a respective receive antenna signal (also called a "receive intermediate signal"), and couples the respective receive intermediate signal to a respective one of the phase-shifting modulators $\mathbf{48}_n$.

Each of the one or more phase-shifting modulators $\mathbf{48}_n$ of the antenna unit $\mathbf{32}_n$ shifts the phase of a respective one of the one or more receive intermediate signals in response to the respective set of one or more control signals (not shown in FIG. 1) that the phase-shifting modulator receives, and couples a respective phase-shifted receive intermediate signal to the signal coupler $\mathbf{44}_n$.

The signal coupler $\mathbf{44}_n$ receives the one or more phase-shifted receive intermediate signals, effectively combines the one or more phase-shifted received intermediate signals to generate a superimposed signal (if there is only one phase-shifted signal, then the superimposed signal effectively equals the one phase-shifted signal), and couples the superimposed signal to the transmission medium 36 at the port $\mathbf{50}_n$ to form a receive reference wave that propagates along the transmission medium toward the signal port 38.

The other antenna units 32 in the row 30 operate in a similar manner, except that each of the other antenna units effectively sums the superimposed signal that it generates with the receive reference signal that the antenna unit receives at its port 52 to generate, at its port 50, a modified receive reference wave; and the antenna unit $\mathbf{32}_1$ couples a final version of the receive reference wave (also called a "row receive reference wave" or a "row output receive reference wave") to a signal analyzer (not shown in FIG. 1) via the port 38 of the transmission medium 36.

The antenna units 32 in other antenna rows (if present) of the antenna 34 operate in a similar manner as the antenna units of the antenna row 30.

The row receive reference waves from all of the antenna rows 30 are superimposed to form a total receive reference wave, from which a signal analyzer (not shown in FIG. 1) forms a receive beam pattern having one or more main receive beams. If, for example, the antenna 34 forms part of a radar subsystem, then the signal analyzer analyzes the receive beam pattern, particularly the one or more main receive beams, to detect one or more objects.

Said another way, the superimposed signals generated by the signal couplers 44 in all of the one or more antenna units 32 combine to form a receive beam pattern having one or more main receive beams (not shown in FIG. 1) that a signal analyzer can analyze, e.g., to detect one or more objects.

By controlling the phase shifts imparted by each of the phase-shifting modulators 48, and, therefore, by controlling the relative phases of the receive intermediate signals generated by the antenna elements 46, the controller circuit (not shown in FIG. 1) can steer the one or more main receive beams (not shown in FIG. 1) in multiple dimensions, such as in AZ and EL.

Still referring to FIG. 1, alternate embodiments of the antenna row 30, the antenna units 32, and the antenna 34 are contemplated. For example, one antenna row 30 can have a different number, or a different type, of antenna units 32 than another antenna row. Furthermore, a controller circuit (not shown in FIG. 1) can deactivate each of one or more of the antenna units 32 during a transmit mode or a receive mode such that each of the deactivated antenna units effectively radiates a transmit signal of zero energy or of a level of non-zero energy that is negligible for the application, or effectively receives a receive signal of zero energy or of a level of non-zero energy that is negligible for the application. Moreover, one or more embodiments described below in conjunction with FIGS. 2-21 may be applicable to the antenna row 30, the antenna units 32, or the antenna 34 of FIG. 1.

Figure 2:
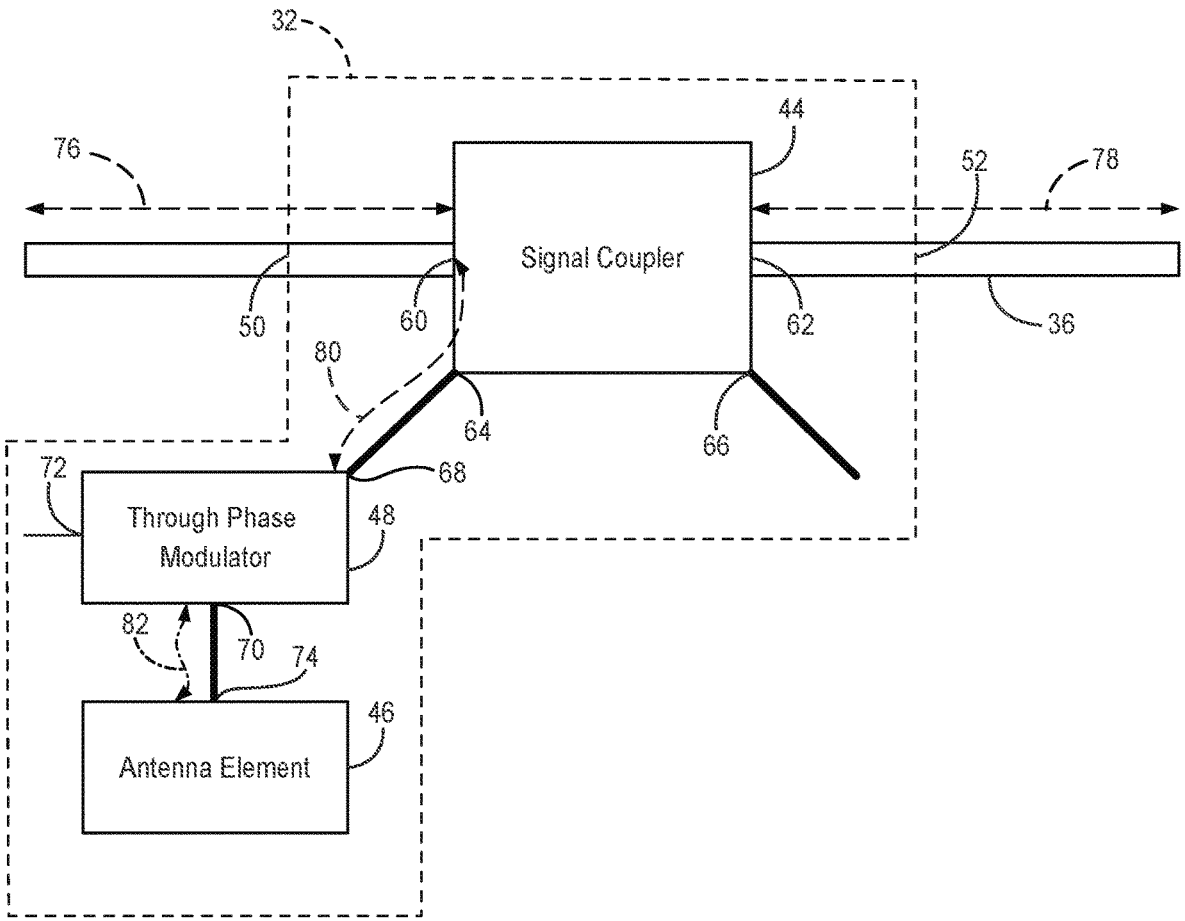
FIG. 2 is a diagram of an antenna unit of FIG. 1 including a single antenna element and a through phase modulator, according to an embodiment.

FIG. 2 is a diagram of one of the antenna units 32 of FIG. 1, which antenna unit includes a single antenna element 46 and a single through phase modulator 48, according to an embodiment in which components common to FIGS. 1 and 2 are labeled with same reference numbers.

The signal coupler 44 includes a signal port 60 coupled to the signal port 50 of the antenna unit 32, a signal port 62 coupled to the signal port 52 of the antenna unit, a signal-coupled port 64, and an optional signal-isolated port 66. In an embodiment, the signal port 50 is the same port as the signal port 60, and the signal port 52 is the same as the signal port 62; that is, in an embodiment, the ports 50 and 60 are a same, single port, and the ports 52 and 62 are another same, single port.

Figure 4:
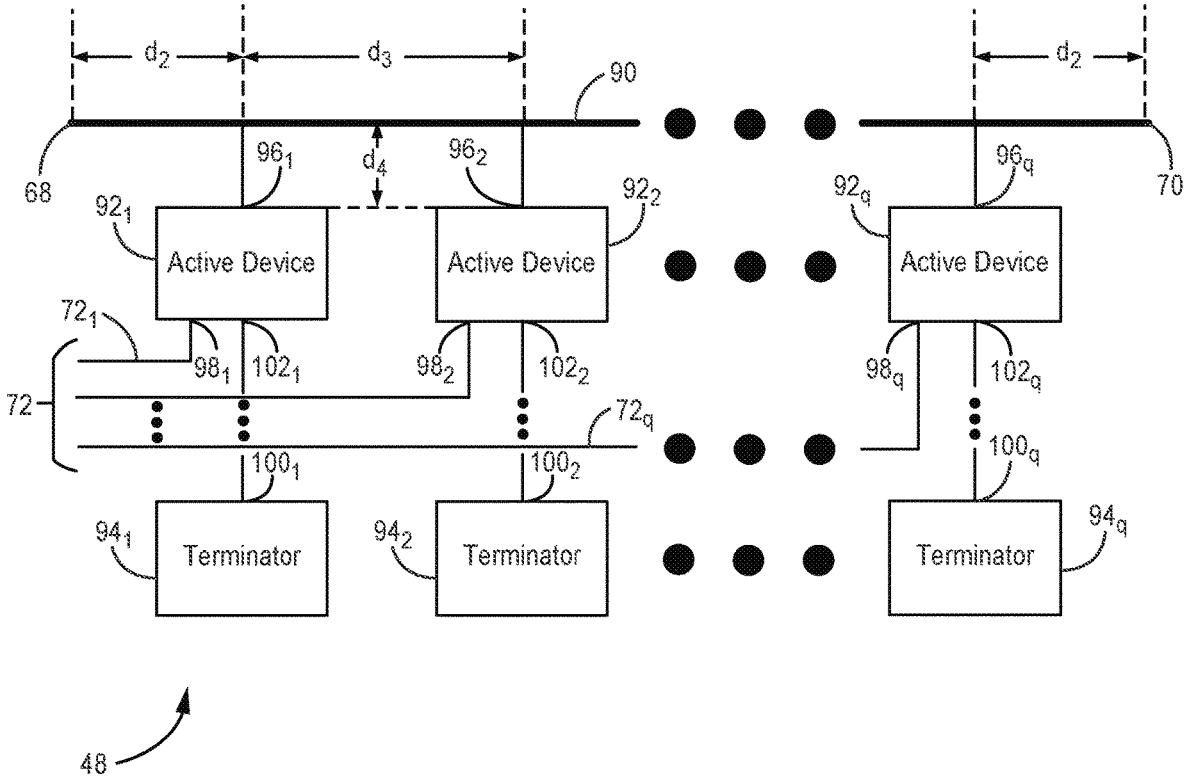
FIG. 4 is a diagram of a through phase modulator of FIGS. 1-3, according to an embodiment.

The through phase modulator 48 includes a signal port 68 coupled to the signal-coupled port 64 of the signal coupler 44, a signal port 70, and one or more control nodes 72 each configured to receive a respective control signal from a controller circuit (not shown in FIG. 4). The phase modulator 48 is called a "through phase modulator" because it is configured to receive a signal on one of the ports 68 and 70, to shift the phase of the received signal by an amount related to the values of the one or more control signals, and to provide the phase-shifted signal at the other one of the ports 68 and 70. As described above, the through phase modulator 48 is configured to have a relatively small size, a relatively light weight, and a relatively low signal-insertion loss, and to consume a relatively low level of power. For example, the through phase modulator 48 can be disposed on a single layer of a platform such as a printed circuit board (PCB), can have as few as one active component (e.g., a two-terminal impedance device) per control node 72, can have an insertion loss that is no higher than approximately 3 dB, and can have a power consumption that is no higher than approximately 1 W.

And the antenna element 46 includes a signal port 74 coupled to the signal port 70 of the phase modulator 48.

In operation during a transmit mode, the signal coupler 44 receives, on the signal port 60, the transmit reference wave as indicated by the right-side arrowhead of a signal-path-indication line 76, couples a first portion of the received transmit reference wave to the port 62, and couples a second portion of the transmit reference wave, called the transmit intermediate signal, to the signal-coupled port 64. And as indicated by the right-side arrowhead of a signal-path-indication line 78, the signal coupler 44 couples the first portion of the reference wave from the port 62 to the transmission medium 36 directly or via the port 52 if present. Depending on the position of the antenna unit 32 in the row of antennas, the power of the first portion of the transmit reference wave that the signal coupler 44 effectively returns to the transmission medium 36 can be much different than the power of the transmit intermediate signal that the signal coupler couples to the signal-coupled port 64. For example, the power of the first portion of the reference wave can be in an approximate range of one time to ten thousand times greater than the power of the transmit intermediate signal.

The through phase modulator 48 receives, on its port 68, the transmit intermediate signal from the coupled-signal port 64 of the signal coupler 44 as indicated by the lower arrowhead of a signal-path-indication curve 80, and receives, on the one or more control nodes 72, a respective one or more control signals from a controller circuit (not shown in FIG. 2).

In response to the one or more control signals, the phase modulator 48 shifts the phase of the transmit intermediate signal by an amount related to the values of the one or more control signals, and provides the phase-shifted transmit intermediate signal at the port 70. For example, each of the control signals can represent a respective bit of phase-shift resolution between 0° and 360°. Further in example, if the number of control signals is two, then the control signals can cause the relative phase shift that the phase modulator 48 imparts to the intermediate signal to be approximately one of the following four values: 0°, 90°, 180°, and 270°. The through phase modulator 48 can be configured with any suitable number of bits of phase-shift resolution, such as approximately between one and sixteen bits of phase-shift resolution, to provide a number of possible different values of phase shift in an approximate range of two values to two hundred fifty six values.

The antenna element 46 receives, at the signal port 74, the phase-shifted transmit intermediate signal from the port 70 of the through phase modulator 48 as indicated by the lower arrowhead of a signal-path-indication curve 82, and, in response to the phase-shifted signal, radiates a transmit signal having approximately the same phase and approximately the same frequency as the phase-shifted transmit intermediate signal.

In operation during a receive mode, the antenna element 46 receives a receive signal from a remote source, and, in response to the receive signal, generates, at the port 74, a receive intermediate signal having approximately the same phase and approximately the same frequency as the receive signal.

Figure 3:
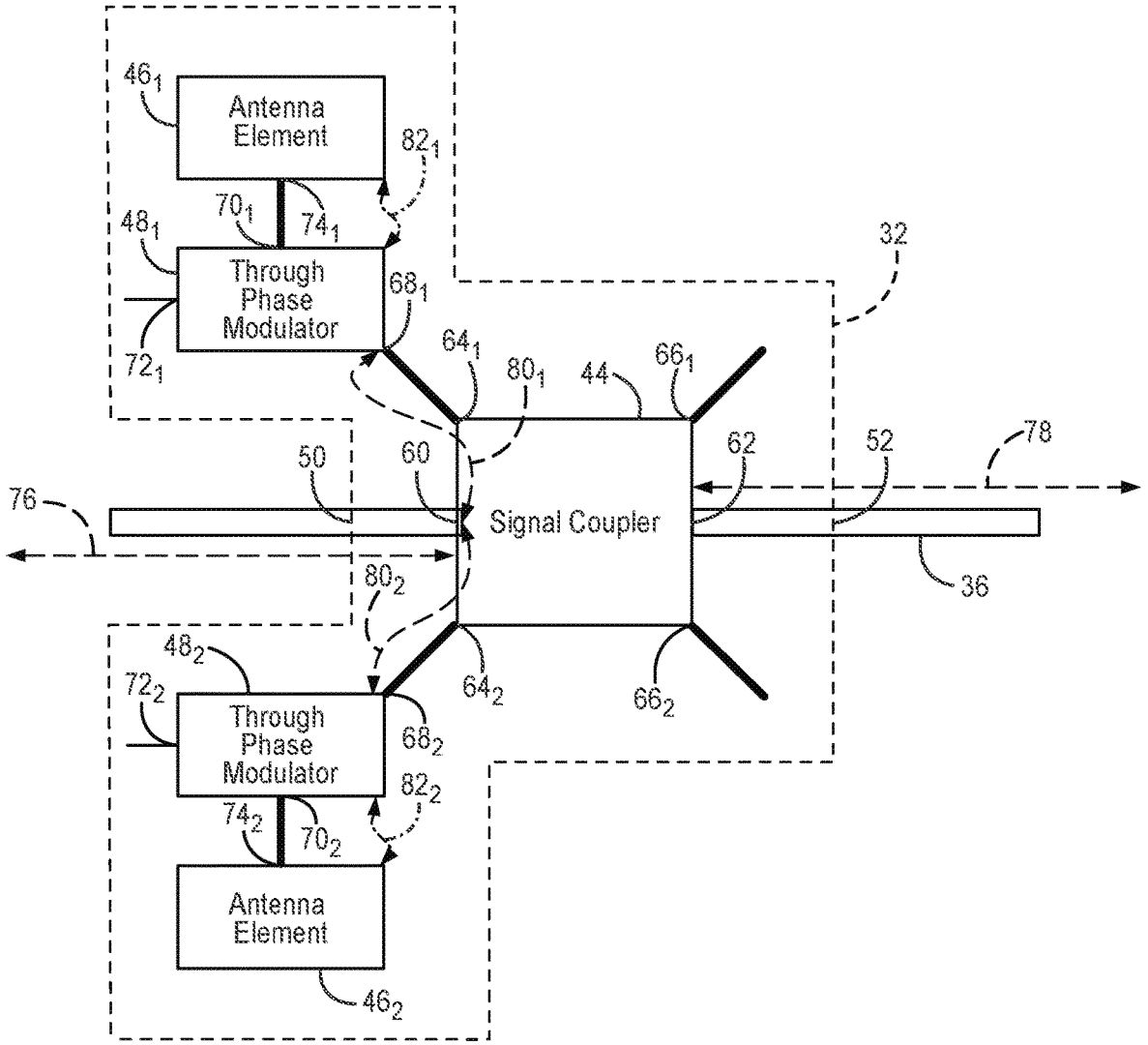
FIG. 3 is a diagram of an antenna unit of FIG. 1 including dual antenna elements and through phase modulators, according to another embodiment.

The through phase modulator 48 receives, on the port 70, the receive intermediate signal from the port 74 of the antenna element 46 as indicated by the upper arrowhead of the signal-path-indication curve 82, and receives, on the one or more control nodes 72, a respective one or more control signals from a controller circuit (not shown in FIG. 3).

In response to the one or more control signals, the phase modulator 48 shifts the phase of the receive intermediate signal by an amount related to the values of the one or more control signals, and provides the phase-shifted receive intermediate signal at the port 68. For example, each of the control signals can represent a respective bit of phase-shift resolution between 0° and 360°. Further in example, if the number of control signals is two, then the control signals can cause the relative phase shift that the phase modulator 48 imparts to the receive intermediate signal to be approximately one of the following four values: 0°, 90°, 180°, and 270°. The through phase modulator 48 can be configured with any suitable number of bits of phase-shift resolution, such as approximately between one and sixteen bits of phase-shift resolution, to provide a number of possible different values of phase shifts in an approximate range of two values to two hundred fifty six values.

The signal coupler 44 receives, on the coupled-signal port 64, the phase-shifted receive intermediate signal from the phase modulator 48, and couples the phase-shifted signal to the transmission medium 36 via the port 60, and the port 50 if present, as indicated by the upper arrowhead of signal-path-indicator curve 80.

The signal coupler 44 also receives, on the port 62, a receive reference wave (if the antenna unit 32 is other than the last antenna unit $\mathbf{32}_n$ in the row 30 of FIG. 1), and couples the receive reference wave to the transmission medium 36 via the port 60, and via the port 50 if present, as indicated by the leftmost arrowheads of the signal-path-indicator lines 78 and 76.

That is, the signal coupler 44 effectively combines the phase-shifted receive intermediate signal from the coupled-signal port 64 and the receive reference wave from the port 62 by superimposing one of these signals onto the other of these signals, and provides, via the port 60 and the port 50 if present, the combined signal to the transmission medium 36 as a modified receive reference wave. Depending on the location of the antenna unit 32 within the row 30 (FIG. 1), the power of the received reference wave from the port 62 can be very different than the power of the phase-shifted receive intermediate signal that the signal coupler receives at the signal-coupled port 64. For example, the power of the receive reference wave can be in an approximate range of one time to ten thousand times greater than the power of the phase-shifted receive intermediate signal.

Still referring to FIG. 2, alternate embodiments of the antenna unit 32 are contemplated. For example, during operation in both the transmit mode and the receive mode, the antenna element 46 may shift the phase of the phase-shifted transmit intermediate signal or the receive signal, respectively, by other than 0°, and the amount of the phase shift may depend on the frequency of the transmit reference wave and the receive signal, respectively. Furthermore, the signal coupler 44 can be considered to be a four-port signal coupler if the signal coupler includes the signal-isolated port 66, and can be considered to be a three-port signal coupler if the signal coupler lacks the signal-isolated port. Moreover, although the signal coupler 44 is described as a backward coupler, the signal coupler can be a forward coupler in which the relative locations of the signal-coupled port 64 and the signal-isolated port 66 are reversed. In addition, one or more embodiments described above in conjunction with FIG. 1 and below in conjunction with FIGS. 3-21 may be applicable to the antenna unit 32 of FIG. 2.

FIG. 3 is a diagram of one of the antenna units 32 of FIG. 1, which antenna unit includes dual antenna elements $\mathbf{46}_1$ and $\mathbf{46}_2$ and dual through phase modulators $\mathbf{48}_1$ and $\mathbf{48}_2$, according to an embodiment in which components common to FIGS. 1-3 are labeled with same reference numbers. Including dual antenna elements 46 and dual phase modulators 48 can allow a reduction in the area per antenna unit 32, and, therefore, can allow a reduction in the area, in the component density, or in both the area and component density of the antenna 34 (FIG. 1).

The signal coupler 44 of FIG. 3 is similar to the signal coupler 44 of FIG. 2 except that the signal coupler of FIG. 3 has two signal-coupled ports $\mathbf{64}_1$ and $\mathbf{64}_2$ and two optional signal-isolated ports $\mathbf{66}_1$ and $\mathbf{66}_2$. That is, unlike the signal coupler 44 of FIG. 2, which is a three-port (if the isolated port 66 is omitted) or four-port signal coupler, the signal coupler 44 of FIG. 3 is a four-port (if the isolated ports $\mathbf{66}_1$ and $\mathbf{66}_2$ are omitted) or a six-port signal coupler.

The first antenna element $\mathbf{46}_1$ and the first through phase modulator $\mathbf{48}_1$ are similar to the antenna element 46 and the through phase modulator 48, respectively, of FIG. 2, and are coupled to one another and to the first signal-coupled port $\mathbf{64}_1$ of the signal coupler 44 in a manner similar to the manner in which the antenna element 46 and the phase modulator 48 of FIG. 2 are coupled to one another and to the signal-coupled port 64 of the signal coupler 44 of FIG. 2.

Likewise, the second antenna element $\mathbf{46}_2$ and the second through phase modulator $\mathbf{48}_2$ are similar to the antenna element 46 and the through phase modulator 48, respectively, of FIG. 2, and are coupled to one another and to the second signal-coupled port $\mathbf{64}_2$ of the signal coupler 44 of FIG. 3 in a manner similar to the manner in which the antenna element 46 and the phase shifter 48 of FIG. 2 are coupled to one another and to the signal-coupled port 64 of the signal coupler 44 of FIG. 2.

In operation during a transmit mode, the signal coupler 44 receives, on the signal port 60, the transmit reference wave as indicated by the rightmost arrowhead of the signal-path-indicator line 76, couples a first portion of the received transmit reference wave to the port 62, couples a second portion the transmit reference wave, called the first transmit intermediate signal, to the first signal-coupled port $\mathbf{64}_1$, and couples a third portion of the transmit reference wave, called the second transmit intermediate signal, to the second signal-coupled port $\mathbf{64}_2$. And as indicated by the right-side arrowhead of the signal-path-indicator line 78, the signal coupler 44 couples the first portion of the transmit reference wave from the port 62 to the transmission medium 36 directly or via the port 52 (if present). Depending on the position of the antenna unit 32 in the row 30 (FIG. 1), the power of the first portion of the transmit reference wave that the signal coupler 44 effectively returns to the transmission medium can be much different than the powers of the first and second transmit intermediate signals that the signal coupler couples to the first and second signal-coupled ports $\mathbf{64}_1$ and $\mathbf{64}_2$, respectively. For example, the power of the first portion of the transmit reference wave can be in an approximate range of one time to ten thousand times greater than the respective power of each of the first and second transmit intermediate signals.

The first through phase modulator $\mathbf{48}_1$ receives, on the port $\mathbf{68}_1$, the first transmit intermediate signal from the first coupled-signal port $\mathbf{64}_1$ of the signal coupler 44 as indicated by the upper arrowhead of a signal-path-indicator curve $\mathbf{80}_1$, and receives, on the one or more first control nodes $\mathbf{72}_1$, a respective one or more first control signals from a controller circuit (not shown in FIG. 3).

Similarly, the second through phase modulator $\mathbf{48}_2$ receives, on the port $\mathbf{68}_2$, the second transmit intermediate signal from the second coupled-signal port $\mathbf{64}_2$ of the signal coupler 44 as indicated by the lower arrowhead of a signal-path-indicator curve $\mathbf{80}_2$, and receives, on the one or more second control nodes $\mathbf{72}_2$, a respective one or more second control signals from a controller circuit (not shown in FIG. 3).

In response to the one or more first control signals on the one or more first control nodes $\mathbf{72}_1$, the first phase modulator $\mathbf{48}_1$ shifts the phase of the first transmit intermediate signal by an amount related to the values of the one or more first control signals, and provides the phase-shifted first transmit intermediate signal at the port $\mathbf{70}_1$. For example, each of the first control signals can represent a respective bit of phase-shift resolution between 0° and 360°.

Similarly, in response to the one or more second control signals on the one or more second control nodes $\mathbf{72}_2$, the second phase modulator $\mathbf{48}_2$ shifts the phase of the second transmit intermediate signal by an amount related to the values of the one or more second control signals, and provides the phase-shifted second transmit intermediate signal at the port $70_2$. For example, each of the second control signals can represent a respective bit of phase-shift resolution between 0° and 360°.

The first antenna element $46_1$ receives, at the signal port $74_1$, the first phase-shifted transmit intermediate signal from the port $70_1$ of the first through phase modulator $48_1$ as indicated by the upper arrowhead of the signal-path-indicator curve $82_1$, and, in response to the phase-shifted first transmit intermediate signal, radiates a first transmit signal having approximately the same phase and approximately the same frequency as the phase-shifted first transmit intermediate signal.

Similarly, the second antenna element $46_2$ receives, at the signal port $74_2$, the phase-shifted second transmit intermediate signal from the port $70_2$ of the second through phase modulator $48_2$ as indicated by the lower arrowhead of the signal-path-indicator curve $82_2$, and, in response to the phase-shifted second transmit intermediate signal, radiates a second transmit signal having approximately the same phase and approximately the same frequency as the phase-shifted second transmit intermediate signal.

In operation during a receive mode, the first antenna element $46_1$ receives a first receive signal from a remote source, and, in response to the first receive signal, generates, at the port $74_1$, a first receive intermediate signal having approximately the same phase and approximately the same frequency as the first receive signal.

Likewise, the second antenna element $46_2$ receives a second receive signal from the remote source (or from another remote source), and, in response to the second receive signal, generates, at the port $74_2$, a second receive intermediate signal having approximately the same phase and approximately the same frequency as the second receive signal.

The first through phase modulator $48_1$ receives, at the port $70_1$, the first receive intermediate signal from the port $74_1$ of the first antenna element $46_1$ as indicated by the lower arrowhead of the signal-path-indicator curve $82_1$, and receives, on the one or more first control nodes $72_1$, a respective one or more first control signals from a controller circuit (not shown in FIG. 3).

Similarly, the second through phase modulator $48_2$ receives, on the port $70_2$, the second receive intermediate signal from the port $74_2$ of the second antenna element $46_2$ as indicated by the upper arrowhead of the signal-path-indicator curve $82_2$, and receives, on the one or more second control nodes $72_2$, a respective one or more second control signals from a controller circuit (not shown in FIG. 3).

In response to the one or more first control signals on the one or more first control nodes $72_1$, the first phase modulator $48_1$ shifts the phase of the first receive intermediate signal by an amount related to the values of the one or more first control signals, and provides a phase-shifted first receive intermediate signal at the port $68_1$. For example, each of the first control signals can represent a respective bit of phase-shift resolution between 0° and 360°.

Similarly, in response to the one or more second control signals on the one or more second control nodes $72_2$, the second through phase modulator $48_2$ shifts the phase of the second receive intermediate signal by an amount related to the values of the one or more second control signals, and provides a phase-shifted second receive intermediate signal at the port $68_2$. For example, each of the second control signals can represent a respective bit of phase-shift resolution between 0° and 360°.

The signal coupler 44 receives, on the first coupled-signal port $64_1$, the phase-shifted first receive intermediate signal from the first through phase modulator $48_1$, receives, on the second coupled-signal port $64_2$, the phase-shifted second receive intermediate signal from the second through phase modulator $48_2$, and couples the phase-shifted first and second receive intermediate signals to the transmission medium 36 via the port 60, and the port 50 (if present), as indicated by the leftmost arrowheads of the signal-path-indicator curves $80_1$ and $80_2$. That is, the signal coupler 44 effectively combines the phase-shifted first and second receive intermediate signals by superimposing them on one another, and couples the combined phase-shifted receive intermediate signal to the transmission medium 36.

The signal coupler 44 also receives, on the port 62, a receive reference wave (if the antenna unit 32 is other than the last antenna unit $32_n$ in the row 30 of FIG. 1), and couples the receive reference wave to the transmission medium 36 via the port 60, and via the port 50 (if present), as indicated by the leftmost arrowheads of the signal-path-indicator lines 78 and 76.

That is, the signal coupler 44 effectively combines the phase-shifted first and second receive intermediate signals from the first and second coupled-signal ports $64_1$ and $64_2$, and the receive reference wave from the port 62, by superimposing these signals onto one another, and provides, via the port 60 (and the port 50 if present), the combined signal to the transmission medium 36 as a modified receive reference wave. Depending on the location of the antenna unit 32 within the row 30 (FIG. 1), the power of the received reference wave from the port 62 can be very different than the powers of the phase-shifted first and second intermediate signals that the signal coupler 44 receives at the first and second signal-coupled ports $64_1$ and $64_2$, respectively. For example, the power of the receive reference wave can be in an approximate range of one time to ten thousand times greater than the respective power of each of the phase-shifted first and second receive intermediate signals.

Still referring to FIG. 3, alternate embodiments of the antenna unit 32 are contemplated. For example, during operation in both the transmit mode and the receive mode, one or both of the first and second antenna elements $46_1$ and $46_2$ may shift the phases of the respective phase-shifted first and second intermediate signals, or the first and second receive signals, respectively, by other than 0°, and the amounts of these phase shifts may depend on the frequency of the transmit reference wave and the receive signals, respectively. Furthermore, although described as forming part of one antenna row 30, the antenna unit 32 can form respective parts of two antenna rows, where the signal coupler 44 forms a part common to both antenna rows, the first antenna element $46_1$ and the first phase modulator $48_1$ form part of one of the antenna rows, and the second antenna element $46_2$ and the second phase modulator $48_2$ form part of another one of the antenna rows. Moreover, one or more embodiments described above in conjunction with FIGS. 1-2 and below in conjunction with FIGS. 4-21 may be applicable to the antenna unit 32 of FIG. 3.

FIG. 4 is a diagram of one of the through phase modulators 48 of FIGS. 2-3, according to an embodiment.

In addition to the ports 68 and 70 and the control nodes $72_1$-$72_q$, the through phase modulator 48 includes a transmission medium 90, one or more active devices $92_1$-$92_q$, and one or more signal terminators $94_1$-$94_q$.

The transmission medium 90 is coupled between the ports 68 and 70, and can be any type of transmission medium that is suitable for an application in which the antenna 30 (FIG.

1) is configured to be used. For example, the transmission medium 90 can be the same as, or similar to, the transmission medium 36. Further in example, the transmission medium 90 can be a strip line, a microstrip line, a CPW, a GBCPW, or a tubular waveguide having a cross section that is rectangular or another suitable shape.

The one or more active devices 92 each have a first port 96 coupled to the transmission medium 90, each have a second port 98 coupled to a respective one of the control nodes 72, and are each configured to have a respective complex impedance that can be altered in response to a respective one of the one or more control signals on the control nodes 72. For example, each device 92 can be any device (see, e.g., FIGS. 5-6) suitable for an application in which the antenna 34 (FIG. 1) is configured to be used. Further in example, by applying to an active device 92 a binary control signal on a respective control line 72, a controller circuit (not shown in FIG. 4) can cause the impedance of the active device to have one of two values depending on whether the control signal represents logic 0 or a logic 1, and, therefore, can cause the active device to contribute one bit of phase shift to a signal propagating from one of the ports 68 and 70 to the other of the ports 68 and 70.

Furthermore, the port $\mathbf{96}_1$ of an active device $\mathbf{92}_1$ closest to the port 68 is spaced from the port 68 by a distance $d_2$, the port $\mathbf{96}_q$ of a device $\mathbf{92}_q$ closest to the port 70 is spaced from the port 70 by approximately the distance $d_2$, and the ports 96 of the active devices $\mathbf{92}_1$ and $\mathbf{92}_q$ and of the other active devices 92 disposed between the active devices $\mathbf{92}_1$ and $\mathbf{92}_q$ are spaced apart by approximately a distance $d_3$, which may be approximately the same as, or different (shorter or longer) than, the distance $d_2$. Because the phase shift imparted to a signal by the through phase modulator 48 depends on the distances $d_2$ and $d_3$, a designer can set these distances such that the phase modulator imparts a respective phase shift to a signal propagating along the transmission medium 90 for each possible logic-1-logic-0 pattern of the control signals at the control nodes 72.

Each signal terminator 94 has a node 100 coupled to a node 102 of a respective one of the active devices 92, and is configured to match the impedance of the respective active device at the node 102 so that the power of a signal reflected back into the node 102 is approximately zero or is otherwise negligible for the application(s) in which the antenna 34 (FIG. 1) is configured. For example, although not shown, each terminator 94 may have another node coupled to a reference conductor such as a ground plane.

Still referring to FIG. 4, operation of the through phase modulator 48 is described according to an embodiment in which a transmit intermediate signal propagates into the phase modulator via the port 68 and propagates out of the phase shifter via the port 70.

First, a controller circuit (not shown in FIG. 4) generates, on the control nodes 72, the control signals having respective values that correspond to a total phase shift that the controller circuit controls the phase modulator 48 to impart to the transmit intermediate signal.

Next, the transmit intermediate signal experiences a first phase shift as it propagates the distance $d_2$ from the port 68 to the location of the transmission medium 90 that is coupled to the port $\mathbf{96}_1$ of the active device $\mathbf{92}_1$. The amount of the first phase shift is related to the distance $d_2$ and to the wavelength $\lambda_m$ of the transmit intermediate signal in the transmission medium 90; the greater the distance $d_2$ and the shorter the wavelength $\lambda_m$, the greater the first phase shift and vice-versa (assuming $d_2<n\cdot\lambda_m$, where n is an integer).

Then, at the location of the transmission medium 90 that is coupled to the port $\mathbf{96}_1$ of the active device $\mathbf{92}_1$, the transmit intermediate signal experiences a second phase shift due to the impedance of the active device $\mathbf{92}_1$, which impedance corresponds to the value of the control signal on the control node $\mathbf{72}_1$. The terminator $\mathbf{100}_1$ causes the combination of the active device $\mathbf{96}_1$ and the terminator $\mathbf{100}_1$ to reflect negligible (for the application) or no signal energy back onto the transmission medium 90.

Next, the transmit intermediate signal experiences one or more additional phase shifts due to the approximate distance $d_3$ between each pair of adjacent active devices 92 and in response to the active devices themselves, if there are more than the two active devices $\mathbf{92}_1$ and $\mathbf{92}_q$. The amounts of the phase shifts imparted to the transmit intermediate signal in response to the approximate distances $d_3$ are related to the distance $d_3$ and the wavelength $\lambda_m$ of the transmit intermediate signal, the greater the distance and the shorter the wavelength the greater the phase shift, and vice-versa (assuming $d_3<n\cdot\lambda_m$, where n is an integer). The impedance of each active device 92 corresponds to the value of the control signal on the respective control node 72 coupled to the active device. And the terminators 100 cause the respective combinations of the active devices 96 and the terminators 100 to reflect negligible (for the application) or no signal energy back onto the transmission medium 90.

Then, the transmit intermediate signal experiences an additional phase shift in response to the impedance of the active device $\mathbf{96}_q$, which impedance corresponds to the value of the control signal on the control node $\mathbf{72}_q$.

Next, the transmit intermediate signal experiences a final phase shift as it propagates the approximate distance $d_2$ from the location of the transmission medium 90 that is coupled to the port $\mathbf{96}_q$ of the active device $\mathbf{92}_q$ to the port 70. The amount of the phase shift imparted to the transmit intermediate signal in response to the approximate distance $d_2$ is related to the distance $d_2$ and to the wavelength $\lambda_m$, the greater the distance and the shorter the wavelength the greater the phase shift, and vice-versa (assuming $d_3<n\cdot\lambda_m$, where n is an integer).

At the port 70, the transmit intermediate signal has a total phase shift equal to the sum of all the phase shifts that the transmit intermediate signal experienced as it propagated along the transmission medium 90 between the port 68 and the port 70.

Still referring to FIG. 4, operation of the through phase modulator 48 is described according to an embodiment in which a receive intermediate signal propagates into the phase modulator via the port 70 and propagates out of the phase modulator via the port 68.

First, a controller circuit (not shown in FIG. 4) generates the control signals having respective values that correspond to a total phase shift that the controller circuit controls the phase modulator 48 to impart to the receive intermediate signal.

Next, the receive intermediate signal experiences a first phase shift as it propagates approximately the distance $d_2$ from the port 70 to the location of the transmission medium 90 that is coupled to the port $\mathbf{96}_q$ of the active device $\mathbf{92}_q$. The amount of the first phase shift is related to the distance $d_2$ and to the wavelength $\lambda_m$; the greater the distance $d_2$ and the shorter the wavelength $\lambda_m$, the greater the first phase shift and vice-versa (assuming $d_2<n\cdot\lambda_m$, where n is an integer).

Then, at the location of the transmission medium 90 that is coupled to the port $\mathbf{96}_q$ of the active device $\mathbf{92}_q$, the receive intermediate signal experiences a second phase shift due to the impedance of the active device $92_q$, which impedance corresponds to the value of the control signal on the control node $72_q$. The terminator $100_q$ causes the combination of the active device $96_q$ and the terminator $100_q$ to reflect negligible (for the application) or no signal energy back onto the transmission medium 90.

Next, the receive intermediate signal experiences one or more additional phase shifts due to the distance $d_3$ between adjacent active devices 92 and in response to the active devices themselves, if there are more than the two active devices $92_1$ and $92_q$. The amounts of the phase shifts imparted to the receive intermediate signal in response to the distances $d_3$ (or of approximately $d_3$) are related to the distance $d_3$ and the wavelength $\lambda_m$ of the receive intermediate signal, the greater the distance and the shorter the wavelength $\lambda_m$ the greater the phase shift, and vice-versa (assuming $d_3<n\cdot\lambda_m$, where n is an integer). The impedance of each active device 92 corresponds to the value of the control signal on the respective control node 72 coupled to the active device. And the terminators 100 cause the respective combinations of the active devices 96 and the terminators 100 to reflect negligible (for the application) or no signal energy back onto the transmission medium 90.

Then, the receive intermediate signal experiences an additional phase shift in response to the impedance of the active device $96_1$, which impedance corresponds to the value of the control signal on the control node $72_1$.

Next, the receive intermediate signal experiences a final phase shift as it propagates the distance $d_2$ from the location of the transmission medium 90 that is coupled to the port $96_1$ of the active device $92_1$ to the port 70. The amount of the phase shift imparted to the receive transmit intermediate signal in response to the distance $d_2$ (or of approximately $d_2$) is related to the distance $d_2$ and the wavelength $\lambda_m$, the greater the distance and the shorter the wavelength the greater the phase shift, and vice-versa (assuming $d_2<n\cdot\lambda_m$, where n is an integer).

At the port 68, the receive intermediate signal has a total phase shift equal to the sum of all the phase shifts that the receive intermediate signal experienced as it propagated along the transmission medium 90 between the port 70 and the port 68.

Still referring to FIG. 4, alternate embodiments of the through phase modulator 48 are contemplated. For example, although more than two active devices 92 and terminators 94 are described, the through phase modulator 48 can have only one or two active-device-terminator pairs. Furthermore, each of one of more of the active devices 92 may be a different type of device than each of one or more other of the active devices. Moreover, although described as receiving only one control signal on one control line 72, each of one or more of the active devices 92 can receive no, or more than one, control signal. In addition, although described as being digital signals, each of one or more of the control signals can be a respective analog signal having one or more voltage levels (e.g., 0 Volts, −6 Volts) that each define a respective state of a respective active device 92, and that each can be used to toggle the state of the active device. Furthermore, one or more embodiments described above in conjunction with FIGS. 1-3 and below in conjunction with FIGS. 5-21 may be applicable to the through phase modulator 48 of FIG. 4.

Figure 5:
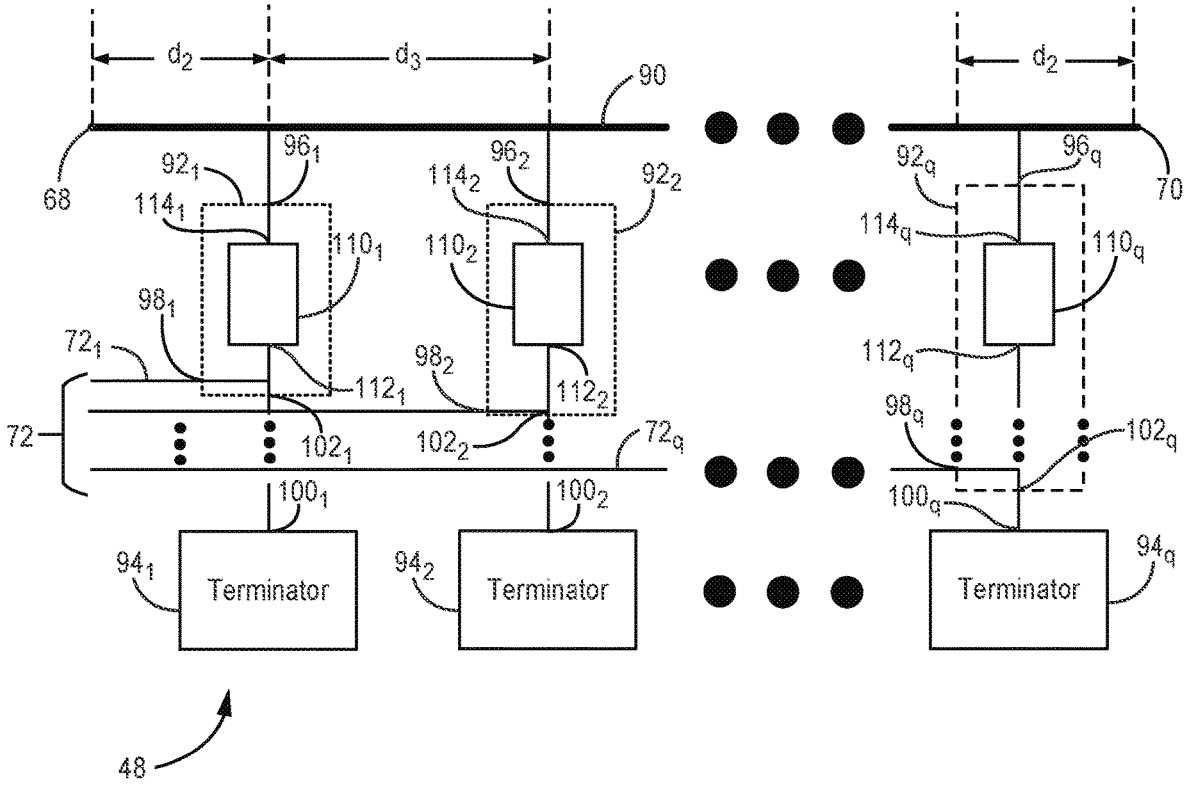
FIG. 5 is a diagram of the through phase modulator of FIG. 4, according to an embodiment.

FIG. 5 is a diagram of the through phase modulator 48 of FIG. 4, according to an embodiment in which each of the active devices 92 includes a respective two-terminal impedance device 110 (e.g., a PIN diode), and where like numerals reference components common to FIGS. 4-5.

A controller circuit (not shown in FIG. 5) is configured to cause each two-terminal impedance device 110 to present an inductive impedance to the signal propagating along the transmission medium 90 by generating, on the respective control line 72, a control voltage that causes the device 110 to be inductive.

The respective inductive impedance causes each two-terminal device 110 to shift the phase of the signal propagating along the transmission medium 90 by a corresponding first amount.

Similarly, the controller circuit (not shown in FIG. 5) is configured to cause each two-terminal device 110 to present a capacitive impedance to the signal propagating along the transmission medium 90 by generating, on the respective control line 72, a control voltage that causes the two-terminal device to be capacitive.

The respective capacitive impedance causes each two-terminal impedance device 110 to shift the phase of the signal propagating along the transmission medium 90 by a corresponding second amount that is different from the first amount.

Furthermore, the through phase modulator 48 can include a suitable and respective RF bypass circuit, or a suitable and respective RF bypass structure (neither bypass circuit nor bypass structure shown in FIG. 5), coupled to one or both terminals 112 114 of each two-terminal impedance device 110 so that the DC control voltage does not affect, adversely, the RF operation of the through phase modulator 48, and so that the RF signals do not affect, adversely, the DC operation of the through phase modulator. Said another way, the RF bypass circuits or RF bypass structures effectively isolate the control-voltage-generating circuitry from the RF signals, and effectively isolate the RF circuitry from the DC signals.

The operation of the through phase modulator 48 of FIG. 5 is similar to the operation of the through phase modulator 48 of FIG. 5 in an embodiment.

Still referring to FIG. 5, alternate embodiments of the through phase modulator 48 are contemplated. For example, each of one or more of the two-terminal impedance devices 110 may be, or may otherwise include, a respective varactor or a respective PIN diode. Furthermore, although the control lines 72 are described as being coupled to the terminals 112 of the two-terminal impedance devices 110, each of one or more of the control lines can be coupled to the other terminal 114 of a respective two-terminal impedance device. Moreover, although each control voltage is describe as having two values, each of one or more of the control voltages can have more than two values. In addition, one or more embodiments described above in conjunction with FIGS. 1-4 and below in conjunction with FIGS. 6-21 may be applicable to the through phase modulator 48 of FIG. 5.

Figure 6:
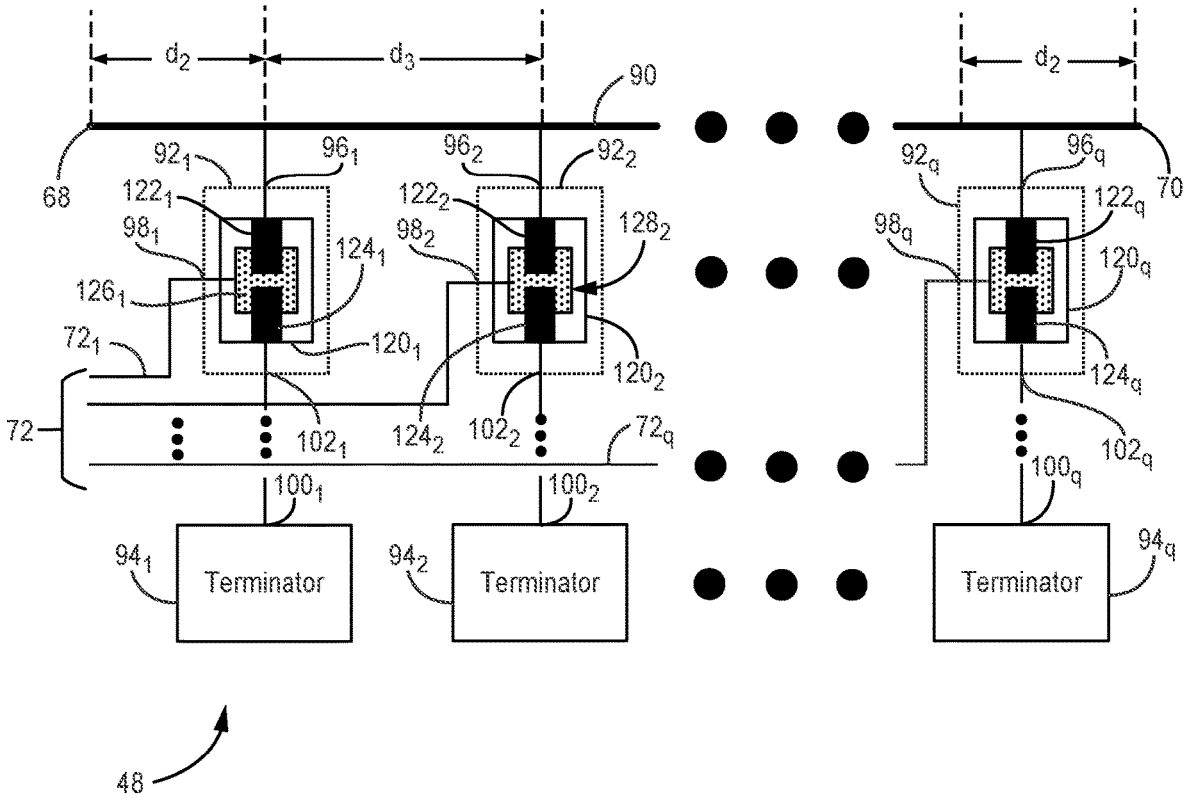
FIG. 6 is a diagram of the through phase modulator of FIG. 4, according to another embodiment.

FIG. 6 is a diagram of the through phase modulator 48 of FIG. 4, according to an embodiment in which each of the active devices 92 includes a respective capacitor 120, which includes a capacitive junction over a tunable two-dimensional material layer, and where like numerals reference components common to FIGS. 4-6.

Each capacitor 120 includes conductive electrodes 122 and 124, and a material 126 (e.g., a ferroelectric material such as $PbTiO_3$, $BaTiO_3$, $PbZrO_3$, Barium Strontium Titanate (BST), Barium Titanate (BTO)), which is in contact with both of the electrodes and which spans a gap 128 between the electrodes. The permittivity of the material 126 is tunable in response to a control voltage applied to, or across, the material via a control node 72. By changing a value of a control voltage on the control node 72, a controller circuit (not shown in FIG. 6) is configured to change the permittivity of the material 126, and, therefore, to change the dielectric constant and the capacitance of the capacitor 120. And changing the capacitance of the capacitor 120 changes the amount of the phase shift that the capacitor imparts to a signal propagating along the transmission medium 90. That is, for each value of the control voltage on the control node 72, the capacitor 120 imparts a respective phase shift to a signal propagating along the transmission medium 90.

Furthermore, the through phase modulator 48 can include, for each capacitor 120, a suitable and respective RF bypass circuit, or a suitable and respective RF bypass structure (neither bypass circuit nor bypass structure shown in FIG. 6), coupled to the material 126 so that the RF signals do not affect, adversely, the DC operation of the through phase modulator. Said another way, the RF bypass circuits or RF bypass structures effectively isolate the control-voltage-generating circuitry from the RF signals.

The operation of the through phase modulator 48 of FIG. 6 is similar to the operation of the through phase modulator 48 of FIG. 4 in an embodiment.

Still referring to FIG. 6, alternate embodiments of the through phase modulator 48 are contemplated. For example, each of one or more of the capacitors 120 can have a structure that differs from the described structure. Further in example, although described as contacting the material 126, one or both of the electrodes 122 and 124 may be spaced apart from the material. Moreover, one or more embodiments described above in conjunction with FIGS. 1-5 and below in conjunction with FIGS. 7-21 may be applicable to the through phase modulator 48 of FIG. 6.

Figure 7:
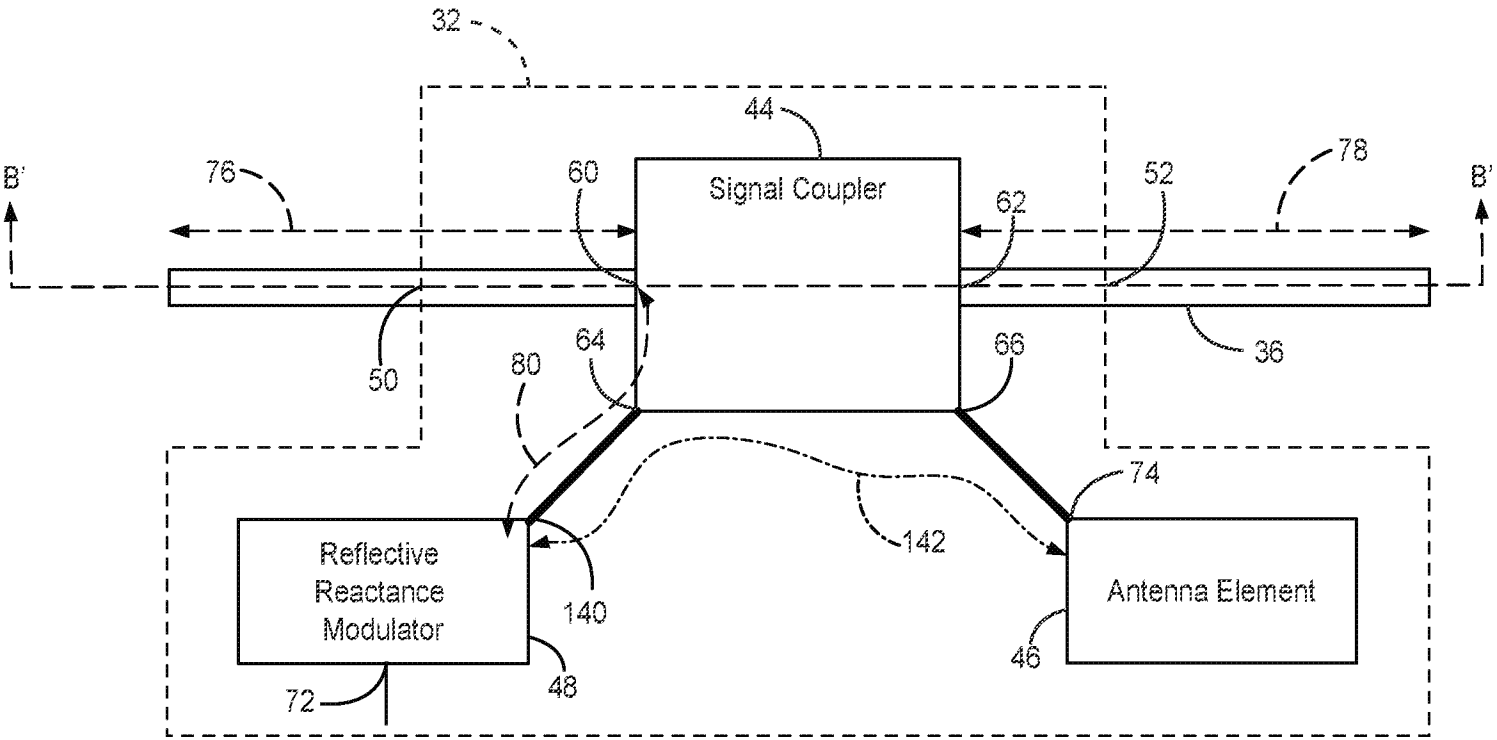
FIG. 7 is a diagram of an antenna unit of FIG. 1 including a single antenna element and a single reflective reactance modulator, according to an embodiment.

FIG. 7 is a diagram of one of the antenna units 32 of FIG. 1, which antenna unit includes a single antenna element 46 and a single reflective reactance modulator 48, according to an embodiment in which components common to FIGS. 1 and 7 are labeled with same reference numbers.

The antenna unit 32 of FIG. 7 is similar to the antenna unit 32 of FIG. 2 except that the modulator 48 of FIG. 7 is a reflective reactance modulator shifter, not a through phase modulator, and the port 74 of the antenna element 46 of FIG. 7 is coupled to the modulator via the signal-isolated port 66 of the signal coupler 44.

The reflective reactance modulator 48 includes a signal port 140, which is coupled to the signal coupled port 64 of the signal coupler 44, and is configured to receive, at the port 140, an intermediate signal from the signal coupled port 64, to impart a first phase shift to the intermediate signal as the intermediate signal propagates from the port 140 to one or more termination locations (not shown in FIG. 7) of the reactance modulator, to impart a second phase shift to the intermediate signal as the first-phase-shifted intermediate signal propagates (e.g., is reflected or otherwise redirected) from the termination location(s) to the signal port 140 such that the phase-shifted intermediate signal at the port 140 has a total phase shift equal to the sum of the first and second phase shifts. In an embodiment, the first phase shift approximately equals the second phase shift such that both the first phase shift and the second phase shift equal approximately half of the total phase shift.

In operation during a transmit mode, the signal coupler 44 receives, on the signal port 60 (via the port 50 if present), the transmit reference wave as indicated by the rightmost arrowhead of the line 76, couples a first portion of the transmit reference wave to the port 62, and couples a second portion of the transmit reference wave, called the transmit intermediate signal, to the signal-coupled port 64. And as indicated by the rightmost arrowhead of the line 78, the signal coupler 44 couples the first portion of the transmit reference wave from the port 62 to the transmission medium 36 (via the port 52 if present). Depending on the position of the antenna unit 32 in the row 30 (FIG. 1), the power of the first portion of the transmit reference wave that the signal coupler 44 effectively returns to the transmission medium 36 can be much different than the power of the transmit intermediate signal that the signal coupler couples to the signal-coupled port 64. For example, the power of the first portion of the transmit reference wave can be in an approximate range of one time to ten thousand times greater than the power of the transmit intermediate signal.

The reflective reactance modulator 48 receives, on the port 140, the transmit intermediate signal from the coupled-signal port 64 of the signal coupler 44 as indicated by the bottom-most arrowhead of a signal-path-indicator curve 80, and receives, on the one or more control nodes 72, a respective one or more control signals from a controller circuit (not shown in FIG. 7).

In response to the one or more control signals on the one or more control nodes 72, the reactance modulator 48 shifts the phase of the transmit intermediate signal by a first amount related to the values of the one or more control signals as the transmit intermediate signal propagates from the port 140 to one or more reflective termination locations (not shown in FIG. 7) of the reactance modulator, and shifts the phase of the transmit intermediate signal, which is already phase shifted by the first amount, by a second amount related to the values of the one or more control signals as the intermediate signal is reflected back from the one or more termination locations to the port 140. As stated above, because the control signals have the same values while the transmit intermediate signal is forward propagating and reverse (reflect) propagating, the first amount of phase shift is approximately equal to the second amount of phase shift such that at the port 140, the reflected intermediate signal has a total phase shift approximately equal to the sum of the first and second amounts. For example, each of the control signals can represent a respective bit of phase-shift resolution between 0° and 360°. Further in example, if the number of control signals is two, then the control signals can cause the total relative phase shift that the reactance modulator 48 imparts to the intermediate signal to be approximately one of the following four values: 0°, 90° (45° while propagating forward, another 45° after being reflected), 180° (90° while propagating forward, another 90° after being reflected), and 270° (135° while propagating forward, another 135° after being reflected). The reflective reactance modulator 48 can be configured with any suitable number of bits of phase-shift resolution, such as approximately between one and sixteen bits of phase-shift resolution, to provide a number of possible different phase shifts in an approximate range of two to two hundred fifty six values.

The phase-shifted transmit intermediate signal then propagates from the port 140 of the reflective reactance modulator 48 to the signal-coupled port 64 of the signal coupler 44, propagates from the signal-coupled port to the signal-isolated port 66, and propagates from the signal-isolated port to the port 74 of the antenna element 46, as indicated by the rightmost arrowhead of a signal-path-indicator curve 142. The signal coupler 44 is configured such that, ideally, all of the energy of the phase-shifted transmit intermediate signal propagates from the signal-coupled port 64 to the signal-isolated port 66, and negligible or no energy from the phase-shifted transmit intermediate signal propagates from the signal-coupled node to either of the ports 60 and 62.

And in response to the phase-shifted transmit intermediate signal at the node 74, the antenna element 46 radiates a transmit signal having approximately the same phase, approximately the same frequency, and approximately the same power as the phase-shifted transmit intermediate signal.

In operation during a receive mode, the antenna element 46 receives a receive signal from a remote source, and, in response to the receive signal, generates, at the port 74, a receive intermediate signal having approximately the same phase, approximately the same frequency, and approximately the same power as the receive signal.

The signal coupler 44 receives, at its signal-isolated port 66, the receive intermediate signal from the antenna element 46, and couples, via the signal-coupled node 64, the receive intermediate signal to the port 140 of the reflective reactance modulator 48 as indicated by the leftmost arrowhead of a signal-path-indicator curve 142.

The reflective reactance modulator 48 receives, on the one or more control nodes 72, a respective one or more control signals from a controller circuit (not shown in FIG. 7).

In response to the one or more control signals, the reactance modulator shifts the phase of the receive intermediate signal by an amount related to the values of the one or more control signals, and provides the phase-shifted intermediate signal at the port 140. As described above, the reflective reactance modulator 48 shifts the phase of the receive intermediate signal by a first amount related to the values of the one or more control signals as the receive intermediate signal propagates from the port 140 to one or more reflective termination locations of the reflective reactance modulator, and further shifts the phase of the receive intermediate signal by a second amount also related to the values of the one or more control signals as the receive intermediate signal is reflected back to the port 140. For example, each of the control signals can represent a respective bit of phase-shift resolution between 0° and 360°. Further in example, if the number of control signals is two, then the control signals can cause the relative phase shift that the reflective reactance modulator 48 imparts to the intermediate signal to be approximately one of the following four values: 0°, 90° (45° while propagating forward, another 45° after being reflected), 180° (90° while propagating forward, another 90° after being reflected), and 270° (135° while propagating forward, another 135° after being reflected). The reflective reactance modulator 48 can be configured with any suitable number of bits of phase-shift resolution, such as approximately between one and sixteen bits of phase-shift resolution, to provide a number of possible different phase shifts in an approximate range of two to two hundred fifty six values.

The signal coupler 44 receives, on the coupled-signal port 64, the phase-shifted intermediate receive signal from the reflective reactance modulator 48, and couples the phase-shifted intermediate receive signal to the transmission medium 36 via the port 60 (and the port 50 if present), as indicated by the leftmost arrowhead of the signal-path-indicator curve 80.

The signal coupler 44 also receives, on the port 62, a receive reference wave (if the antenna unit 32 is other than the last antenna unit $\mathbf{32}_n$ in the row 30 of FIG. 1), and couples the reference wave to the transmission medium 36 via the port 60 (and via the port 50 if present), as indicated by the leftmost arrowheads of the signal-path-indicator lines 78 and 76.

That is, the signal coupler 44 effectively combines the phase-shifted intermediate receive signal from the coupled-signal port 64 and the receive reference wave from the port 62 by superimposing one of these signals onto the other of these signals, and provides, via the port 60 (and the port 50 if present), the combined signal to the transmission medium 36 as a modified receive reference wave. Depending on the location of the antenna unit 32 within the row 30 (FIG. 1), the power of the receive reference wave from the port 62 can be very different than the power of the phase-shifted intermediate receive signal that the signal coupler receives at the signal-coupled port 64. For example, the power of the receive reference wave can be in an approximate range of one time to ten thousand times greater than the power of the phase-shifted intermediate receive signal.

Based on the above description of the operation of the antenna unit 32, it is evident that the signal coupler 44, and the respective impedances at the ports 60, 64, and 66, are configured as pseudo-circulator ports such that, ignoring leakage, during a transmit mode, signal energy flows between these ports only in one direction (rightward in FIG. 7), and such that during a receive mode, signal energy flows between these ports only in the opposite direction (leftward in FIG. 7).

Still referring to FIG. 7, alternate embodiments of the signal coupler 44 are contemplated. For example, one or more embodiments described above in conjunction with FIGS. 1-6 and below in conjunction with FIGS. 8-21 may be applicable to the antenna unit 32 of FIG. 7.

Figure 8:
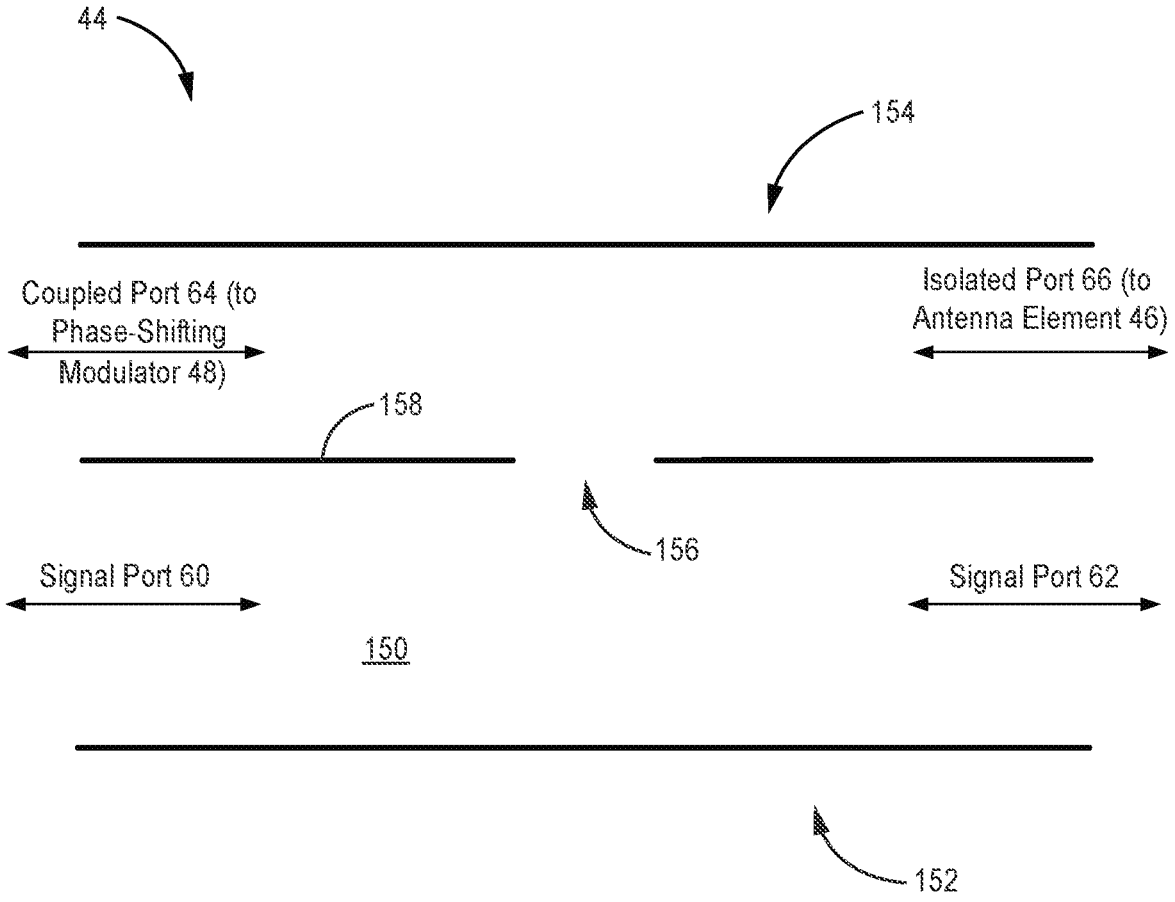
FIG. 8 is a cutaway side view of the signal coupler of FIG. 7, according to an embodiment.

FIG. 8 is a cutaway side view of the signal coupler 44 taken along the lines B'-B' of FIG. 7, according to an embodiment.

In addition to the signal ports 60 and 62, the signal-coupled port 64, and the signal-isolated port 66, the signal coupler 44 includes a portion 150 of a first waveguide 152, a second waveguide 154, and an iris 156.

The signal ports 60 and 62 are effectively disposed in the portion 150 of the first waveguide 152, which can be a continuous waveguide that forms the transmission medium 36 (FIG. 7), and which also forms the signal ports of other signal couplers 44 in a same row 30 of antenna units 32 (FIG. 1). For example, the first waveguide 152 can be any suitable waveguide, such as a rectangular waveguide, configured to have, at the wavelength of a reference wave that propagates along the first waveguide, a primary propagation mode of $TE_{10}$.

The signal-coupled port 64 and the signal-isolated port 66 are effectively disposed at opposite ends of the second waveguide 154. For example, the second waveguide 154 can be any suitable waveguide, such as a rectangular waveguide, configured to have, at the wavelength of a reference wave that propagates along the second waveguide, a primary propagation mode of $TE_{10}$.

The iris 156 is an opening that is disposed in a conductive boundary 158 disposed between, and shared by, the first and second waveguides 152 and 154, and can have any suitable dimensions. For example, the iris 156 can form, or can form part of, a Bethe hole signal coupler.

Operation of the signal coupler 44 is described according to an embodiment in which the signal coupler is part of an antenna unit 32 other than the last antenna unit in a row 30 (FIG. 1) of antenna units.

In operation during a transmit mode in which a transmit reference wave propagates along the first waveguide 152 from the signal port 60 to the signal port 62, the iris 156 couples, to the second wave guide 154 as the intermediate transmit signal, a portion of the transmit reference wave.

The intermediate transmit signal propagates from the iris 156 to the signal-coupled port 64.

The intermediate transmit signal then propagates from the signal-coupled port 64 into the reflective reactance modulator 48 (FIG. 7), which shifts the phase of the intermediate transmit signal by an amount corresponding to the respective values of the one or more control signals on the control nodes 72 (FIG. 7).

The phase-shifted transmit intermediate signal is reflected, or otherwise redirected, back out of the reactance modulator 48 (FIG. 7) to the signal-coupled port 64.

The phase-shifted transmit intermediate signal then propagates from the signal-coupled port 64, to the signal-isolated port 66, and to the antenna element 46 (FIG. 7), which radiates a transmit signal in response to the phase-shifted transmit intermediate signal. The transmit signal has approximately the same phase, wavelength, and power as the phase-shifted transmit intermediate signal.

In operation during a receive mode in which a receive reference wave propagates along the first waveguide 152 from the signal port 62 to the signal port 64, the antenna element 46 receives a receive signal from a remote location, and, in response to the receive signal, generates, and couples to the signal-isolated port 66, an intermediate receive signal.

The intermediate receive signal propagates along the second waveguide 154 from the signal-isolated port 66 to the signal-coupled port 64, and propagates from the signal-coupled port into the reflective reactance modulator 48 (FIG. 7).

The reflective reactance modulator 48 (FIG. 7) shifts the phase of the receive intermediate receive signal by an amount corresponding to the values of the one or more control signals on the respective control lines 72 (FIG. 7), and couples the phase-shifted receive intermediate receive signal back to the signal-coupled port 64.

The phase-shifted receive intermediate signal propagates along the second waveguide 154 from the signal-coupled port 64 to the iris 156, which couples the phase-shifted receive intermediate signal to the first waveguide 152.

The first waveguide 152 effectively combines the phase-shifted receive intermediate signal from the iris 156 with the receive reference wave propagating along the first waveguide from the signal port 62 to the signal port 60 to generate a modified receive reference wave at the signal port 60.

Still referring to FIG. 8, alternate embodiments of the signal coupler 44 are contemplated. For example, instead of sharing the wider (top/bottom) conductive boundary 158, the first and second waveguides 152 and 154 may share a narrower (side) conductive boundary (not shown in FIG. 8) such that the iris 156 forms, or forms part of, a Riblet-Saad coupler. Furthermore, one or more embodiments described above in conjunction with FIGS. 1-7 and below in conjunction with FIGS. 9-21 may be applicable to the signal coupler 44 of FIG. 8.

Figure 9:
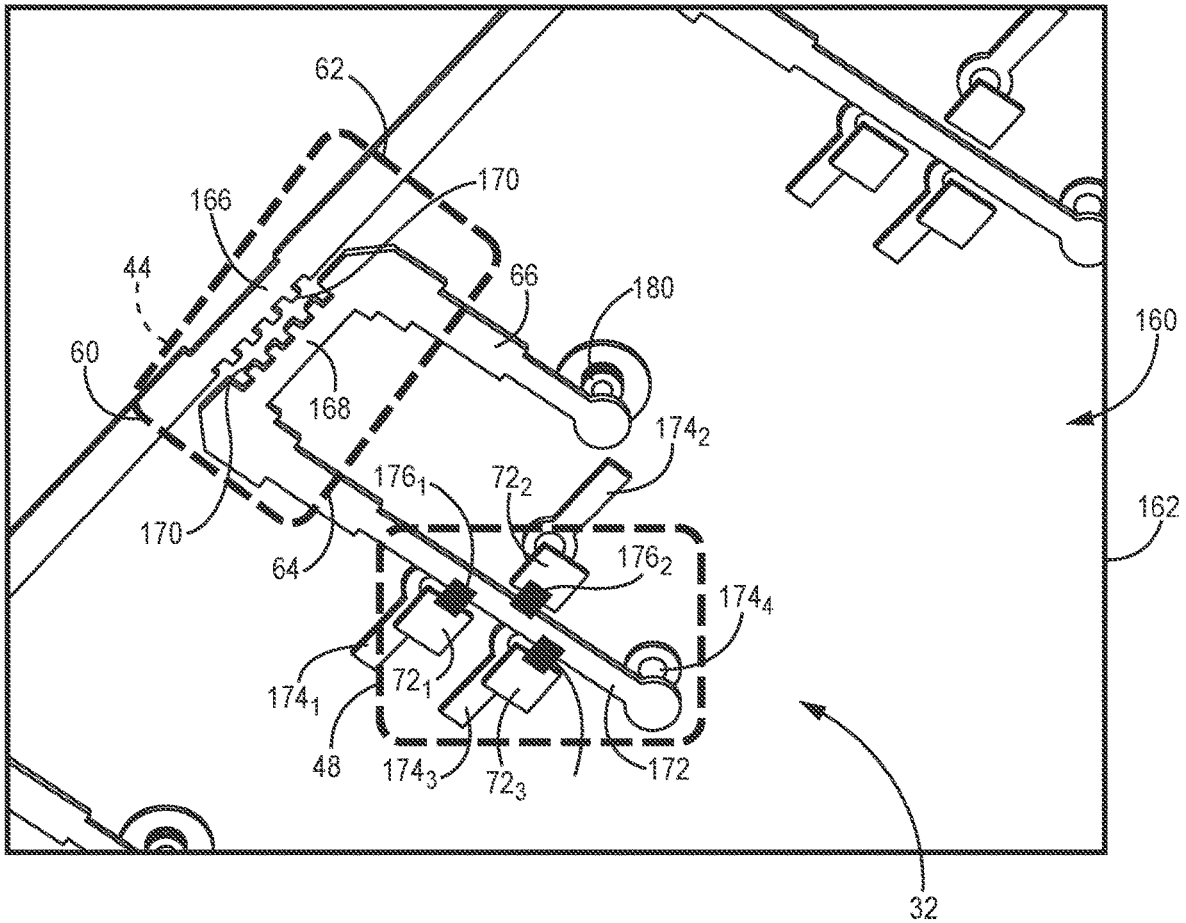
FIG. 9 is an isometric plan view of a portion of the antenna unit of FIG. 7 including the signal coupler and the reactance modulator, according to an embodiment.

FIG. 9 is an isometric plan view of a first side 160 of a printed circuit board (PCB) 162 on which is formed a signal coupler 44 and a reflective reactance modulator 48 of an antenna unit 32, according to an embodiment in which components common to FIGS. 1-3 and 7-9 are labeled with like reference numerals.

Figure 10:
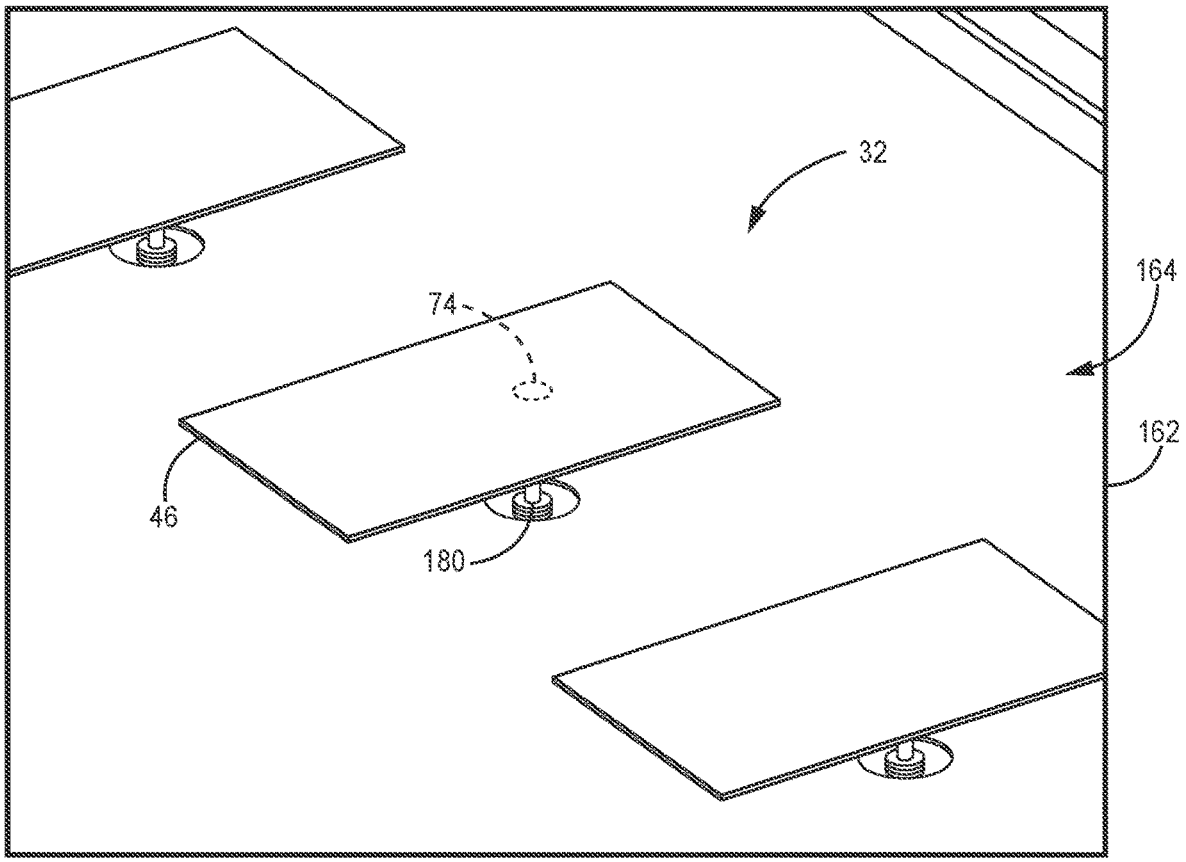
FIG. 10 is an isometric plan view of a portion of the antenna unit of FIGS. 7 and 9 including the antenna element, according to an embodiment.

FIG. 10 is an isometric plan view of a second side 164 of the PCB 162 on which is formed an antenna element 46 of the same antenna unit 32 shown in FIG. 9, according to an embodiment in which components common to FIGS. 1-3 and 7-10 are labeled with like reference numerals.

Referring to FIG. 9, in addition to the ports 60, 62, 64, and 66, the signal coupler 44 includes a pair of opposing conductors 166 and 168 having opposing "teeth" 170.

Furthermore, in addition to conductive control nodes $72_1$-$72_3$, the reflective reactance modulator 48 includes a conductive signal path 172, reflective terminator structures $174_1$-$174_4$ (disposed in a conductive layer within the PCB 162), and surface-mount active devices (e.g., PIN diodes) $176_1$-$176_3$ coupled between the signal path 172 and the control nodes, respectively, according to an embodiment.

And the antenna unit 32 further includes a through via 180 coupled between the isolated-signal port 66 and the antenna element 46 (FIG. 10).

Referring to FIG. 10, the port 74 of the antenna element 46 is coupled to the through via 180.

Operation of the antenna unit 32 of FIGS. 9-10 can be similar to the operation described above for the antenna unit of FIG. 7.

Still referring to FIGS. 9-10, alternate embodiments of the antenna unit 32 are contemplated. For example, components disclosed as being disposed on a surface 160 or 164 of the PCB 162 can be disposed in an inner layer of the PCB or on the other surface 164 or 160. Furthermore, one or more embodiments described above in conjunction with FIGS. 1-8 and below in conjunction with FIGS. 11-21 may be applicable to the PCB-mounted antenna unit 32 of FIGS. 9-10.

Figure 11:
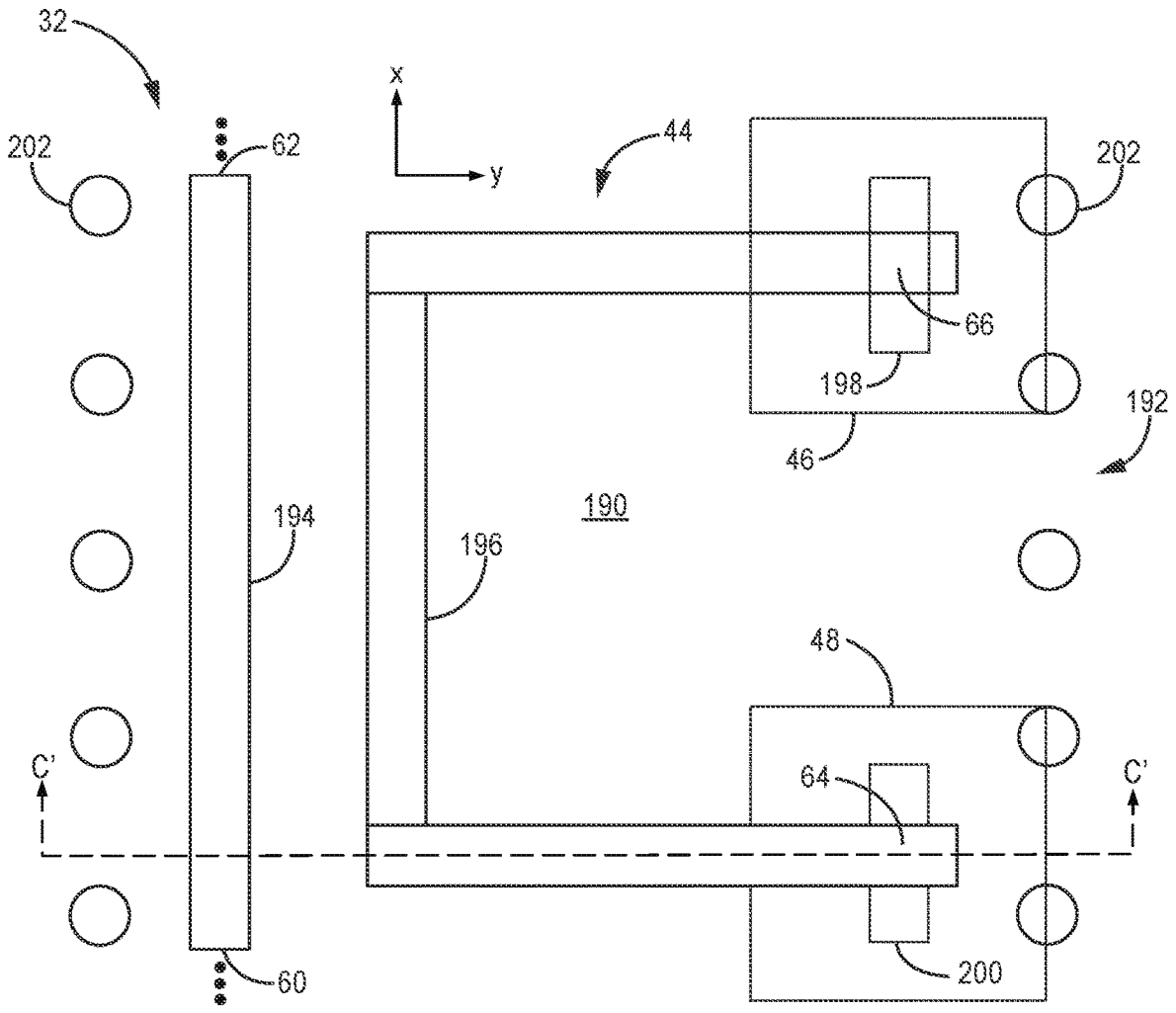
FIG. 11 is a plan view of an antenna unit of FIG. 1 including a single antenna element and a single reflective reactance modulator, according to another embodiment.

FIG. 11 is a cutaway plan view of an inner layer 190 of a printed-circuit-board (PCB) assembly 192 on which is formed a signal coupler 44, an antenna element 46, and a reflective reactance modulator 48 of an antenna unit 32, according to an embodiment in which components common to FIGS. 1-3 and 7-11 are labeled with like reference numerals, in which the antenna unit is part of a row of antenna units extending in the x dimension, and in which the antenna unit has a topology similar to the topology of the antenna unit 32 of FIG. 7.

Figure 12:
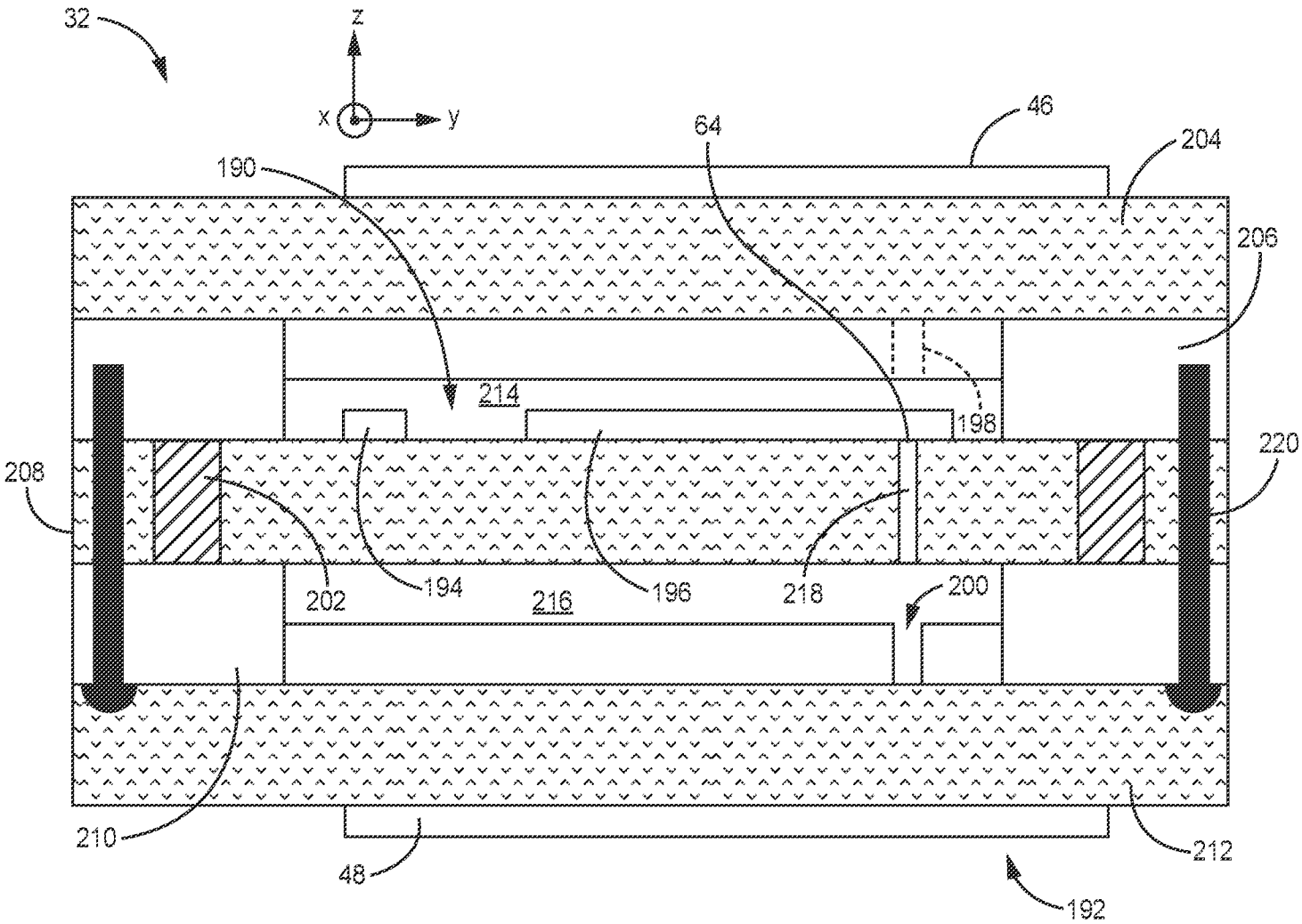
FIG. 12 is a cutaway side view of the antenna unit of FIG. 11, according to an embodiment.

FIG. 12 is cutaway side view of the PCB assembly 192 taken along lines C'-C' of FIG. 11, according to an embodiment in which components common to FIGS. 1-3 and 7-12 are labeled with like reference numerals.

Referring to FIG. 11, in addition to the ports 60, 62, 64, and 66, the signal coupler 44 includes an approximately straight conductor 194 spaced apart from a U-shaped conductor 196 with three approximately straight sides.

Furthermore, the antenna unit 32 includes a first iris 198 configured to couple the signal-isolated port 66 to the antenna element 46, and includes a second iris 200 configured to couple the signal-coupled port 64 to the reactance modulator 48.

Moreover, the antenna unit 32 includes conductive vias 202, which together form a pseudo Faraday cage along sides of the antenna unit so as to electrically isolate the antenna unit from antenna units in adjacent rows of antenna units (adjacent rows not shown in FIG. 13) at the frequency or frequencies at which the antenna unit is configured to operate.

Referring to FIG. 12, the PCB assembly 192 further includes an upper dielectric layer 204, an upper conductive shield 206, an inner dielectric layer 208, a lower conductive shield 210, and a lower dielectric layer 212, chambers 214 and 216, a coupling probe 218, and screws 220.

The upper dielectric layer 204 is disposed over the upper conductive shield 206, and the lower dielectric layer 212 is disposed beneath the lower conductive shield 210. The upper and lower dielectric layers 204 and 212 can each be made from any suitable same or different dielectric material.

The upper and lower conductive shields 206 and 210 form, with the conductor 194, the vias 202, and the inner dielectric layer 208, a strip line that is configured to function as a transmission medium over which a reference wave can propagate along the row (not shown in FIGS. 11-12) of the antenna units 32. Ideally, the only energy transfer between the conductor 194 of the strip line and the antenna element 46 and the reflective phase shifter 48 is through the irises 198 and 200, respectively.

Each of the chambers 214 and 216 can be filled with air or with any other suitable dielectric material.

The coupling probe 218 is configured to couple a transmit intermediate signal from the signal-coupled node 64 of the signal coupler 44 (FIG. 13) to the iris 200 through the chamber 216, and is configured to couple a receive intermediate signal from the iris 200 and the chamber 216 to the signal-coupled node 64. The coupling probe 218 can be made from any suitable conductive material and can have any suitable dimensions.

And the screws 220 (only two screws 220 shown in FIG. 12) are each part of a respective row of screws that extends in the x dimension along the length of the PCB assembly 192 and that holds the upper and lower conductors 206 and 210, and the inner dielectric layer 208, together such that the upper and lower conductors electrically contact each the vias 202. Each of the screws 220 can be any suitable type of screw and can be formed from any suitable material (e.g., metal, plastic, ceramic).

Referring to FIGS. 11-12, during manufacture of the PCB assembly 192, openings for the vias 202, the probes 218 (only one probe shown in FIG. 12), and the screws 220 are formed in the intermediate dielectric layer 208, and then all of the openings but for the screw openings are filled with a conductive material, such as copper or another metal, to form the vias 202 and the probes 218. The thickness of the inner dielectric layer 208 and the dimensions of the vias 202 and the probe 218 can be selected based on, e.g., the wavelengths at which the antenna unit 32 is to be configured to operate, and on performance parameters with which the antenna unit is to be configured to operate.

Next, the conductors 194 and 196 are formed in the conductive layer 190 over the inner dielectric layer 208. The thicknesses of the conductors 194 and 196, and the distance by which these conductors are spaced apart from one another in the y dimension, can be selected based on the wavelength for which the antenna unit 32 is to be configured, on the permittivities and permeabilities of the intermediate dielectric layer 208 and the material partially or fully filling the chamber 214, and on other physical quantities and other considerations.

Then, the shields 206 and 210 are secured over and beneath, respectively, the inner dielectric layer 208 with the screws 220.

Next, the upper and lower dielectric layers 204 and 212 are respectively bonded, or otherwise attached, to the upper and lower conductive shields 206 and 210, respectively. The bonding can be any suitable bonding process and can use any suitable bonding agent or technique such as an adhesive or welding.

Then, the antenna element 46 is formed from a conductive layer over the upper dielectric layer 204, and one or more conductive structures of the reflective reactance modulator 48 are formed from a conductive layer over the lower dielectric layer 212. The thicknesses, and other dimensions, of the antenna element 46 and the conductive reactance-modulator structures can be selected based on the wavelength(s) at which the antenna unit 32 is to be configured to operate, and on performance parameters with which the antenna unit is to be configured to operate.

Operation of the antenna unit 32 of FIGS. 11-12 can be similar to the operation described above for the antenna unit 32 of FIG. 7.

Still referring to FIGS. 11-12, alternate embodiments of the PCB assembly 192 are contemplated. For example, instead of securing the upper and lower conductive shields 206 and 210 about the inner dielectric layer 208 before bonding the upper and lower dielectric layers 204 and 212 to the upper and lower shields, respectively, the dielectric layers can be bonded to the shields before such securing, and holes can be formed through the lower dielectric layer 212 to accommodate the screws 220 so that the upper and lower conductive shields can be secured about the inner dielectric layer after the bonding of the upper and lower dielectric layers to the upper and lower shields. Furthermore, one or more embodiments described above in conjunction with FIGS. 1-10 and below in conjunction with FIGS. 13-21 may be applicable to the PCB assembly 192 of FIGS. 11-12.

Figure 13:
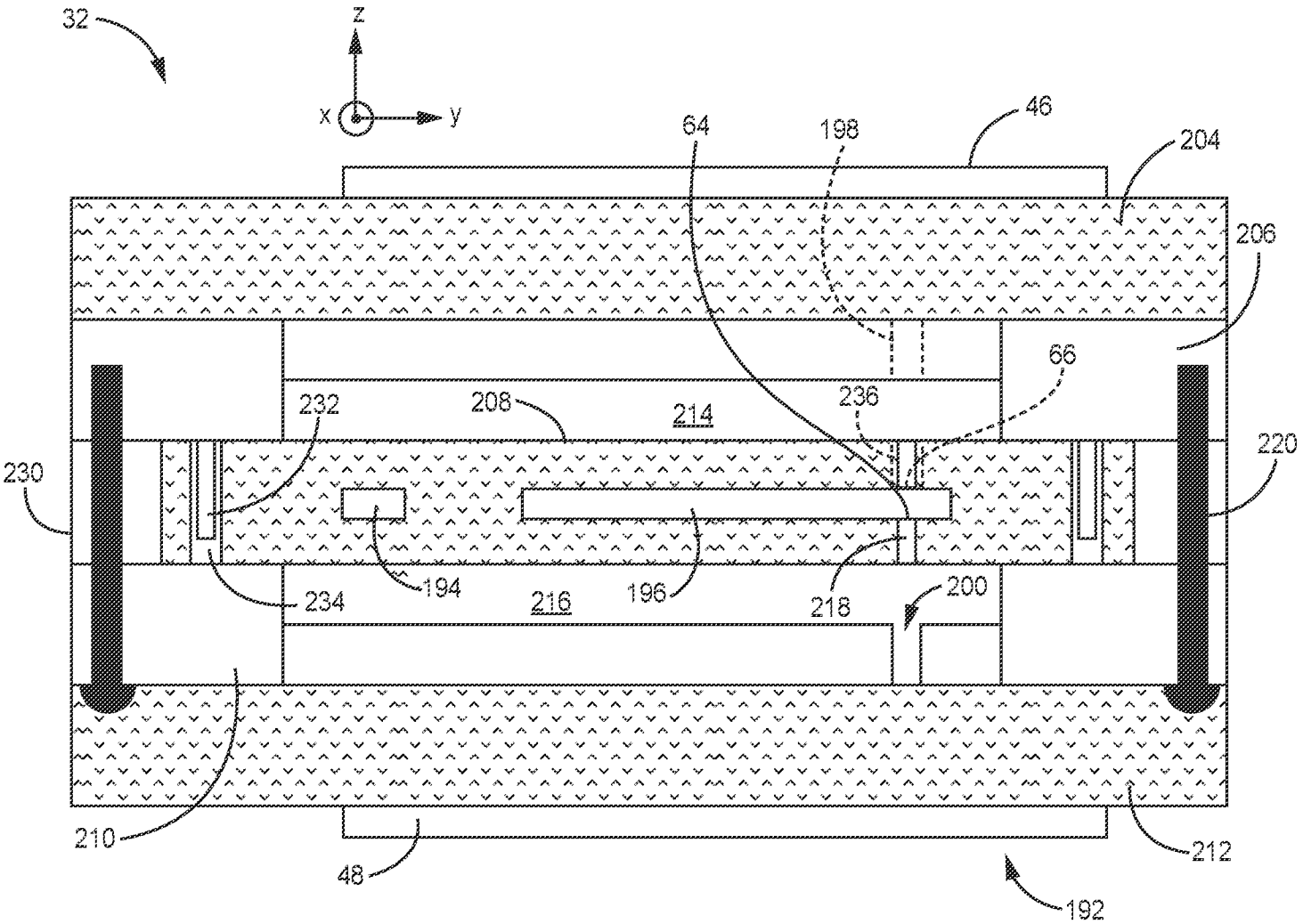
FIG. 13 is a cutaway side view of the antenna unit of FIG. 11, according to another embodiment.

FIG. 13 is cutaway side view of the PCB assembly 192 taken along lines C'-C' of FIG. 11, according to another embodiment in which components common to FIGS. 1-3 and 7-13 are labeled with like reference numerals.

The PCB assembly 192 of FIG. 13 is similar to the PCB assembly of FIG. 12 except that: 1) the conductors 194 and 196 of the signal coupler 44 are embedded inside of the inner dielectric layer 208 instead of being disposed over a surface of the inner dielectric layer, 2) conductive flanges 230 are disposed between the upper and lower shields 206 and 210, and 3) the vias 202 are replaced with conductive bumps or extensions 232.

Embedding the conductors 194 and 196 in the inner dielectric layer 208 can improve the signal-carrying characteristics of the strip line formed by the conductor 194 and the upper and lower shields 206 and 210 by approximately equalizing the distances, and, therefore, the permittivity and permeability distributions, between the conductor 194 and the upper and lower shields. Furthermore, because the conductor 196 is embedded, the antenna unit 32 includes a second conductive coupling probe 236 configured to couple the signal-isolated port 66 of the signal coupler 44 to the antenna element 46 via the chamber 214, the iris 198, and the upper dielectric layer 204. The second coupling probe 236 can be made from any suitable conductive material and can have any suitable dimensions. For example, the second probe 236 can be made from the same material, and can have the same dimensions, as the first probe 218.

The conductive flanges 230 can be configured to provide electrical coupling between the upper and lower shields 206 and 210 in the absence of the vias 202 (FIGS. 11-12).

And the conductive extensions 232 can form a pseudo Faraday cage in the absence of the vias 202. The extensions 232 can be formed to engage openings, hereinafter receptacles, 234, and can be configured to be shorter than the receptacles so that manufacturing tolerances do not cause a situation in which the upper shield 206 does not fully seat against the inner dielectric 208 or one or more of the flanges 230.

Referring to FIGS. 11 and 13, during manufacture of the PCB assembly 192, the conductors 194 and 196 are formed on a first dielectric layer, and then a second dielectric layer is formed over the first dielectric layer to form the inner dielectric layer 208 including the embedded conductors. The thicknesses of the conductors 194 and 196, and the distance by which these conductors are spaced apart from one another in the y dimension, can be selected based on the wavelength(s) for which he antenna unit 32 is to be configured, the permittivities and permeabilities of the intermediate dielectric layer 208 and of the materials partially or fully filling the chambers 214 and 216, and on other physical quantities and other considerations.

Next, the receptacles 234 for the extensions 232, and openings for the first probes 218 (only one first probe shown in FIG. 13) and the second probes 236 (only one second probe shown in FIG. 13) are formed in the inner dielectric layer 208, and the probe openings are filled with a conductive material, such as copper or another metal, to form the first and second probes. The thickness of the inner dielectric layer 208 and the dimensions of the first and second probes 218 and 236 can be selected based on the wavelength(s) for which the antenna unit 32 is to be configured, and on performance parameters of the antenna unit.

Then, the shields 206 and 210 are secured over and beneath, respectively, the inner dielectric layer 208 and the flanges 230 with the screws 220. Before installing the screws 220, an assembler (human or machine) may check that the extensions 232 are properly seated within the respective receptacles 234.

Next, the upper and lower dielectric layers 204 and 212 are respectively bonded, or otherwise attached, to the upper and lower conductive shields 206 and 210, respectively. The bonding can be any suitable bonding process and can use any suitable bonding agent or technique such as an adhesive or welding.

Then, the antenna element 46 is formed from a conductive layer over the upper dielectric layer 204, and one or more conductive structures of the reflective reactance modulator 48 are formed from a conductive layer over the lower dielectric layer 212. The thicknesses, and other dimensions, of the antenna element 46 and the conductive reactance-modulator structures can be selected based on the wavelength(s) and performance parameters for which the antenna unit 32 is to be configured.

Operation of the antenna unit 32 of FIGS. 11 and 13 can be similar to the operation described above for the antenna unit 32 of FIG. 7.

Still referring to FIGS. 11 and 13, alternate embodiments of the PCB assembly 192 are contemplated. For example, one or more embodiments described above in conjunction with FIGS. 1-10 and 12, and below in conjunction with FIGS. 14-21, may be applicable to the PCB assembly 192 of FIGS. 11 and 13.

Figure 14:
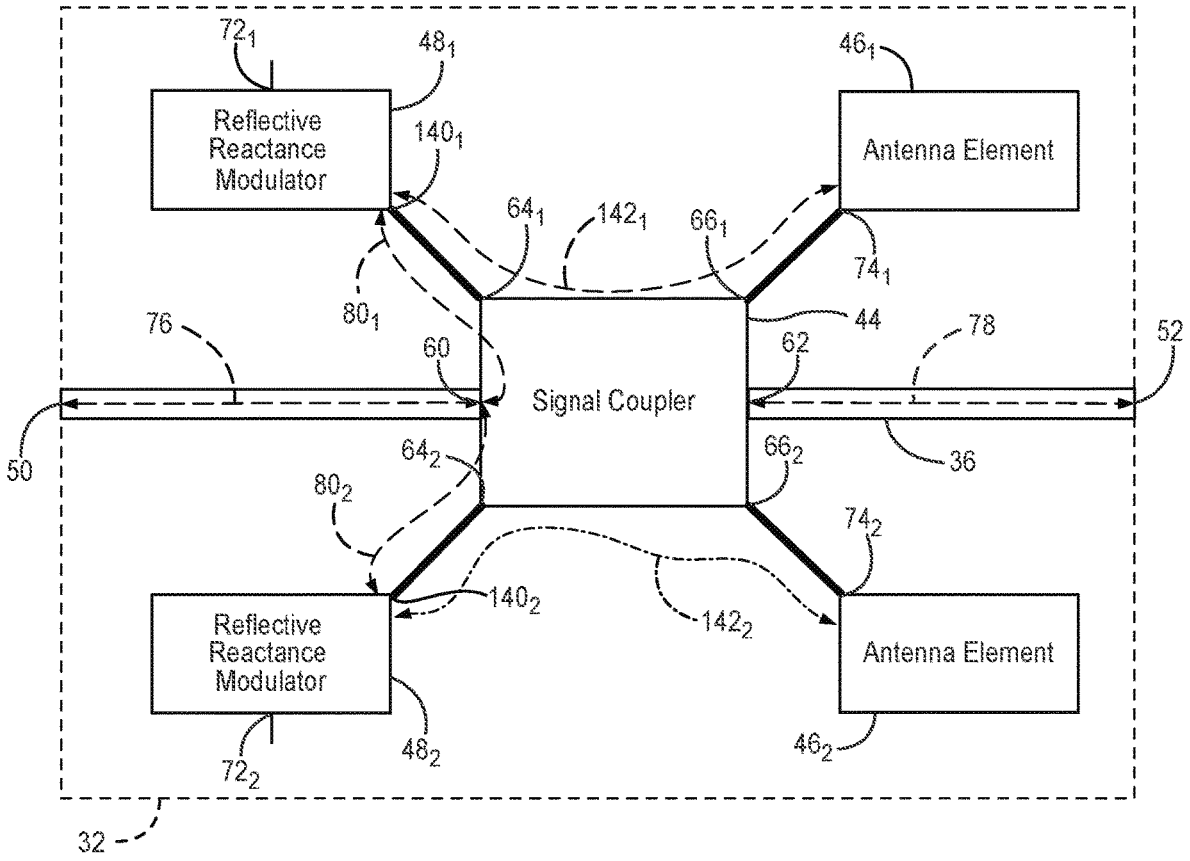
FIG. 14 is a diagram of an antenna unit of FIG. 1 including dual antenna elements and dual reflective reactance modulators, according to another embodiment.

FIG. 14 is a diagram of one of the antenna units 32 of FIG. 1, which antenna unit includes dual antenna elements $\mathbf{46}_1$ and $\mathbf{46}_2$ and dual reflective reactance modulators $\mathbf{48}_1$ and $\mathbf{48}_2$, according to an embodiment in which components common to FIGS. 1-3 and 7-14 are labeled with same reference numbers. Including dual antenna elements 46 and dual reactance modulators 48 can allow a reduction in the area per antenna unit 32, and, therefore, can allow a reduction in the size, in the component density, or in both the area and component density of the antenna 34 (FIG. 1).

The signal coupler 44 of FIG. 14 is similar to the signal coupler 44 of FIG. 7 except that the signal coupler of FIG. 14 has two signal-coupled ports $\mathbf{64}_1$ and $\mathbf{64}_2$ and two signal-isolated ports $\mathbf{66}_1$ and $\mathbf{66}_2$. That is, unlike the signal coupler 44 of FIG. 7, which is a four-port signal coupler, the signal coupler 44 of FIG. 14 is a six-port signal coupler.

The first antenna element $\mathbf{46}_1$ and the first reflective reactance modulator $\mathbf{48}_1$ are similar to the antenna element 46 and the reflective reactance modulator 48, respectively, of FIG. 7, and are coupled the first signal-isolated port $\mathbf{66}_1$ and to the first signal-coupled port $\mathbf{64}_1$, respectively, of the signal coupler 44 in a manner similar to the manner in which the antenna element 46 and the reflective reactance modulator 48 of FIG. 7 are coupled to the signal-isolated port 66 and to the signal-coupled port 64, respectively, of the signal coupler 44 of FIG. 7.

Likewise, the second antenna element $\mathbf{46}_2$ and the second reflective reactance modulator $\mathbf{48}_2$ are similar to the antenna element 46 and the reflective reactance modulator shifter 48, respectively, of FIG. 7, and are coupled to the second signal-isolated port $\mathbf{66}_2$ and to the second signal-coupled port $\mathbf{64}_2$, respectively, of the signal coupler 44 in a manner similar to the manner in which the antenna element 46 and the reactance modulator 48 of FIG. 7 are coupled to the signal-isolated port 66 and to the signal-coupled port 64, respectively, of the signal coupler 44 of FIG. 7.

In operation during a transmit mode, the signal coupler 44 receives, on the signal port 60 (via the port 50 if present), a transmit reference wave as indicated by the rightmost arrowhead of the signal-path-indicator line 76, couples a first portion of the transmit reference wave to the port 62, couples a second portion of the transmit reference wave, called the first transmit intermediate signal, to the first signal-coupled port $\mathbf{64}_1$, and couples a third portion of the transmit reference wave, called the second transmit intermediate signal, to the second signal-coupled port $\mathbf{64}_2$. And as indicated by the rightmost arrowhead of the signal-path-indicator line 78, the signal coupler 44 couples the first portion of the transmit reference wave from the port 62 to the transmission medium 36 (via the port 52 if present). Depending on the position of the antenna unit 32 in the row 30 (FIG. 1), the power of the first portion of the transmit reference wave that the signal coupler 44 effectively returns to the transmission medium 36 can be much different than the powers of the first and second transmit intermediate signals that the signal coupler couples to the first and second signal-coupled ports $\mathbf{64}_1$ and $\mathbf{64}_2$, respectively. For example, the power of the first portion of the transmit reference wave can be in an approximate range of one time to ten thousand times greater than the respective power of each of the first and second transmit intermediate signals.

The first reflective reactance modulator $\mathbf{48}_1$ receives, on the port $\mathbf{140}_1$, the first transmit intermediate signal from the first signal-coupled port $\mathbf{64}_1$ of the signal coupler 44 as indicated by the upper arrowhead of a signal-path-indicator curve $\mathbf{80}_1$, and receives, on the one or more first control nodes $\mathbf{72}_1$, a respective one or more first control signals from a controller circuit (not shown in FIG. 14).

Similarly, the second reflective reactance modulator $\mathbf{48}_2$ receives, on the port $\mathbf{140}_2$, the second transmit intermediate signal from the second signal-coupled port $\mathbf{64}_2$ of the signal coupler 44 as indicated by the lower arrowhead of a signal-path-indicator curve $\mathbf{80}_2$, and receives, on the one or more second control nodes $\mathbf{72}_2$, a respective one or more second control signals from a controller circuit (not shown in FIG. 14).

In response to the one or more first control signals on the first control nodes $\mathbf{72}_1$, the first reflective reactance modulator $\mathbf{48}_1$ shifts the phase of the first transmit intermediate signal by a first amount related to the values of the one or more first control signals as the first intermediate signal propagates from the port $\mathbf{140}_1$ to one or more reflective termination locations (not shown in FIG. 14) of the phase shifter, and shifts the phase of the first transmit intermediate signal, which is already phase shifted by the first amount, by a second amount related to the values of the one or more first control signals as the first transmit intermediate signal is reflected back from the one or more termination locations to the port $\mathbf{140}_1$. Because the first control signals have the same values while the first transmit intermediate signal is forward propagating and reverse (reflect) propagating, the first amount of phase shift is approximately equal to the second amount of phase shift such that at the port $\mathbf{140}_1$, the reflected first transmit intermediate signal has a total phase shift approximately equal to the sum of the first and second amounts. For example, each of the first control signals can represent a respective bit of phase-shift resolution between 0° and 360°. Further in example, if the number of first control signals is two, then the first control signals can cause the total relative phase shift that the first reactance modulator $\mathbf{48}_1$ imparts to the first transmit intermediate signal to be approximately one of the following four values: 0°, 90° (45° while propagating forward, another 45° after being reflected), 180° (90° while propagating forward, another 90° after being reflected), and 270° (135° while propagating forward, another 135° after being reflected). The first reflective reactance modulator $\mathbf{48}_1$ can be configured with any suitable number of bits of phase-shift resolution, such as approximately between two and sixteen bits of phase-shift resolution, to provide a number of possible different phase shifts in an approximate range of four to two hundred fifty six values.

Likewise, in response to the one or more second control signals on the second control nodes $\mathbf{72}_2$, the second reflective reactance modulator $\mathbf{48}_2$ shifts the phase of the second transmit intermediate signal by a first amount related to the values of the one or more second control signals as the second transmit intermediate signal propagates from the port $\mathbf{140}_1$ to one or more reflective termination locations (not shown in FIG. 14) of the second reactance modulator, and shifts the phase of the second transmit intermediate signal, which is already phase shifted by the first amount, by a second amount related to the values of the one or more second control signals as the second transmit intermediate signal is reflected back from the one or more termination locations to the port $\mathbf{140}_2$. Because the second control signals have the same values while the second transmit intermediate signal is forward propagating and reverse (reflect) propagating, the first amount of phase shift is approximately equal to the second amount of phase shift such that at the port $\mathbf{140}_2$, the reflected second transmit intermediate signal has a total phase shift approximately equal to the sum of the first and second amounts. For example, each of the second control signals can represent a respective bit of phase-shift resolution between 0° and 360°. Further in example, if the number of second control signals is two, then the second control signals can cause the total relative phase shift that the second phase shifter $\mathbf{48}_2$ imparts to the second intermediate signal to be approximately one of the following four values: 0°, 90° (45° while propagating forward, another 45° after being reflected), 180° (90° while propagating forward, another 90° after being reflected), and 270° (135° while propagating forward, another 135° after being reflected). The second reflective reactance modulator $\mathbf{48}_2$ can be configured with any suitable number of bits of phase-shift resolution, such as approximately between two and sixteen bits of phase-shift resolution, to provide a number of possible different phase shifts in an approximate range of four to two hundred fifty six values. Although the first and second reflective reactance modulators $\mathbf{48}_1$ and $\mathbf{48}_2$ typically have the same number of bits of phase resolution, the amount by which the first reactance modulator shifts the phase of the first transmit intermediate signal can be different than the amount by which the second reactance modulator shifts the phase of the second transmit intermediate signal.

The phase-shifted first transmit intermediate signal then propagates from the port $\mathbf{140}_1$ of the first reflective reactance modulator $\mathbf{48}_1$ to the first signal-coupled port $\mathbf{64}_1$ of the signal coupler 44, propagates from the first signal-coupled port to the first signal-isolated port $\mathbf{66}_1$, and propagates from the first signal-isolated port to the port $\mathbf{74}_1$ of the first antenna element $\mathbf{46}_1$ as indicated by the rightmost arrowhead of a signal-path-indicator curve $\mathbf{142}_1$. The signal coupler 44 is configured such that, ideally, all of the energy of the phase-shifted first transmit intermediate signal propagates from the first signal-coupled port $\mathbf{64}_1$ to the first signal-isolated port $\mathbf{66}_1$, and negligible or no energy from the phase-shifted first transmit intermediate signal propagates from the first signal-coupled port to either of the ports 60 and 62.

In response to the phase-shifted first transmit intermediate signal at the node $\mathbf{74}_1$, the first antenna element $\mathbf{46}_1$ radiates a first transmit signal having approximately the same phase, approximately the same frequency, and approximately the same power as the phase-shifted first transmit intermediate signal.

And in response to the phase-shifted second transmit intermediate signal at the node $\mathbf{74}_2$, the second antenna element $\mathbf{46}_2$ radiates a second transmit signal having approximately the same phase, approximately the same frequency, and approximately the same power as the phase-shifted second transmit intermediate signal.

In operation during a receive mode, the first antenna element $\mathbf{46}_1$ receives a first receive signal from a remote source, and, in response to the first receive signal, generates, at the port $\mathbf{74}_1$, a first receive intermediate signal having approximately the same phase, approximately the same frequency, and approximately the same power as the first receive signal.

Likewise, the second antenna element $\mathbf{46}_2$ receives a second receive signal from a remote source (may or may not be the same remote source from which the first antenna element $\mathbf{46}_1$ receives the first receive signal), and, in response to the second receive signal, generates, at the port $\mathbf{74}_2$, a second receive intermediate signal having approximately the same phase, approximately the same frequency, and approximately the same power as the second receive signal.

The signal coupler 44 receives, at the first signal-isolated port $\mathbf{66}_1$, the first receive intermediate signal from the first antenna element $\mathbf{46}_1$, and couples, via the first signal-coupled node $\mathbf{64}_1$, the first receive intermediate signal to the port $\mathbf{140}_1$ of the first reflective reactance modulator $\mathbf{48}_1$ as indicated by the leftmost arrowhead of the signal-path-indicator curve $\mathbf{142}_1$.

Similarly, the signal coupler 44 receives, at the second signal-isolated port $\mathbf{66}_2$, the second receive intermediate signal from the second antenna element $\mathbf{46}_2$, and couples, via the second signal-coupled node $\mathbf{64}_2$, the second receive intermediate signal to the port $\mathbf{140}_2$ of the second reflective reactance modulator $\mathbf{48}_2$ as indicated by the leftmost arrowhead of a signal-path-indicator curve 1422.

The first reflective reactance modulator $\mathbf{48}_1$, receives, on the one or more first control nodes $\mathbf{72}_1$, a respective one or more first control signals from a controller circuit (not shown in FIG. 14).

Likewise, the second reflective reactance modulator $\mathbf{48}_2$, receives, on the one or more second control nodes $\mathbf{72}_2$, a respective one or more second control signals from a controller circuit (not shown in FIG. 14).

Still referring to FIG. 14, in response to the one or more first control signals, the first reactance modulator $\mathbf{48}_1$ shifts the phase of the first receive intermediate signal by an amount related to the values of the one or more first control signals, and provides the phase-shifted first receive intermediate signal at the port $140_1$. As described above, the first reflective reactance modulator $48_1$ shifts the phase of the first receive intermediate signal by a first amount related to the values of the one or more first control signals as the first receive intermediate signal propagates from the port $140_1$ to one or more reflective termination locations of the first reflective reactance modulator, and further shifts the phase of the first receive intermediate signal by a second amount also related to the values of the one or more first control signals as the first receive intermediate signal is reflected back to the port $140_1$. For example, each of the first control signals can represent a respective bit of phase-shift resolution between 0° and 360°. Further in example, if the number of first control signals is two, then the first control signals can cause the relative phase shift that the first reflective reactance modulator $48_1$ imparts to the first receive intermediate signal to be approximately one of the following four values: 0°, 90° (45° while propagating forward, another 45° after being reflected), 180° (90° while propagating forward, another 90° after being reflected), and 270° (135° while propagating forward, another 135° after being reflected). The first reflective reactance modulator $48_1$ can be configured with any suitable number of bits of phase-shift resolution, such as approximately between two and sixteen bits of phase-shift resolution, to provide a number of possible different phase shifts in an approximate range of four to two hundred fifty six values.

Similarly, in response to the one or more second control signals, the second reactance modulator $48_2$ shifts the phase of the second receive intermediate signal by an amount related to the values of the one or more second control signals, and provides the phase-shifted second receive intermediate signal at the port $140_2$. As described above, the second reflective reactance modulator $48_2$ shifts the phase of the second receive intermediate signal by a first amount related to the values of the one or more second control signals as the second receive intermediate signal propagates from the port $140_2$ to one or more reflective termination locations of the second reflective reactance modulator, and further shifts the phase of the second receive intermediate signal by a second amount also related to the values of the one or more second control signals as the second receive intermediate signal is reflected back to the port $140_2$. For example, each of the second control signals can represent a respective bit of phase-shift resolution between 0° and 360°. Further in example, if the number of second control signals is two, then the second control signals can cause the relative phase shift that the second reflective reactance modulator $48_2$ imparts to the second receive intermediate signal to be approximately one of the following four values: 0°, 90° (45° while propagating forward, another 45° after being reflected), 180° (90° while propagating forward, another 90° after being reflected), and 270° (135° while propagating forward, another 135° after being reflected). The second reflective reactance modulator $48_2$ can be configured with any suitable number of bits of phase-shift resolution, such as approximately between two and sixteen bits of phase-shift resolution, to provide a number of possible different phase shifts in an approximate range of four to two hundred fifty six values. And although the first and second reflective reactance modulators $48_1$ and $48_2$ typically have the same number of bits of phase resolution, the amount by which the first reactance modulator shifts the phase of the first receive intermediate signal can be different than the amount by which the second reactance modulator shifts the phase of the second receive intermediate signal.

The signal coupler 44 receives, on the first signal-coupled port $64_1$, the phase-shifted first receive intermediate signal from the first reflective reactance modulator $48_1$, and couples the phase-shifted first receive intermediate signal to the transmission medium 36 via the port 60 (and the port 50 if present), as indicated by the lower arrowhead of the signal-path-indicator curve $80_1$.

Likewise, the signal coupler 44 receives, on the second signal-coupled port $64_2$, the phase-shifted second intermediate receive signal from the second reflective reactance modulator $48_2$, and couples the phase-shifted second receive intermediate signal to the transmission medium 36 via the port 60 (and the port 50 if present), as indicated by the upper arrowhead of the signal-path-indicator curve $80_2$.

The signal coupler 44 also receives, on the port 62, a receive reference wave (if the antenna unit 32 is other than the last antenna unit $32_n$ in the row 30 of FIG. 1), and couples the receive reference wave to the transmission medium 36 via the port 60 (and via the port 50 if present), as indicated by the leftmost arrowheads of the signal-path-indicator lines 78 and 76.

That is, the signal coupler 44 effectively combines the phase-shifted first and second receive intermediate signals from the first and second signal-coupled ports $64_1$ and $64_2$ with the receive reference wave from the port 62 by superimposing these signals onto one another, and provides, via the port 60 (and the port 50 if present), the combined signal to the transmission medium 36 as a modified receive reference wave. Depending on the location of the antenna unit 32 within the row 30 (FIG. 1), the power of the received reference wave at the port 62 can be very different than the respective power of each of the phase-shifted first and second receive intermediate signals that the signal coupler 44 respectively receives at the signal-coupled ports $64_1$ and $64_2$. For example, the power of the receive reference wave can be in an approximate range of one time to ten thousand times greater than the power of one, or the powers of both, of the phase-shifted first and second receive intermediate signals.

Based on the above description of the operation of the antenna unit 32, it is evident that the signal coupler 44 is configured as a pseudo circulator, and the ports 60, $64_1$, $64_2$, $66_1$ and $66_2$ are configured as pseudo-circulator ports, such that, ignoring leakage, during a transmit mode, signal energy flows between these ports only in one direction (clockwise in FIG. 14), and such that during a receive mode, signal energy flows between these ports only in the opposite direction (counterclockwise in FIG. 14).

Still referring to FIG. 14, alternate embodiments of the signal antenna unit 32 are contemplated. For example, one or more embodiments described above in conjunction with FIGS. 1-3 and 7-13 and below in conjunction with FIGS. 15-21 may be applicable to the antenna unit 32 of FIG. 14.

Figure 15:
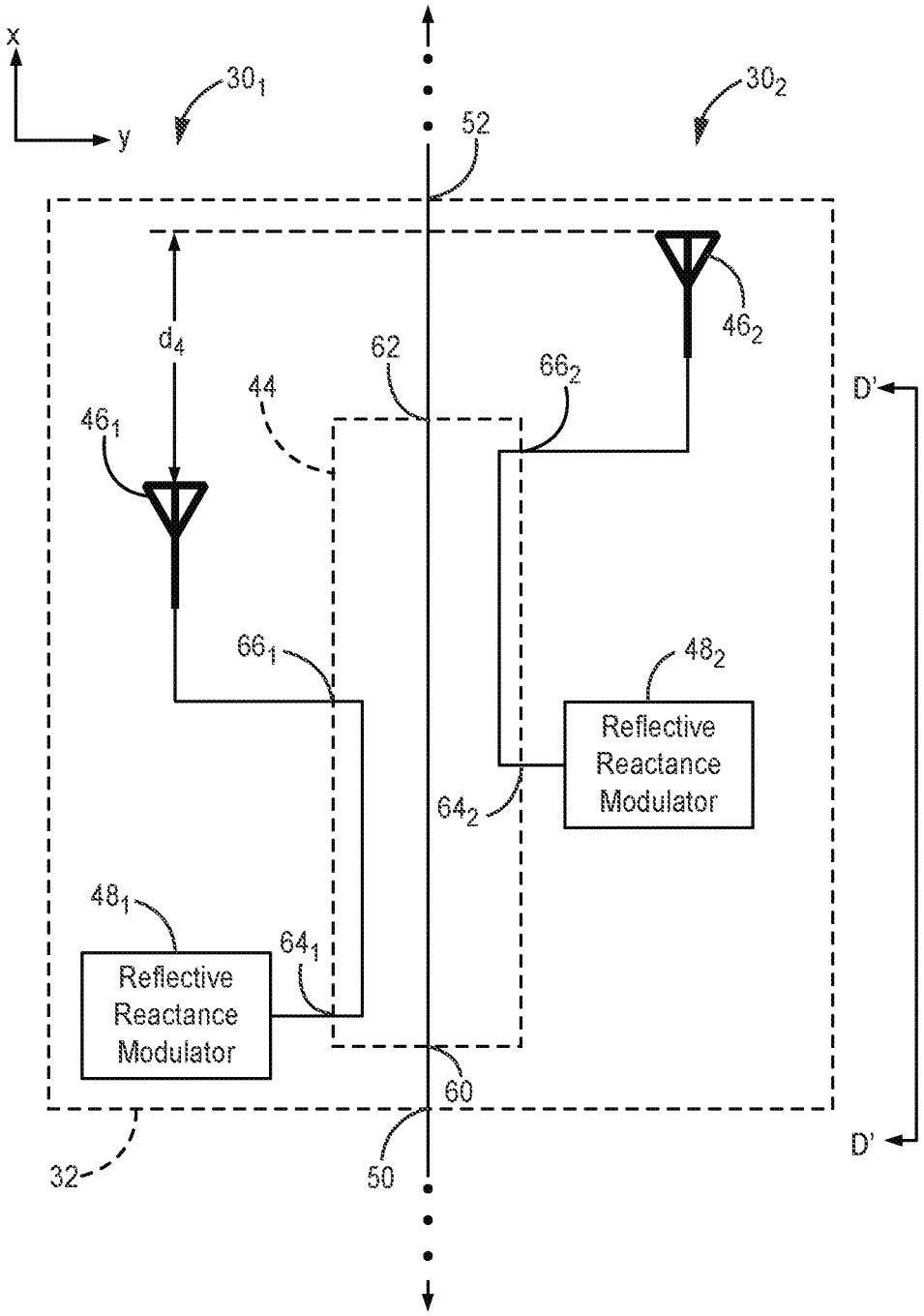
FIG. 15 is a diagram of the antenna unit of FIG. 14, according to an embodiment in which the dual antenna elements are offset from one another.

FIG. 15 is a diagram of the antenna unit 32 of FIG. 14, according to an embodiment in which the antenna unit has a folded layout and components common to FIGS. 1-3 and 7-15 are labeled with same reference numbers. Folding the antenna elements 46 and reactance modulators 48 can allow a reduction in the area per antenna unit 32, and, therefore, can allow a reduction in the size, in the component density, or in both the size and component density, of an antenna 34 (FIG. 1) that incorporates one of more of the antenna units of FIG. 15.

The first antenna element $46_1$ is part of a first row 301 of antenna elements, and the second antenna element $46_2$ is part of a second row 302 of antenna elements. And the first reactance modulator $\mathbf{48}_1$ can be considered to be part of the first row 301 of antenna elements, and the second reactance modulator $\mathbf{48}_2$ can be considered to be part of the second row 302 of antenna elements.

The first antenna element $\mathbf{46}_1$ is offset from the second antenna element $\mathbf{46}_2$ by a distance $d_4$ in the x dimension, which is the dimension along which the rows 301 and 302 lie. For example, a location (e.g., an edge) of the first antenna element $\mathbf{46}_1$ is offset by $d_4$ from a corresponding same location (e.g., a same edge) of the second antenna element $\mathbf{46}_2$.

Similarly, the first reflective reactance modulator $\mathbf{48}_1$ is offset from the second reflective reactance modulator $\mathbf{48}_2$ by approximately the distance $d_4$ in the x dimension.

Offsetting the antenna elements 46 in one row 30 relative to the antenna elements and reactance modulators in adjacent rows can reduce the y-dimension width of an antenna that includes the antenna units 32. Because the antenna elements 46 in one row 30 can "slide between" the antenna elements in an adjacent row, the antenna elements can overlap, at least partially, in the y dimension. If the antenna elements 46 in one row 30 are not offset from the antenna elements in an adjacent row, then no overlapping is allowed, and a minimum separation in the y dimension is maintained between adjacent antenna elements in adjacent rows.

Offsetting the reactance modulators 48 in one row 30 relative to the reactance modulators in adjacent rows also can reduce the y-dimension width of an antenna that includes the antenna units 32 for similar reasons.

Still referring to FIG. 15, alternate embodiments of the dual-antenna-element antenna unit 32 are contemplated. For example, the antenna unit 32 can have a structure similar to any one of the structures described above in conjunction with FIGS. 11-13 modified for a folded layout. In addition, one or more embodiments described above in conjunction with FIGS. 1-3 and 7-14 and below in conjunction with FIGS. 16-21 may be applicable to the antenna unit 32 of FIG. 15.

Figure 16:
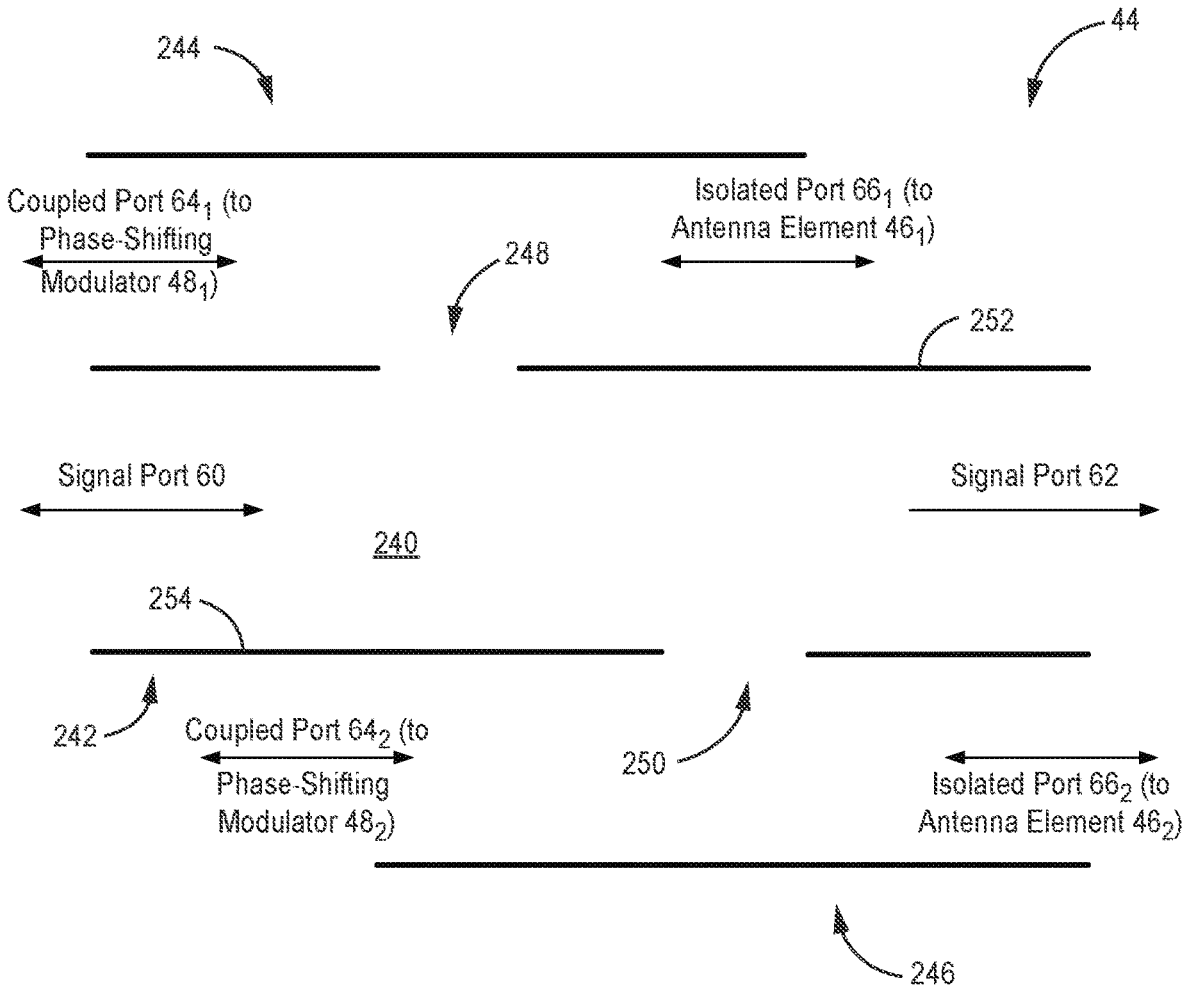
FIG. 16 is a cutaway side view of the antenna unit of FIG. 15, according to an embodiment.

FIG. 16 is a cutaway side view of the signal coupler 44 taken along lines D'-D' of FIG. 15, according to an embodiment in which components common to FIGS. 1-3 and 7-16 are labeled with same reference numbers.

In addition to the signal ports 60 and 62, the first and second signal-coupled ports $\mathbf{64}_1$ and $\mathbf{64}_2$, and the first and second signal-isolated ports $\mathbf{66}_1$ and $\mathbf{66}_2$, the signal coupler 44 includes a portion 240 of a first waveguide 242, a second waveguide 244, a third waveguide 246, a first iris 248, and a second iris 250.

The signal ports 60 and 62 are effectively disposed in the portion 240 of the first waveguide 242, which can be a continuous waveguide that also forms the transmission medium 36 (e.g., FIG. 14), and, therefore, the signal ports 60 and 62 of other signal couplers 44 in a row 30 of antenna units 32 (FIG. 1). For example, the first waveguide 242 can be any suitable waveguide such as a rectangular waveguide configured to have, at the wavelength of a reference wave that propagates along the first waveguide, a primary propagation mode of $TE_{10}$.

The first signal-coupled port $\mathbf{64}_1$ and the first signal-isolated port $\mathbf{66}_1$ are effectively disposed at opposite ends of the second waveguide 244. For example, the second waveguide 244 can be any suitable waveguide, such as a rectangular waveguide, configured to have, at the wavelength of a reference wave that propagates along the second waveguide, a primary propagation mode of $TE_{10}$.

Likewise, the second signal-coupled port $\mathbf{64}_2$ and the second signal-isolated port $\mathbf{66}_2$ are effectively disposed at opposite ends of the third waveguide 246. For example, the third waveguide 246 can be any suitable waveguide, such as a rectangular waveguide, configured to have, at the wavelength of a reference wave that propagates along the third waveguide, a primary propagation mode of $TE_{10}$.

The iris 248 is an opening that is disposed in a conductive boundary 252 disposed between, and shared by, the first and second waveguides 242 and 244, and can have any suitable dimensions. For example, the iris 248 can form, or can form part of, a Bethe hole signal coupler.

Similarly, the iris 250 is an opening that is disposed in a conductive boundary 254 disposed between, and shared by, the first and third waveguides 242 and 246, and can have any suitable dimensions. For example, the iris 250 can form, or can form part of, a Bethe hole signal coupler.

Operation of the signal coupler 44 is described according to an embodiment in which the signal coupler is part of an antenna unit 32 other than the last antenna unit in a row 30 (FIG. 1) of antenna units.

In operation during a transmit mode in which a transmit reference wave propagates along the first waveguide 242 from the signal port 60 to the signal port 62, the iris 248 couples, to the second wave guide 244 as the first transmit intermediate signal, a first portion of the transmit reference wave.

Likewise, the iris 250 couples, to the third waveguide 246 as the second transmit intermediate signal, a second portion of the transmit reference wave.

The first transmit intermediate signal propagates from the iris 248 to the signal-coupled port $\mathbf{64}_1$.

Similarly, the second transmit intermediate signal propagates from the iris 250 to the signal-coupled port $\mathbf{64}_2$.

The first transmit intermediate signal then propagates from the signal-coupled port $\mathbf{64}_1$ into the reflective reactance modulator $\mathbf{48}_1$, which shifts the phase of the first transmit intermediate signal by an amount corresponding to the respective values of the one or more first control signals on the first control nodes $\mathbf{72}_1$ (e.g., FIG. 7).

Likewise, the second transmit intermediate signal then propagates from the signal-coupled port $\mathbf{64}_2$ into the reflective reactance modulator $\mathbf{48}_2$, which shifts the phase of the second transmit intermediate signal by an amount corresponding to the respective values of the one or more second control signals on the second control nodes $\mathbf{72}_2$ (not shown in FIG. 16).

The phase-shifted first transmit intermediate signal is reflected back out of the reactance modulator $\mathbf{48}_1$ to the signal-coupled port $\mathbf{64}_1$.

Likewise, the phase-shifted second transmit intermediate signal is reflected back out of the reactance modulator $\mathbf{48}_2$ to the signal-coupled port $\mathbf{64}_2$.

The phase-shifted first transmit intermediate signal then propagates from the first signal-coupled port $\mathbf{64}_1$, to the first signal-isolated port $\mathbf{66}_1$, and to the first antenna element $\mathbf{46}_1$, which radiates a first transmit signal in response to the phase-shifted first transmit intermediate signal.

Likewise, the phase-shifted second transmit intermediate signal then propagates from the second signal-coupled port $\mathbf{64}_2$, to the second signal-isolated port $\mathbf{66}_2$, and to the second antenna element $\mathbf{46}_2$, which radiates a second transmit signal in response to the phase-shifted second transmit intermediate signal.

In operation during a receive mode in which a receive reference wave propagates along the first waveguide 242 from the signal port 62 to the signal port 60, the antenna element $46_1$ receives a first receive signal from a remote location, and, in response to the first receive signal, generates, and couples to the first signal-isolated port $66_1$, a first receive intermediate signal.

Similarly, the second antenna element $46_2$ receives a second receive signal from a remote location (for example, from the same remote location from which the first antenna element $46_1$ receives the first receive signal), and, in response to the second receive signal, generates, and couples to the second signal-isolated port $66_2$, a second receive intermediate signal.

The first receive intermediate signal propagates along the second waveguide 244 from the first signal-isolated port $66_1$ to the first signal-coupled port $64_1$, and propagates from the first signal-coupled port into the first reflective reactance modulator $48_1$.

Likewise, the second receive intermediate signal propagates along the third waveguide 246 from the second signal-isolated port $66_2$ to the second signal-coupled port $64_2$, and propagates from the second signal-coupled port into the second reflective reactance modulator $48_2$.

The first reflective reactance modulator $48_1$ shifts the phase of the first receive intermediate signal by an amount corresponding to the values of the one or more first control signals on the respective control lines $72_1$ (e.g., FIG. 7), and couples the phase-shifted first receive intermediate signal back to the first signal-coupled port $64_1$.

Similarly, the second reflective reactance modulator $48_2$ shifts the phase of the second receive intermediate signal by an amount corresponding to the values of the one or more second control signals on the respective control lines $72_2$ (e.g., FIG. 7), and couples the phase-shifted second receive intermediate signal back to the second signal-coupled port $64_2$.

The phase-shifted first receive intermediate signal propagates along the second waveguide 244 from the first signal-coupled port $64_1$ to the first iris 248, which couples the phase-shifted first receive intermediate signal to the first waveguide 242.

Likewise, the phase-shifted second receive intermediate signal propagates along the third waveguide 246 from the second signal-coupled port $64_2$ to the second iris 250, which couples the phase-shifted second receive intermediate signal to the first waveguide 242.

The first waveguide 242 effectively combines the phase-shifted first and second receive intermediate signals from the irises 248 and 250 with the receive reference wave propagating along the first waveguide from the signal port 62 to the signal port 60 to generate a modified receive reference wave at the signal port 60.

Still referring to FIG. 16, alternate embodiments of the signal coupler 44 are contemplated. For example, instead of sharing the wider (top/bottom) conductive boundaries 252 and 254, the first, second, and third waveguides 242, 244, and 246 can be arranged side by side, and can share narrower (side) conductive boundaries (not shown in FIGS. 15-16) such that the irises 248 and 250 each can form, or each can form part of, a respective Riblet-Saad coupler. Furthermore, one or more embodiments described above in conjunction with FIGS. 1-3 and 7-15 and below in conjunction with FIGS. 17-21 may be applicable to the signal coupler 44 of FIG. 16.

Figure 17:
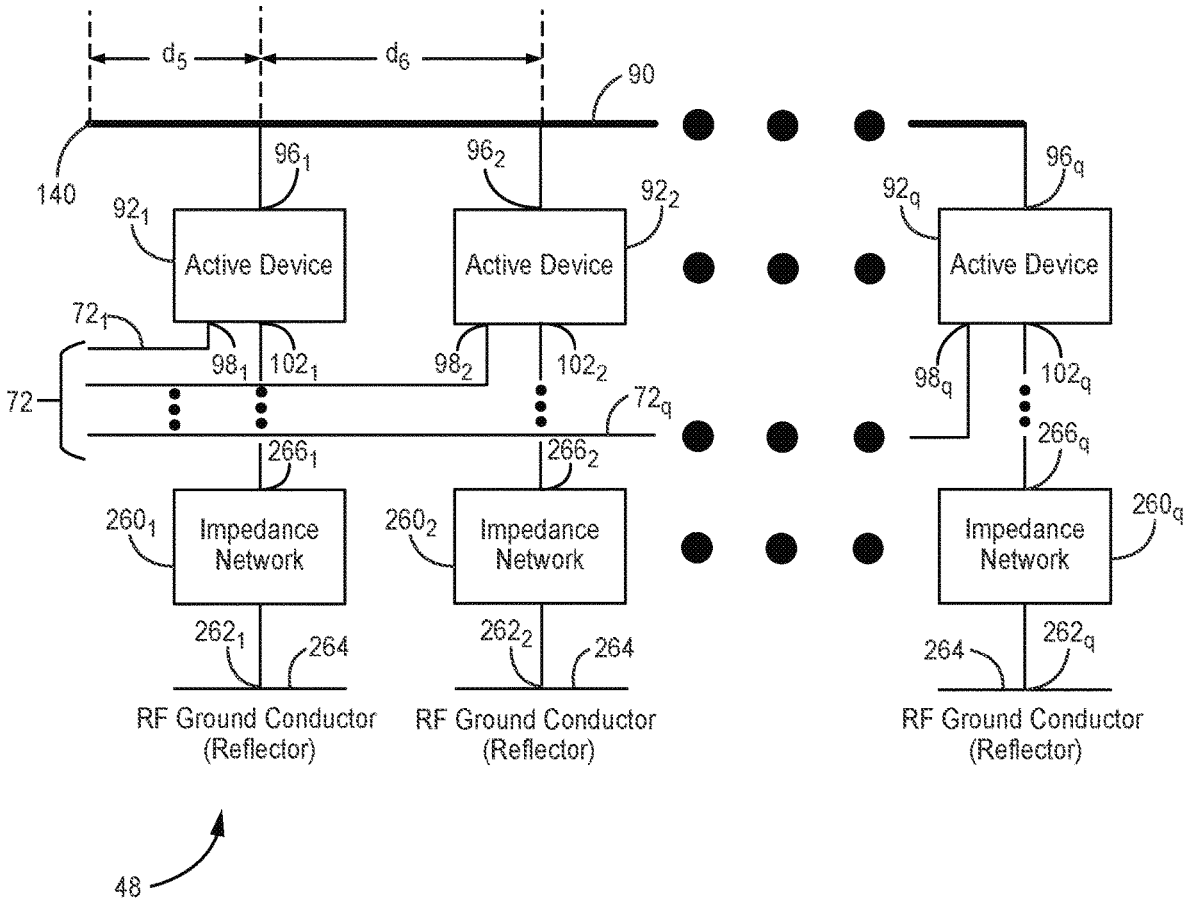
FIG. 17 is a diagram of a reflective reactance modulator of FIGS. 1, 7, 9, and 11-15, according to an embodiment.

FIG. 17 is a diagram of one of the reflective reactance modulator 48 of FIGS. 7, 9, and 14-15, according to an embodiment in which like numbers reference components common to FIGS. 4-6 and 17.

In addition to the port 140 and the control nodes $72_1$-$72_q$, the reflective reactance modulator 48 includes a transmission medium 90, one or more active devices $92_1$-$92_q$, and one or more impedance networks $260_1$-$260_q$, which are each coupled between a respective one of the active devices $92_1$-$92_q$ and a respective connection node $262_1$-$262_q$ of an RF ground conductor 264, which also may be called a ground plane, a reflector plane, or a reflective plane.

The transmission medium 90 is coupled between the port 140 and a port $96_q$ of the active device $92_q$ farthest from the port 140, and can be any type of transmission medium that is suitable for an application in which an antenna that includes the reflective reactance modulator 48 is configured to be used. For example, the transmission medium 90 can be the same as, or similar to, the transmission medium 36 (e.g., FIG. 7). Further in example, the transmission medium 90 can be a strip line, a microstrip line, a CPW, a GBCPW, or a tubular waveguide having a cross section that is rectangular or another suitable shape.

The one or more active devices 92 each have a respective first port 96 coupled to the transmission medium 90 in any suitable manner and a respective second port 98 coupled to a respective one of the control nodes 72, and are each configured to have a respective complex impedance that can be altered in response to a respective one of the one or more control signals on the respective one of the control nodes. For example, each device 92 can be any suitable type of adjustable-impedance device (see, e.g., FIGS. 18-19). Further in example, by applying to an active device 92 a binary control signal on a respective control line 72, a controller circuit (not shown in FIG. 17) can cause the impedance of the active device to have one of two values depending on whether the control signal represents logic 0 or a logic 1, and, therefore, can cause the active device to contribute one bit of phase shift to a signal propagating into and out from the port 140.

Still referring to FIG. 17, the port $96_1$ of an active device $92_1$ closest to the port 140 is spaced from the port 140 by a distance $d_5$, and the ports $96_1$-$96_q$ of adjacent ones of the active devices $92_1$-$92_q$ are spaced apart by approximately a distance $d_6$, which may be approximately the same as, or different than, the distance $d_5$. Because the phase shift imparted to a signal by the reflective reactance modulator 48 depends on the distances $d_5$ and $d_6$, a designer can set these distances such that the phase shifter imparts a respective predictable phase shift to a signal propagating along the transmission medium 90 for each possible logic-1-logic-0 pattern of the control signals on the control nodes 72.

Each impedance network 260 has a respective node 266, which is coupled to a node 102 of a respective one of the active devices 92, and which is configured to couple the respective active device to the RF ground conductor node 262 such that, ideally, all of the power of a signal that propagates from the transmission medium 90, through the active device 92 and the impedance network 260, to the node 262 is reflected, or otherwise redirected, by the RF ground conductor 264, back through the impedance network, the active device, and the transmission medium 90 to the port 140.

Still referring to FIG. 17, operation of the reflective reactance modulator 48 is described according to an embodiment in which an intermediate signal (either a transmit intermediate signal or a receive intermediate signal) propagates into, and then back out from, the reflective reactance modulator via the port 140.

A controller circuit (not shown in FIG. 17) generates, on the control nodes 72, control signals having respective values that correspond to a total phase shift that the controller circuit controls the reflective reactance modulator 48 to impart to the intermediate signal.

Next, the intermediate signal experiences a first phase shift as it propagates the distance $d_5$ from the port 140 to the location of the transmission medium 90 that is coupled to the port $\mathbf{96}_1$ of the active device $\mathbf{92}_1$. The amount of the first phase shift is related to the distance $d_5$ and to the wavelength $\lambda_m$ of the intermediate signal in the transmission medium 90; the greater the distance $d_5$ and the shorter $\lambda_m$, the greater the first phase shift and vice-versa (assuming that $d_5<n\cdot\lambda_m$, where n is an integer).

Then, at the location of the transmission medium 90 that is coupled to the port $\mathbf{96}_1$ of the active device $\mathbf{92}_1$, the intermediate signal experiences a second phase shift due to the impedance of the active device $\mathbf{92}_1$, which impedance corresponds to the value of the control signal on the control node $\mathbf{72}_1$. In more detail, a portion, or component, of the intermediate signal propagates through the active device $\mathbf{92}_1$ (the remaining component of the intermediate signal continues forward propagating along the transmission medium 90 toward the final active device $\mathbf{92}_q$) and experiences a phase shift that corresponds to the value of the control signal on the node $\mathbf{72}_1$. Next, the component of the intermediate signal propagates through the impedance network $\mathbf{260}_1$. The component of the intermediate signal may or may not experience a phase shift as it propagates through the impedance network $\mathbf{260}_1$, but it is assumed for purposes of this example that the component of the intermediate signal experiences no phase shift as it propagates through the impedance network. Then, the component of the intermediate signal propagates to the ground-conductor node $\mathbf{262}_1$, and the ground conductor 264 reflects, or otherwise redirects, the component of the intermediate signal back through the impedance network $\mathbf{260}_1$ and the active device $\mathbf{92}_1$. As it propagates back through the active device $\mathbf{92}_1$, the reflected component of the intermediate signal experiences an additional phase shift that corresponds to the value of the control signal on the node $\mathbf{72}_1$. That is, the reflected, component of the intermediate signal experiences approximately the same phase shift as it reverse propagates through the active device $\mathbf{92}_1$ from the port $\mathbf{102}_1$ to the port $\mathbf{96}_1$ that the same component of the intermediate signal previously experienced as it forward propagated through the active device from the port $\mathbf{96}_1$ to the port $\mathbf{102}_1$.

Next, assuming for purposes of this example that the distance between the port $\mathbf{96}_1$ and the transmission medium 90 is negligible or zero, the reflected component of the intermediate signal at the node $\mathbf{96}_1$ is superimposed on the reflected intermediate signal reverse propagating along the transmission medium 90 toward the port 140 to form the reflected intermediate signal. The reflected intermediate signal experiences yet another phase shift as it propagates the distance $d_5$ from the location of the transmission medium that is coupled to the port $\mathbf{96}_1$ to the port 140.

Other components of the intermediate signal each respectively forward propagate through a respective pair of an active device 92 and an impedance network 260, are each reflected by the ground conductor 264, and each reverse propagate back through the respective pair of the active device and the impedance network, in a manner similar to that described above for the pair of the active device $\mathbf{92}_1$ and the impedance network $\mathbf{260}_1$.

And the combination of these reflected components that reverse propagate from the respective active devices 92 to the port 140 forms the reflected intermediate signal in the transmission medium 90.

Therefore, the intermediate signal experiences a total phase shift having phase-shift components imparted by the active devices 92, and by the distances $d_5$ and $d_6$, as the components of the intermediate signal forward propagate from the node 140, through the transmission medium 90, and through the active devices, and as the components of the intermediate signal reverse propagate back through the active devices, back along the transmission medium, to the node 140. In the above-described example, the intermediate signal experiences, ideally, the same phase shift as it forward propagates from the port 140 through the reactance modulator 48 and as it does as it reverse propagates back through the reactance modulator to the port 140.

Consequently, at the port 140, the intermediate signal has a total phase shift equal to the sum of all the phase shifts that components of the intermediate signal respectively experienced as these signal components forward propagated and reverse propagated through the reflective reactance modulator 48.

Still referring to FIG. 17, alternate embodiments of the reflective reactance modulator 48 are contemplated. For example, there may be a respective finite distance between the port 96 of each active device 92 and the transmission medium 90, and the respective component of the intermediate signal may experience respective phase shifts as it forward and reverse propagates along this respective finite distance. Furthermore, one or more of the impedance networks 260 can be omitted such that the node 102 of the corresponding active device 92 is coupled to the node 262 of the ground conductor 264. Moreover, one or more embodiments described above in conjunction with FIGS. 1-16 and below in conjunction with FIGS. 18-21 may be applicable to the reflective reactance modulator 48 of FIG. 17.

Figure 18:
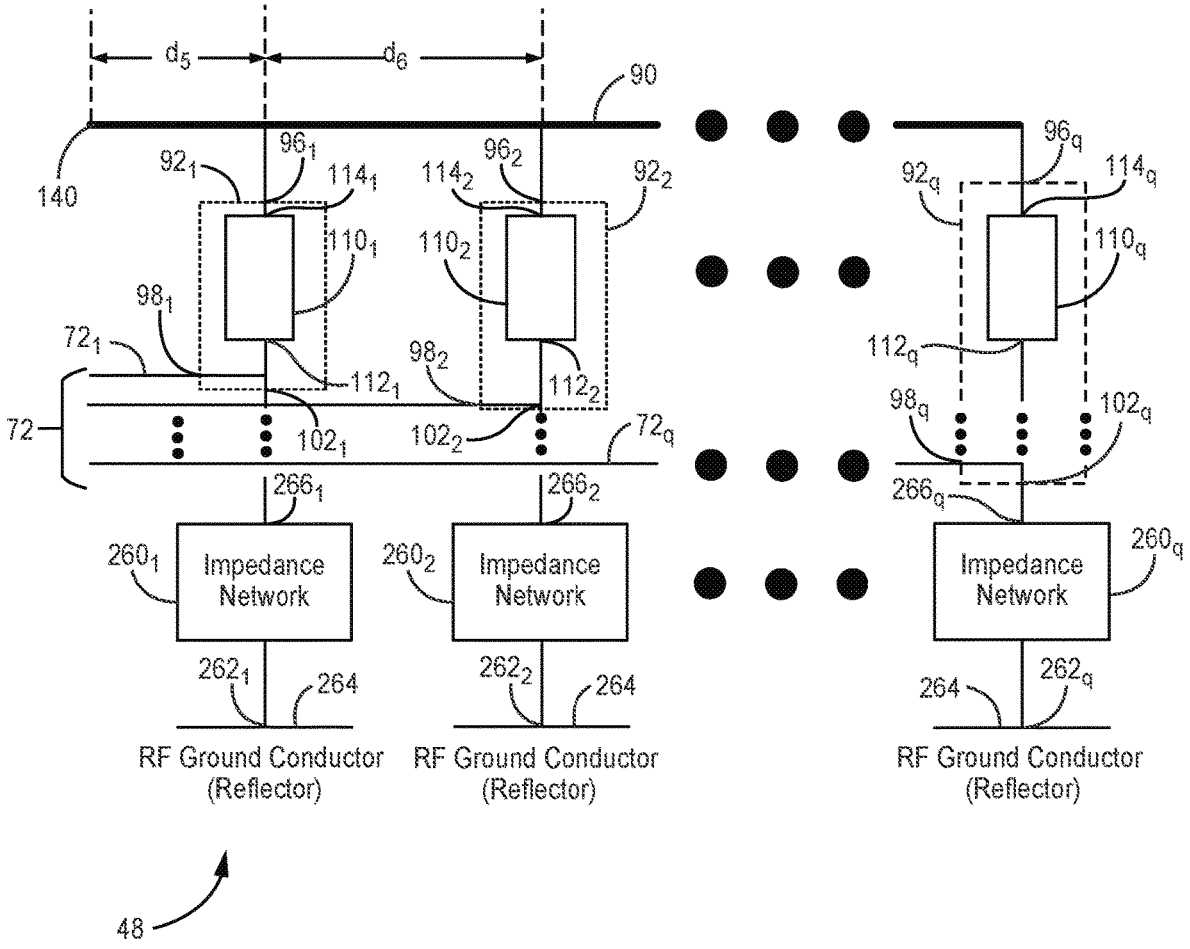
FIG. 18 is a diagram of the reflective reactance modulator of FIG. 17, according to an embodiment.

FIG. 18 is a diagram of the reflective reactance modulator 48 of FIG. 17, according to an embodiment in which each of the active devices 92 includes a respective two-terminal impedance device (e.g., a PIN diode) 110, and where like numerals reference components common to FIGS. 4-6 and 17-18.

A controller circuit (not shown in FIG. 18) is configured to cause each two-terminal impedance device 110 to present an inductive impedance to the intermediate signal propagating along the transmission medium 90 by generating, on the respective control line 72, a control voltage that renders the impedance device inductive. For example, the controller circuit can be configured to generate, on a cathode 112 of a PIN diode, a negative DC voltage (e.g., −3.0 V) to forward bias the diode.

The respective inductive impedance causes each two-terminal impedance device 110 to shift the phase of a respective component of the intermediate signal propagating along the transmission medium 90 by a corresponding first amount as the component forward propagates through the impedance device, and again by approximately the first amount as the reflected component reverse propagates through the impedance device.

Similarly, the controller circuit (not shown in FIG. 18) is configured to cause each two-terminal impedance device 110 to present a capacitive impedance to the intermediate signal propagating along the transmission medium 90 by generating, on the respective control line 72, a control voltage that renders the impedance device capacitive. For example, the controller circuit can be configured to generate, on a cathode 112 of a PIN diode, a positive DC voltage (e.g., +3.0 V) to forward bias the diode.

The respective capacitive impedance causes each two-terminal impedance device 110 to shift the phase of a respective component of the intermediate signal propagating along the transmission medium 90 by a corresponding second amount as the component forward propagates through the impedance device, and again by approximately the second amount as the component reverse propagates through the impedance device.

The second amount of phase shift may be different than the first amount of phase shift that a two-terminal impedance device 110 imparts to the signal component while the impedance device is inductive. For example, the first amount of phase shift may have approximately the same magnitude, but an opposite polarity, as compared to the second amount of phase shift. Or the first amount of phase shift may have a different magnitude and a same or different polarity as the second amount of phase shift.

Furthermore, each impedance network 260 can be, or can include, a suitable and respective RF bypass circuit, or a suitable and respective RF bypass structure (neither bypass circuit nor bypass structure shown in FIG. 18), coupled to one or both of the cathode 112 and an anode 114 of each diode 110 so that the DC control voltage does not affect, adversely, the RF operation of the reflective reactance modulator 48, and so that the RF signals do not affect, adversely, the DC operation of the reflective reactance modulator. Said another way, the RF bypass circuits or RF bypass structures effectively isolate the DC-control-voltage-generating circuitry from the RF signals, and effectively isolate the RF circuitry from the DC signals.

The operation of the reflective reactance modulator 48 of FIG. 18 is similar to the operation of the reflective reactance modulator 48 of FIG. 17 in an embodiment.

Still referring to FIG. 18, alternate embodiments of the reflective reactance modulator 48 are contemplated. For example, each of one or more of the active devices 92 may include a respective varactor as two-terminal impedance device 110. Furthermore, although the control lines 72 are described as being coupled to the terminals 112 of the impedance devices 110, each of one or more of the control lines can be coupled to a terminal 114 of a respective impedance device. Moreover, although each control signal is described as a control voltage having two values, each control voltage can have more than two values. In addition, one or more embodiments described above in conjunction with FIGS. 1-17 and below in conjunction with FIGS. 19-21 may be applicable to the reflective reactance modulator 48 of FIG. 18.

Figure 19:
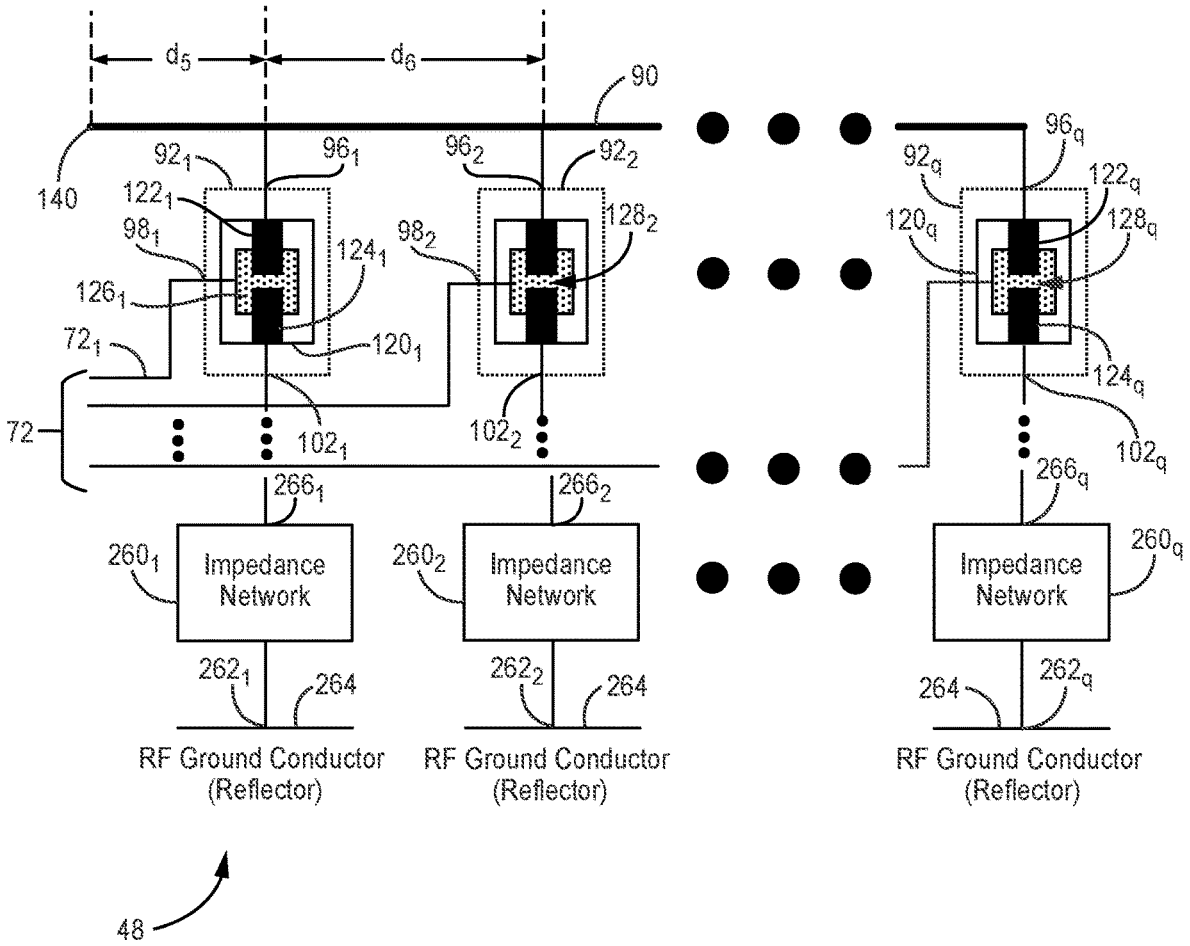
FIG. 19 is a diagram of the reflective reactance modulator of FIG. 17, according to another embodiment.

FIG. 19 is a diagram of the reflective reactance modulator 48 of FIG. 17, according to an embodiment in which each of the active devices 92 includes a respective capacitor 120 including a capacitive junction over a tunable two-dimensional material layer, and where like numerals reference components common to FIGS. 4-6 and 17-19.

Each capacitor 120 includes conductive electrodes 122 and 124, and a material 126 (e.g., a ferroelectric material such as $PbTiO_3$, $BaTiO_3$, $PbZrO_3$, BST, BTO), which is in contact with both of the electrodes and which spans a gap 128 between the electrodes. The permittivity of the material 126 is tunable in response to a control voltage applied to, or across, the material via a respective control node 72. By changing a value of a control voltage on the control node 72, a controller circuit (not shown in FIG. 19) is configured to change the permittivity of the material 126, and, therefore, to change the dielectric constant and the capacitance of the capacitor 120. And changing the capacitance of the capacitor 120 changes the amount of the phase shift that the capacitor imparts to an intermediate signal propagating along the transmission medium 90. That is, for each value of the control voltage on the control node 72, the capacitor 120 imparts a respective phase shift to an intermediate signal propagating along the transmission medium 90. In more detail, the capacitor 120 shifts the phase of a respective component of the intermediate signal by an amount as the component forward propagates through the capacitor, and shifts the phase of the respective component again by approximately the amount as the component reverse propagates through the capacitor. The sum of all the reflected signal components on the transmission medium 90 effectively impart to the intermediate signal a total phase shift as the intermediate signal propagates out of the reflective reactance modulator 48 at the node 140.

Furthermore, each impedance network 260 can be, or can include, a suitable and respective RF bypass circuit, or a suitable and respective RF bypass structure (neither bypass circuit nor bypass structure shown in FIG. 19), coupled to the material 126 so that so that the RF signals do not affect, adversely, the DC operation of the reflective phase shifter. Said another way, the RF bypass circuits or RF bypass structures effectively isolate the DC-control-voltage-generating circuitry from the RF signals.

The operation of the reflective reactance modulator 48 of FIG. 19 is similar to the operation of the reflective reactance modulator 48 of FIG. 17 in an embodiment.

Still referring to FIG. 19, alternate embodiments of the reflective reactance modulator 48 are contemplated. For example, each of one or more of the capacitors 120 can have a structure that differs from the described structure. Further in example, one or both of the electrodes 122 and 124 may not contact the material 126. Furthermore, one or more embodiments described above in conjunction with FIGS. 1-18 and below in conjunction with FIGS. 20-21 may be applicable to the reflective reactance modulator 48 of FIG. 19.

Figure 20:
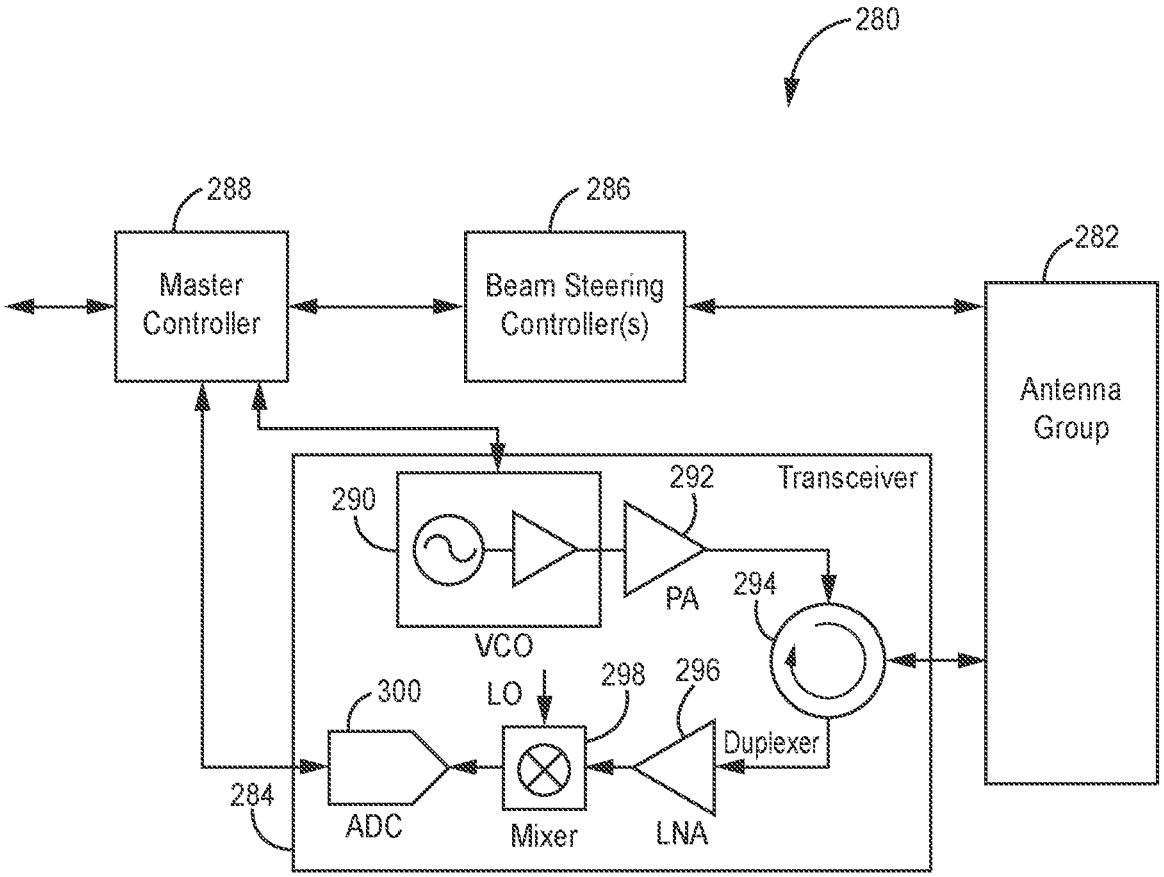
FIG. 20 is a diagram of a radar subsystem that includes at least one antenna array incorporating one or more of the antenna units of FIGS. 1-3, 7, and 9-15, according to an embodiment.

FIG. 20 is a block diagram of a radar subsystem 280, which includes an antenna group 282 having one or more of antennas, such as the antenna 34 of FIG. 1, the one or more antennas including one or more of the antenna units 32 described above in conjunction with FIGS. 1-3, 7, and 9-15, according to an embodiment.

In addition to the antenna group 282, the radar subsystem 280 includes a transceiver 284, a beam-steering controller 286, and a master controller 288.

The transceiver 284 includes a voltage-controlled oscillator (VCO) 290, a preamplifier (PA) 292, a duplexer 294, a low-noise amplifier (LNA) 296, a mixer 298, and an analog-to-digital converter (ADC) 300. The VCO 290 is configured to generate a reference signal having a frequency $f_0=c/\lambda_0$, which is the frequency for which at least one of the antennas of the antenna group 282 is designed. The PA 292 is configured to amplify the VCO signal, and the duplexer 294 is configured to couple the reference signal to the antennas of the antenna group 282, via one or more signal feeders (not shown in FIG. 20), as transmit versions of respective reference waves. One or both of the duplexer 294 and antenna group 292 can include one or more of the signal feeders. The duplexer 294 is also configured to receive versions of respective reference waves from the antennas of the antenna group 282, and to provide these receive versions of the respective reference waves to the LNA 296, which is configured to amplify these received signals. The mixer 298 is configured to shift the frequencies of the amplified received signals down to a base band, and the ADC 300 is configured to convert the down-shifted analog signals to digital signals for processing by the master controller 288.

The beam-steering controller 286 is configured to steer the beams (both transmit and receive beams) generated by the one or more antennas of the antenna group 282 by generating the control signals to the control ports of the antenna units as a function of time and main-beam position. By appropriately generating the control signals, the beam-steering controller 286 is configured to selectively activate, deactivate, and generate a phase shift for, the antenna elements of the antenna units according to selected spatial and temporal patterns.

The master controller 288 is configured to control the transceiver 284 and the beam-steering controller 286, and to analyze the digital signals from the ADC 300. For example, assuming that the one or more antennas of the antenna group 282 are designed to operate at frequencies in a range centered about $f_0$, the master controller 288 is configured to adjust the frequency of the signal generated by the VCO 290 for, e.g., environmental conditions such as weather, the average number of objects in the range of the one or more antennas of the antenna assembly, and the average distance of the objects from the one or more antennas, and to conform the signal to spectrum regulations. Furthermore, the master controller 288 is configured to analyze the signals from the ADC 300 to, e.g., identify a detected object, and to determine what action, if any, that a system including, or coupled to, the radar subsystem 280 should take. For example, if the system is a self-driving vehicle or a self-directed drone, then the master controller 288 is configured to determine what action (e.g., braking, swerving), if any, the vehicle should take in response to the detected object.

Operation of the radar subsystem 280 is described below, according to an embodiment. Any of the system components, such as the master controller 288, can store in a memory, and execute, software/program instructions to perform the below-described actions. Alternatively, any of the system components, such as the system controller 288, can store, in a memory, firmware that when loaded configures one or more of the system components to perform the below-described actions. Or any of the system components, such as the system controller 288, can be hardwired to perform the below-described actions.

The master controller 288 generates a control voltage that causes the VCO 290 to generate a reference signal at a frequency within a frequency range centered about $f_0$. For example, $f_0$ can be in the range of approximately 5 Gigahertz (GHz)-110 GHz.

The VCO 290 generates the signal, and the PA 292 amplifies the signal and provides the amplified signal to the duplexer 294.

The duplexer 294 can further amplify the signal, and couples the amplified signal to the one or more antennas of the antenna group 282 as a respective transmit version of a reference wave.

While the duplexer 294 is coupling the signal to the one or more antennas of the antenna group 282, the beam-steering controller 286, in response to the master controller 288, is generating control signals to the antenna units of the one or more antennas. These control signals cause the one or more antennas to generate and to steer one or more main signal-transmission beams. The control signals cause the one or more main signal-transmission beams to have desired characteristics (e.g., phase, amplitude, polarization, direction, half-power beam width (HPBW)), and also cause the side lobes to have desired characteristics such as suitable total side-lobe power and a suitable side-lobe level (e.g., a difference between the magnitudes of a smallest main signal-transmission beam and the largest side lobe).

Then, the master controller 288 causes the VCO 290 to cease generating the reference signal.

Next, while the VCO 290 is generating no reference signal, the beam-steering controller 286, in response to the master controller 288, generates control signals to the antenna units of the one or more antennas. These control signals cause the one or more antennas to generate and to steer one or more main signal-receive beams. The control signals cause the one or more main signal-receive beams to have desired characteristics (e.g., phase, amplitude, polarization, direction, half-power beam width (HPBW)), and also cause the side lobes to have desired characteristics such as suitable total side-lobe power and a suitable side-lobe level. Furthermore, the beam-steering controller 286 can generate the same sequence of control signals for steering the one or more main signal-receive beams as it does for steering the one or more main signal-transmit beams.

Then, the duplexer 294 couples receive versions of reference waves respectively generated by the one or more antennas of the antenna subassembly 282 to the LNA 296.

Next, the LNA 292 amplifies the received signals.

Then, the mixer 298 down-converts the amplified received signals from a frequency, e.g., at or near $f_0$, to a baseband frequency.

Next, the ADC 300 converts the analog down-converted signals to digital signals.

Then, the master system controller 288 analyzes the digital signals to obtain information from the signals and to determine what, if anything, should be done in response to the information obtained from the signals.

The master system controller 288 can repeat the above cycle one or more times.

Still referring to FIG. 20, alternate embodiments of the radar subsystem 280 are contemplated. For example, the radar subsystem 280 can include one or more additional components not described above, and can omit one or more of the above-described components. Furthermore, embodiments described above in conjunction with FIGS. 1-19 and below in conjunction with FIG. 21 may apply to the radar subsystem 280.

Figure 21:
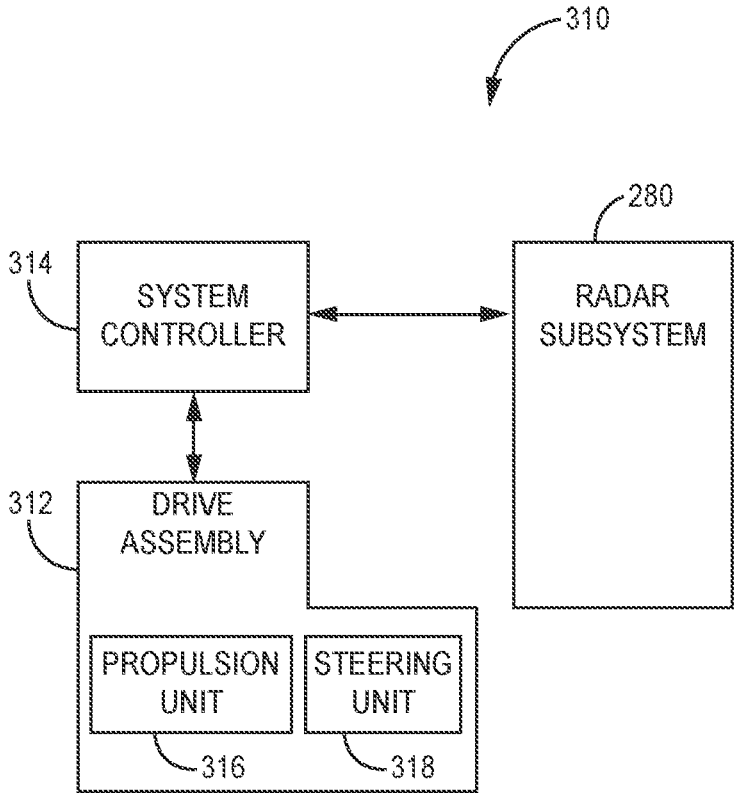
FIG. 21 is a diagram of a system that includes one or more of the radar subsystem of FIG. 20, according to an embodiment.

FIG. 21 is a block diagram of a system, such as a vehicle system 310, which includes the radar subsystem 280 of FIG. 22, according to an embodiment. For example, the vehicle system 310 can be an unmanned aerial vehicle (UAV) such as a drone, or a self-driving car.

In addition to the radar subsystem 280, the vehicle system 310 includes a drive assembly 312 and a system controller 314.

The drive assembly 312 includes a propulsion unit 316, such as an engine or motor, and includes a steering unit 318, such as a rudder, flaperon, pitch control, or yaw control (for, e.g., an UAV or drone), or a steering wheel linked to steerable wheels (for, e.g., a self-driving car).

The system controller 314 is configured to control, and to receive information from, the radar subsystem 280 and the drive assembly 312. For example, the system controller 314 can be configured to receive locations, sizes, and speeds of nearby objects from the radar subsystem 280, and to receive the speed and traveling direction of the vehicle system 310 from the drive assembly 312.

Operation of the vehicle system 310 is described below, according to an embodiment. Any of the system components, such as the system controller 314, can store in a memory, and execute, software/program instructions to perform the below-described actions. Alternatively, any of the system components, such as the system controller 314, can store, in a memory, firmware that when loaded configures one or more of the system components to perform the below-described actions. Or any of the system components, such as the system controller 314, can be circuitry hardwired to perform the below-described actions.

The system controller 314 activates the radar subsystem 280, which, as described above in conjunction with FIG. 20, provides to the system controller information regarding one or more objects in the vicinity of the vehicle system 310. For example, if the vehicle system 310 is an UAV or a drone, then the radar subsystem can provide information regarding one or more objects (e.g., birds, aircraft, and other UAVs/drones), in the flight path to the front, sides, and rear of the UAV/drone. Alternatively, if the vehicle system 310 is a self-driving car, then the radar subsystem 280 can provide information regarding one or more objects (e.g., other vehicles, debris, pedestrians, bicyclists) in the roadway or out of the roadway to the front, sides, and rear of the vehicle system.

In response to the object information from the radar subsystem 280, the system controller 314 determines what action, if any, the vehicle system 310 should take in response to the object information. Alternatively, the master controller 288 (FIG. 20) of the radar subsystem can make this determination and provide it to the system controller 314.

Next, if the system controller 314 (or master controller 288 of FIG. 20) determined that an action should be taken, then the system controller causes the drive assembly 312 to take the determined action. For example, if the system controller 314 or master controller 288 determined that a UAV system 310 is closing on an object in front of the UAV system, then the system controller 314 can control the propulsion unit 316 to reduce air speed. Or, if the system controller 314 or master controller 288 determined that an object in front of a self-driving system 310 is slowing down, then the system controller 314 can control the propulsion unit 316 to reduce engine speed and to apply a brake. Or if the system controller 314 or master controller 288 determined that evasive action is needed to avoid an object (e.g., another UAV/drone, a bird, a child who ran in front of the vehicle system) in front of the vehicle system 310, then the system controller 314 can control the propulsion unit 316 to reduce engine speed and, for a self-driving vehicle, to apply a brake, and can control the steering unit 318 to maneuver the vehicle system away from or around the object.

Still referring to FIG. 21, alternate embodiments of the vehicle system 310 are contemplated. For example, the vehicle system 310 can include one or more additional components not described above, and can omit one or more of the above-described components. Furthermore, the vehicle system 310 can be a vehicle system other than a UAV, drone, or self-driving car. Other examples of the vehicle system 310 include a watercraft, a motor cycle, a car that is not self-driving, and a spacecraft. Moreover, a system including the radar subsystem 280 can be other than a vehicle system. Furthermore, embodiments described above in conjunction with FIGS. 1-20 may apply to the vehicle system 310 of FIG. 21.

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated. In addition, any described component or operation may be implemented/performed in hardware, software, firmware, or a combination of any two or more of hardware, software, and firmware. Furthermore, one or more components of a described apparatus or system may have been omitted from the description for clarity or another reason. Moreover, one or more components of a described apparatus or system that have been included in the description may be omitted from the apparatus or system.

Example 1 includes an antenna unit, comprising: a coupler having a first input-output port, a second input-output port, and a first coupled port; a first phase-shifting modulator coupled to the first coupled port; and a first antenna element coupled to the first phase-shifting modulator.

Example 2 includes the antenna unit of Example 1 wherein the coupler is disposed in a layer of an antenna.

Example 3 includes the antenna unit of any of Examples 1-2 wherein the first phase-shifting modulator includes an input port coupled to the first coupled port and includes an output port coupled to the first antenna.

Example 4 includes the antenna unit of any of Examples 1-3 wherein: the first phase-shifting modulator is disposed in a layer of an antenna; and the first antenna element is disposed in another layer of the antenna.

Example 5 includes the antenna unit of any of Examples 1-4 wherein: the coupler includes an isolated port; and the first antenna element is coupled to first phase-shifting modulator via the isolated port.

Example 6 includes the antenna unit of any of Examples 1-5 wherein the first phase-shifting modulator includes a through phase modulator.

Example 7 includes the antenna unit of any of Examples 1-6 wherein the first phase-shifting modulator includes a reflective reactance modulator.

Example 8 includes the antenna unit of any of Examples 1-7 wherein the first antenna element includes an approximately planar conductor.

Example 9 includes the antenna unit of any of Examples 1-8, further comprising: wherein the coupler has a second coupled port; a second phase-shifting modulator coupled to the second coupled port; and a second antenna element coupled to the second phase-shifting modulator.

Example 10 includes the antenna unit of Example 9 wherein the second phase-shifting modulator includes an input port coupled to the second coupled port and includes an output port coupled to the second antenna.

Example 11 includes the antenna unit of any of Examples 9-10 wherein: the coupler includes an isolated port; and the second antenna element is coupled to the second phase-shifting modulator via the isolated port.

Example 12 includes the antenna unit of any of Examples 9-11 wherein the second antenna element is offset from the first antenna element in a dimension along which the first and second input-output ports lie.

Example 13 includes the antenna unit of any of Examples 9-12 wherein the second phase-shifting modulator includes a through phase modulator.

Example 14 includes the antenna unit of any of Examples 9-13 wherein the second phase-shifting modulator includes a reflective reactance modulator.

Example 15 includes the antenna unit of any of Examples 9-14 wherein the second antenna element includes an approximately planar conductor.

Example 16 includes an antenna unit, comprising: a coupler configured to generate an output signal and a first intermediate signal in response to an input signal; a first phase-shifting modulator configured to generate a first phase-shifted signal in response to the first intermediate signal; and a first antenna element configured to radiate a first transmit signal in response to the first phase-shifted signal.

Example 17 includes the antenna unit of Example 16 wherein the coupler is configured to generate: the output signal at an output port; and the first intermediate signal at a coupled port.

Example 18 includes the antenna unit of any of Examples 16-17 wherein: the coupler is configured to generate the output signal at an output port, and the first intermediate signal at a coupled port; and the first phase-shifting modulator is configured to receive the first intermediate signal from the coupled port.

Example 19 includes the antenna unit of any of Examples 16-18 wherein the first antenna element is configured to receive the first phase-shifted signal from the first phase-shifting modulator via a primary signal path that excludes the coupler.

Example 20 includes the antenna unit of any of Examples 16-19 wherein: the coupler is configured to generate the output signal at an output port, to generate the first intermediate signal at a coupled port, to receive the first phase-shifted signal at the coupled port, and to couple the first phase-shifted signal from the coupled port to an isolated port; and the first antenna element is configured to receive the first phase-shifted signal from the isolated port.

Example 21 includes the antenna unit of any of Examples 16-20, further comprising: wherein the coupler is configured to generate a second intermediate signal in response to the input signal; a second phase-shifting modulator configured to generate a second phase-shifted signal in response to the second intermediate signal; and a second antenna element configured to radiate a second transmit signal in response to the second phase-shifted signal.

Example 22 includes the antenna unit of Example 21 wherein the coupler is configured to generate the second intermediate signal at a coupled port.

Example 23 includes the antenna unit of any of Examples 21-22 wherein: the coupler is configured to generate the second intermediate signal at a coupled port; and the second phase-shifting modulator is configured to receive the second intermediate signal from the coupled port.

Example 24 includes the antenna unit of any of Examples 21-23 wherein the second antenna element is configured to receive the second phase-shifted signal from the second phase-shifting modulator via a primary signal path that excludes the coupler.

Example 25 includes the antenna unit of any of Examples 21-24 wherein: the coupler is configured to generate the second intermediate signal at a coupled port, to receive the second phase-shifted signal at the coupled port, and to couple the second phase-shifted signal from the coupled port to an isolated port; and the second antenna element is configured to receive the second phase-shifted signal from the isolated port.

Example 26 includes an antenna unit, comprising: a first antenna element configured to generate a first intermediate signal in response to a first receive signal; a first phase-shifting modulator configured to generate a first phase-shifted signal in response to the first intermediate signal; and a coupler configured to generate an output signal in response to an input signal and the first phase-shifted signal.

Example 27 includes the antenna unit of Example 26 wherein the coupler is configured: to receive the input signal at an input port; and to receive the first phase-shifted signal at a coupled port.

Example 28 includes the antenna unit of any of Examples 26-27 wherein: the coupler is configured to receive the first intermediate signal at an isolated port, the input signal at an input port, and the first phase-shifted signal at a coupled port; and the first phase-shifting modulator is configured to receive the first intermediate signal from the coupled port.

Example 29 includes the antenna unit of any of Examples 26-28 wherein the first antenna element is configured to provide the first intermediate signal to the first phase-shifting modulator via a primary signal path that excludes the coupler.

Example 30 includes the antenna unit of any of Examples 26-29 wherein: the coupler is configured to generate the output signal at an output port, to receive the first phase-shifted signal at a coupled port, and to receive the first intermediate signal at an isolated port; and the first antenna element is configured generate the first intermediate signal at the isolated port.

Example 31 includes the antenna unit of any of Examples 26-30, further comprising: a second antenna element configured to generate a second intermediate signal in response to a second receive signal; a second phase-shifting modulator configured to generate a second phase-shifted signal in response to the second intermediate signal; and wherein the coupler is configured to generate the output signal in response to the second phase-shifted signal.

Example 32 includes the antenna unit of any of Examples 26-31 wherein the coupler is configured to receive the second phase-shifted signal at a coupled port.

Example 33 includes the antenna unit of any of Examples 26-32 wherein: the coupler is configured to receive the second phase-shifted signal at a coupled port; and the second phase-shifting modulator is configured to generate the second phase-shifted signal at the coupled port.

Example 34 includes the antenna unit of any of Examples 26-33 wherein the second antenna element is configured to provide the second intermediate signal to the second phase-shifting modulator via a primary signal path that excludes the coupler.

Example 35 includes the antenna unit of any of Examples 26-34 wherein: the coupler is configured to receive the second phase-shifted signal at a coupled port, and the second intermediate signal at an isolated port; and the second antenna element is configured to generate the second intermediate signal at the isolated port.

Example 36 includes an antenna, comprising: control nodes; and an array of antenna units each including a respective coupler having a first input-output port, a second input-output port, and a first coupled port, a respective first phase-shifting modulator coupled to the first coupled port and to a respective at least one of the control nodes, and a respective first antenna element coupled to the respective first phase-shifting modulator.

Example 37 includes the antenna of Example 36 wherein the array of antenna units includes a one-dimensional array of antenna units.

Example 38 includes the antenna of any of Examples 36-37 wherein the array of antenna units includes a two-dimensional array of antenna units.

Example 39 includes the antenna of any of Examples 36-38 wherein the array of antenna units includes a three-dimensional array of antenna units.

Example 40 includes the antenna of any of Examples 36-39 wherein the antenna element of one antenna unit is spaced from an antenna element of another antenna unit at least by a distance approximately equal to one half of a free-space wavelength of a signal that the antenna units are configured to receive.

Example 41 includes the antenna of any of Examples 36-40 wherein the antenna element of one antenna unit is spaced from an antenna element of another antenna unit at least by a distance that is less than one half of a wavelength of a free-space wavelength of a signal that the antenna units are configured to receive.

Example 42 includes the antenna of any of Examples 36-41 wherein at least one of the antenna elements has an approximately square shape.

Example 43 includes the antenna of any of Examples 36-42 wherein an input-output port of a coupler of a first one of the antenna units is coupled to an input-output port of a coupler of a second antenna unit.

Example 44 includes the antenna of any of Examples 36-43 wherein an input-output port of a coupler of one of the antenna units at an end of a row of antenna units is configured for coupling to a transceiver.

Example 45 includes the antenna of any of Examples 36-44 wherein an input-output port of a coupler of one of the antenna units at an end of a row of antenna units is configured for coupling to a terminator.

Example 46 includes the antenna of any of Examples 36-45 wherein the respective first phase-shifting modulator of one of the antenna units includes an input port coupled to the first coupled port of the respective coupler and includes an output port coupled to the respective first antenna.

Example 47 includes the antenna of any of Examples 36-46 wherein: the respective coupler of one of the antenna units includes an isolated port; and the respective first antenna element of the one of the antenna units is coupled to respective first phase-shifting modulator via the isolated port.

Example 48 includes the antenna of any of Examples 36-47, wherein one of the antenna units further comprises: wherein the respective coupler of the one of the antenna units has a second coupled port; a respective second phase-shifting modulator coupled to the second coupled port; and a respective second antenna element coupled to the second phase-shifting modulator.

Example 49 includes the antenna of any of Examples 36-48 wherein the respective second phase-shifting modulator includes an input port coupled to the second coupled port and includes an output port coupled to the second antenna element.

Example 50 includes the antenna of any of Examples 36-49 wherein: the respective coupler includes an isolated port; and the respective second antenna element is coupled to the isolated port.

Example 51 includes the antenna of any of Examples 36-50 wherein: the respective first antenna element of each of the antenna units forms part of a first row of antenna elements; and the respective second antenna element of each of the antenna units forms part of a second row of antenna elements.

Example 52 includes a radar subsystem, comprising: an antenna, including, control nodes; an array of antenna units each including a respective coupler having a first input-output port, a second input-output port, and a coupled port, a respective phase-shifting modulator coupled to the coupled port and to a respective at least one of the control nodes, and a respective antenna element coupled to the respective phase-shifting modulator; a transceiver circuit configured to generate, and to provide to the antenna, a transmit reference wave, and to receive, from the antenna, a receive reference wave; a beam-steering controller circuit configured to generate, on the control nodes, respective control signals to cause the antenna to generate, with each respective antenna element, a respective transmit signal in response to the at transmit reference wave, to form, from the transmit signals, a transmit beam pattern including a main transmit beam, to steer the main transmit beam, to receive, with each respective antenna element, a respective receive signal, to form, from the receive signals, a receive beam pattern including a main receive beam, to steer the main receive beam, and to generate, in response to the main receive beam, the receive reference wave; and a master controller circuit configured to detect, in response to the receive reference wave from the transceiver circuit, an object.

Example 53 includes a vehicle, comprising: a radar subsystem, including an antenna, including, control nodes, an array of antenna units each including a respective coupler having a first input-output port, a second input-output port, and a coupled port, a respective phase-shifting modulator coupled to the coupled port and to a respective at least one of the control nodes, and a respective antenna element coupled to the respective phase shifter, a transceiver circuit configured to generate, and to provide to the antenna, a transmit reference wave, and to receive, from the antenna, a receive reference wave, a beam-steering controller circuit configured to generate, on the control nodes, respective control signals to cause the antenna to generate, with each respective antenna element, a respective transmit signal in response to the at transmit reference wave, to form, from the transmit signals, a transmit beam pattern including a main transmit beam, to steer the main transmit beam, to receive, with each respective antenna element, a respective receive signal, to form, from the receive signals, a receive beam pattern including a main receive beam, to steer the main receive beam, and to generate, in response to the main receive beam, the receive reference wave, and a master controller circuit configured to detect, in response to the receive reference wave from the transceiver circuit, an object; a drive assembly; and a controller circuit configured to control the drive assembly in response to the detected object.

Example 54 includes the system of Example 53 wherein the drive assembly comprises: a propulsion unit; and a steering unit.

Example 55 includes a method, comprising: generating, in response to an input signal, a first intermediate signal on a first coupled port of a coupler and an output signal on an output port of the coupler; shifting a phase of the first intermediate signal; and radiating a first transmit signal with a first antenna element in response to the phase-shifted first intermediate signal.

Example 56 includes the method of Example 55, further comprising: wherein shifting the phase includes shifting the phase of the intermediate signal as the intermediate signal passes from an input port of a phase-shifting modulator to an output port of the phase-shifting modulator; and coupling the phase-shifted intermediate signal from the output port of the phase-shifting modulator to the first antenna element.

Example 57 includes the method of any of Examples 55-56, further comprising: wherein shifting the phase includes shifting the phase of the first intermediate signal as the first intermediate signal passes from a port at a first location of a phase-shifting modulator to a second location of the phase-shifting modulator and back to the port; and coupling the phase-shifted first intermediate signal from the port of the phase-shifting modulator to the coupled port of the coupler, from the coupled port of the coupler to an isolated port of the coupler, and from the isolated port of the coupler to the first antenna element.

Example 58 includes the method of any of Examples 55-57, further comprising: generating, in response to the input signal, a second intermediate signal on a second coupled port of the coupler; shifting a phase of the second intermediate signal; and radiating a second transmit signal with a second antenna element in response to the phase-shifted second intermediate signal.

Example 59 includes the method of any of Examples 55-58, further comprising: wherein shifting the phase includes shifting the phase of the second intermediate signal as the second intermediate signal passes from an input port of a phase-shifting modulator to an output port of the phase-shifting modulator; and coupling the phase-shifted second intermediate signal from the output port of the phase shifting modulator to the second antenna element.

Example 60 includes the method of any of Examples 55-59, further comprising: wherein shifting the phase includes shifting the phase of the second intermediate signal as the second intermediate signal passes from a port at a first location of a phase-shifting modulator to a second location of the phase-shifting modulator and back to the port; and coupling the phase-shifted second intermediate signal from the port of the phase-shifting modulator to the second coupled port of the coupler, from the second coupled port of the coupler to an isolated port of the coupler, and from the isolated port of the coupler to the second antenna element.

Example 61 includes a method, comprising: generating, in response to a first receive signal, a first intermediate signal with a first antenna element; shifting a phase of the first intermediate signal; and generating, in response to an input signal on an input port of a coupler and the phase-shifted first intermediate signal on a first coupled port of the coupler, an output signal on an output port of the coupler.

Example 62 includes the method of Example 61, further comprising: wherein shifting a phase includes shifting a phase of the first intermediate signal as the first intermediate signal passes from an input port of a phase-shifting modulator to an output port of the phase-shifting modulator; and coupling the phase-shifted first intermediate signal from the output port of the phase-shifting modulator to the first coupled port of the coupler.

Example 63 includes the method of any of Examples 61-62, further comprising: coupling the first intermediate signal to an isolated port of the coupler, and from the isolated port to the first coupled port of the coupler; wherein shifting a phase includes receiving the first intermediate signal from the first coupled port of the coupler at a port of a phase-shifting modulator, and shifting a phase of the first intermediate signal as the first intermediate signal passes from the port of the phase-shifting modulator to another location of the phase-shifting modulator and back to the port; and coupling the phase-shifted first intermediate signal from the port of the phase-shifting modulator to the first coupled port of the coupler.

Example 64 includes the method of any of Examples 61-63, further comprising: generating, in response to a second receive signal, a second intermediate signal with a second antenna element; shifting a phase of the second intermediate signal; generating, in response to the input signal, the phase-shifted first intermediate signal, and the phase-shifted second intermediate signal at a second coupled port of the coupler, the output signal.

Example 65 includes the method of any of Examples 61-64, further comprising: coupling the second intermediate signal to an isolated port of the coupler, and from the isolated port to the second coupled port of the coupler; wherein shifting the phase includes shifting the phase of the second intermediate signal as the second intermediate signal passes from an input port of a phase-shifting modulator to an output port of the phase-shifting modulator; and coupling the phase-shifted second intermediate signal from the output port of the phase-shifting modulator to the second coupled port of the coupler.

Example 66 includes the method of any of Examples 61-65, further comprising: coupling the second intermediate signal to an isolated port of the coupler, and from the isolated port to the second coupled port of the coupler; wherein shifting a phase of the second intermediate signal includes receiving the second intermediate signal from the second coupled port of the coupler at a port of a phase-shifting modulator, and shifting a phase of the second intermediate signal as the second intermediate signal passes from the port of the phase-shifting modulator to another location of the phase-shifting modulator and back to the port; and coupling the phase-shifted second intermediate signal from the port of the phase-shifting modulator to the second coupled port of the coupler.

The invention claimed is:

1. An antenna unit, comprising:

a coupler having a first input-output port, a second input-output port, and a first coupled port;

a first phase-shifting modulator coupled to the first coupled port; and a first antenna element coupled to the first phase-shifting modulator.

2. The antenna unit of claim 1 wherein the first phase-shifting modulator includes a reflective reactance modulator.

3. The antenna unit of claim 1 wherein the first antenna element includes an approximately planar conductor.

4. An antenna unit, comprising:

a coupler having a first input-output port, a second input-output port, and a first coupled port;

a first phase-shifting modulator including an input port coupled to the first coupled port, and an output port; and a first antenna element coupled to the output port of the first phase-shifting modulator.

5. An antenna unit, comprising:

a coupler having a first input-output port, a second input-output port, an isolated port, and a first coupled port;

a first phase-shifting modulator coupled to the first coupled port; and a first antenna element coupled to the first phase-shifting modulator via the isolated port.

6. The antenna unit of claim 1 wherein the first phase-shifting modulator includes a through phase modulator.

7. An antenna unit, comprising:

a coupler having a first input-output port, a second input-output port, a first coupled port, and a second coupled port;

a first phase-shifting modulator coupled to the first coupled port;

a first antenna element coupled to the first phase-shifting modulator;

a second phase-shifting modulator coupled to the second coupled port; and a second antenna element coupled to the second phase-shifting modulator.

8. The antenna unit of claim 7 wherein the second phase-shifting modulator includes an input port coupled to the second coupled port and includes an output port coupled to the second antenna.

9. The antenna unit of claim 7 wherein:

the coupler includes an isolated port; and the second antenna element is coupled to the second phase-shifting modulator via the isolated port.

10. The antenna unit of claim 7 wherein the second antenna element is offset from the first antenna element in a dimension along which the first and second input-output ports lie.

11. An antenna, comprising:

control nodes; and an array of antenna units each including a respective coupler having a first input-output port, a second input-output port, and a first coupled port, a respective first phase-shifting modulator coupled to the first coupled port and to a respective at least one of the control nodes, and a respective first antenna element coupled to the respective first phase-shifting modulator.

12. The antenna of claim 11 wherein the array of antenna units includes a one-dimensional array of antenna units.

13. The antenna of claim 11 wherein the array of antenna units includes a two-dimensional array of antenna units.

14. The antenna of claim 11 wherein the antenna element of one antenna unit is spaced from an antenna element of another antenna unit at least by a distance approximately equal to one half of a free-space wavelength of a signal that the antenna units are configured to receive.

15. The antenna of claim 11 wherein the antenna element of one antenna unit is spaced from an antenna element of another antenna unit at least by a distance that is less than one half of a wavelength of a free-space wavelength of a signal that the antenna units are configured to receive.

16. The antenna of claim 11 wherein an input-output port of a coupler of a first one of the antenna units is coupled to an input-output port of a coupler of a second antenna unit.

17. The antenna of claim 11 wherein an input-output port of a coupler of one of the antenna units at an end of a row of antenna units is configured for coupling to a transceiver.

18. The antenna of claim 11 wherein an input-output port of a coupler of one of the antenna units at an end of a row of antenna units is configured for coupling to a terminator.

19. The antenna of claim 11, wherein one of the antenna units further comprises:

wherein the respective coupler of the one of the antenna units has a second coupled port;

a respective second phase-shifting modulator coupled to the second coupled port; and a respective second antenna element coupled to the second phase-shifting modulator.

20. The antenna of claim 19 wherein:

the respective first antenna element of each of the antenna units forms part of a first row of antenna elements; and the respective second antenna element of each of the antenna units forms part of a second row of antenna elements.

21. A radar subsystem, comprising:

an antenna, including, control nodes;

an array of antenna units each including a respective coupler having a first input-output port, a second input-output port, and a coupled port, a respective phase-shifting modulator coupled to the coupled port and to a respective at least one of the control nodes, and a respective antenna element coupled to the respective phase-shifting modulator;

a transceiver circuit configured to generate, and to provide to the antenna, a transmit reference wave, and to receive, from the antenna, a receive reference wave;

a beam-steering controller circuit configured to generate, on the control nodes, respective control signals to cause the antenna to generate, with each respective antenna element, a respective transmit signal in response to the at transmit reference wave, to form, from the transmit signals, a transmit beam pattern including a main transmit beam, to steer the main transmit beam, to receive, with each respective antenna element, a respective receive signal, to form, from the receive signals, a receive beam pattern including a main receive beam, to steer the main receive beam, and to generate, in response to the main receive beam, the receive reference wave; and a master controller circuit configured to detect, in response to the receive reference wave from the transceiver circuit, an object.

22. A method, comprising:

generating, in response to an input signal, a first intermediate signal on a first coupled port of a coupler and an output signal on an input-output port of the coupler;

shifting a phase of the first intermediate signal; and radiating a first transmit signal with a first antenna element in response to the phase-shifted first intermediate signal.

23. The method of claim 22, further comprising:

wherein shifting the phase includes shifting the phase of the intermediate signal as the intermediate signal passes from an input port of a phase-shifting modulator to an output port of the phase-shifting modulator; and coupling the phase-shifted intermediate signal from the output port of the phase-shifting modulator to the first antenna element.

24. A method, comprising:

generating, in response to an input signal, a first intermediate signal on a first coupled port of a coupler and an output signal on an output port of the coupler;

shifting a phase of the first intermediate signal as the first intermediate signal passes from a port at a first location of a phase-shifting modulator to a second location of the phase-shifting modulator and back to the port;

coupling the phase-shifted first intermediate signal from the port of the phase-shifting modulator to the coupled port of the coupler, from the coupled port of the coupler to an isolated port of the coupler, and from the isolated port of the coupler to a first antenna element; and radiating a first transmit signal with the first antenna element in response to the phase-shifted first intermediate signal.

25. A method, comprising:

generating, in response to an input signal, a first intermediate signal on a first coupled port of a coupler and an output signal on an output port of the coupler;

shifting a phase of the first intermediate signal;

radiating a first transmit signal with a first antenna element in response to the phase-shifted first intermediate signal;

generating, in response to the input signal, a second intermediate signal on a second coupled port of the coupler;

shifting a phase of the second intermediate signal; and radiating a second transmit signal with a second antenna element in response to the phase-shifted second intermediate signal.

26. A method, comprising:

generating, in response to a first receive signal, a first intermediate signal with a first antenna element;

shifting a phase of the first intermediate signal; and generating, in response to an input signal on a first input-output port of a coupler and the phase-shifted first intermediate signal on a first coupled port of the coupler, an output signal on a second input-output port of the coupler.

27. The method of claim 26, further comprising:

wherein shifting a phase includes shifting a phase of the first intermediate signal as the first intermediate signal passes from an input port of a phase-shifting modulator to an output port of the phase-shifting modulator; and coupling the phase-shifted first intermediate signal from the output port of the phase-shifting modulator to the first coupled port of the coupler.

28. A method, comprising:

generating, in response to a first receive signal, a first intermediate signal with a first antenna element;

coupling the first intermediate signal to an isolated port of a coupler, and from the isolated port to a first coupled port of the coupler;

receiving the first intermediate signal from the first coupled port of the coupler at a port of a phase-shifting modulator, shifting a phase of the first intermediate signal as the first intermediate signal passes from the port of the phase-shifting modulator to another location of the phase-shifting modulator and back to the port;

coupling the phase-shifted first intermediate signal from the port of the phase-shifting modulator to the first coupled port of the coupler; and generating, in response to an input signal on an input port of the coupler and the phase-shifted first intermediate signal on the first coupled port of the coupler, an output signal on an output port of the coupler.

29. A method, comprising:

generating, in response to a first receive signal, a first intermediate signal with a first antenna element;

shifting a phase of the first intermediate signal;

generating, in response to an input signal on an input port of a coupler and the phase-shifted first intermediate signal on a first coupled port of the coupler, an output signal on an output port of the coupler;

generating, in response to a second receive signal, a second intermediate signal with a second antenna element;

shifting a phase of the second intermediate signal; and generating, in response to the input signal, the phase-shifted first intermediate signal, and the phase-shifted second intermediate signal at a second coupled port of the coupler, the output signal.

* * * * *